US007894754B2

(12) United States Patent
Hazeyama

(10) Patent No.: US 7,894,754 B2
(45) **Date of Patent: *Feb. 22, 2011**

(54) IMAGE FORMING APPARATUS HAVING DEVELOPER SUPPLY APPARATUS

(75) Inventor: Tomoaki Hazeyama, Yokkaichi (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

This patent is subject to a terminal disclaimer.

(21) Appl. No.: 12/412,188

(22) Filed: Mar. 26, 2009

(65) Prior Publication Data

US 2009/0185834 A1 Jul. 23, 2009

Related U.S. Application Data

(63) Continuation of application No. PCT/JP2007/068912, filed on Sep. 20, 2007.

(30) Foreign Application Priority Data

Sep. 26, 2006 (JP) ..... 2006-261374
Oct. 16, 2006 (JP) ..... 2006-281579

(51) Int. Cl.
*G03G 15/08* (2006.01)

(52) U.S. Cl. ..... 399/266; 399/290; 399/291
(58) Field of Classification Search ..... 399/266, 399/290–291
See application file for complete search history.

(56) References Cited

U.S. PATENT DOCUMENTS

| | | | | |
|---|---|---|---|---|
| 4,598,991 | A | 7/1986 | Hosoya et al. | |
| 6,070,036 | A * | 5/2000 | Thompson et al. | 399/266 |
| 6,597,884 | B2 | 7/2003 | Miyaguchi et al. | |
| 6,901,231 | B1 * | 5/2005 | Sakai et al. | 399/266 |
| 6,901,232 | B2 | 5/2005 | Sakuma et al. | |
| 6,941,098 | B2 * | 9/2005 | Miyaguchi et al. | 399/266 |
| 7,647,013 | B2 * | 1/2010 | Hazeyama | 399/265 |
| 2009/0297227 | A1 * | 12/2009 | Hazeyama et al. | 399/265 |
| 2010/0028056 | A1 * | 2/2010 | Nishiwaki | 399/266 |

FOREIGN PATENT DOCUMENTS

| | | |
|---|---|---|
| JP | 59-189372 | 10/1984 |
| JP | 63-013075 | 1/1988 |
| JP | 05-031146 | 5/1993 |
| JP | 2002-082524 | 3/2002 |
| JP | 2002-091159 | 3/2002 |
| JP | 2002-287484 | 10/2002 |

(Continued)

OTHER PUBLICATIONS

International Search Report: PCT/JP2007/068912, Mailing Date: Jan. 8, 2008.

*Primary Examiner*—Ryan D Walsh
(74) *Attorney, Agent, or Firm*—Banner & Witcoff, Ltd.

(57) ABSTRACT

A toner supply apparatus 6 is configured to be able to supply a charged toner T to a latent image forming surface LS of a photoconductor drum 3. The toner supply apparatus 6 houses a toner electric field transport body 62. The toner electric field transport body 62 has first portions and second portions which differ in toner T transport force. The first portions and the second portions differ in structural feature, such as relative dielectric constant or thickness. By means of such a structural difference, the state of transport of the toner T on the toner transport surface TTS is appropriately set.

1 Claim, 37 Drawing Sheets

FOREIGN PATENT DOCUMENTS

| | | |
|---|---|---|
| JP | 2002-365912 | 12/2002 |
| JP | 2003-076136 | 3/2003 |
| JP | 2003-098826 | 4/2003 |
| JP | 2004-333845 | 11/2004 |
| JP | 2005-275127 | 10/2005 |
| JP | 2008-076681 | 4/2008 |
| JP | 2008-083237 | 4/2008 |
| JP | 2008-083241 | 4/2008 |

* cited by examiner

IMAGE FORMING APPARATUS HAVING DEVELOPER SUPPLY APPARATUS

This application is a continuation application of prior application no. PCT/JP2007/068912, filed Sep. 20, 2007, which claims priority to Japanese patent application no. 2006-261374, filed Sep. 26, 2006 and Japanese patent application no. 2006-281579, filed Oct. 16, 2006. The entire subject matter and contents of these priority applications are incorporated herein by reference.

TECHNICAL FIELD

The present invention relates to an image forming apparatus.

BACKGROUND ART

Conventionally, there have been known many developer supply apparatuses capable of supplying a developer (dry developer or dry toner) to a predetermined object (a photoconductor drum or the like) to which the developer is to be supplied (hereinafter such an object will be referred to as a "target object") in an image forming apparatus, and many developer electric-field transport apparatuses which are provided in the developer supply apparatuses (see, for example, Japanese Patent Publication (kokoku) No. H5-31146 and Japanese Patent Application Laid-Open (kokai) Nos. 2002-91159, 2003-98826, 2004-333845, and 2005-275127).

Such a developer electric-field transport apparatus is configured to transport a developer in a predetermined developer transport direction by use of a traveling wave electric field. Typically, in the developer electric-field transport apparatus, a large number of elongated electrodes are arrayed on an insulative base material. These electrodes are arranged along the developer transport direction. The developer is stored in a predetermined casing.

In the developer electric-field transport apparatus having the above-described structure, polyphase AC voltages are sequentially applied to the electrodes, whereby a traveling wave electric field is formed. By the action of the traveling wave electric field, the developer in a charged state is transported in the developer transport direction.

DISCLOSURE OF THE INVENTION

In an image forming apparatus equipped with a developer electric-field transport apparatus as described above, in order to suppress generation of "white-background fogging," or in order to attain a necessary image density, the state of transport of the developer in the developer transport direction must be set properly.

The term "white-background fogging" refers to a phenomenon in which pixels are erroneously formed in a white background portion in which pixels are not to be formed by the developer. Such "white-background fogging" becomes remarkable when the developer is erroneously jetted into a space in the vicinity of the predetermined target object such as the photoconductor drum or the like, in particular, to a position separated from a predetermined position (a developing position or a developer carrying position) on the target object to which position the developer must be supplied.

The present invention has been conceived for solving the above-mentioned problems. That is, an object of the invention is to provide a developer electric field transport apparatus in which the state of transport of a developer in a developer transport direction can be appropriately set, a developer supply apparatus which includes the developer electric field transport apparatus, whereby the state of supply of the developer can be appropriately set, and an image forming apparatus which includes the developer supply apparatus, whereby image formation by use of the developer can be performed more satisfactorily.

The developer electric field transport apparatus of the present invention is configured to be able to transport a charged developer along a predetermined developer transport direction by the effect of an electric field. The developer electric field transport apparatus is disposed in such a manner as to face a developer carrying body.

The developer carrying body has a developer carrying surface. The developer carrying surface is a surface of the developer carrying body and can carry the developer thereon. The developer carrying surface is formed in parallel with a predetermined main scanning direction.

The developer carrying surface can move along a predetermined moving direction. The moving direction can be set in parallel with a sub-scanning direction orthogonal to the main scanning direction.

Specifically, for example, an electrostatic latent image carrying body configured to be able to form an electrostatic latent image thereon by means of electric potential distribution can be used as the developer carrying body. In this case, the developer carrying surface assumes the form of a latent image forming surface. The latent image forming surface is a circumferential surface of the electrostatic latent image carrying body. The latent image forming surface is configured to be able to form the electrostatic latent image thereon.

Alternatively, the developer carrying body can be, for example, a recording medium (paper or the like) which is transported along the sub-scanning direction. In this case, the developer carrying surface is implemented by the surface (recording surface) of the recording medium.

Alternatively, the developer carrying body can be, for example, a roller, a sleeve, or a belt member (a developing roller, a developing sleeve, an intermediate transfer belt, etc.). These members are disposed, for example, in such a manner as to face the recording medium or the electrostatic latent image carrying body. These members are configured and disposed so as to be able to transfer the developer onto the recording medium or the electrostatic latent image carrying body.

The developer electric field transport apparatus of the present invention comprises a plurality of transport electrodes.

The transport electrodes are configured to have their longitudinal direction intersecting with the sub-scanning direction. Also, the transport electrodes are arrayed along the sub-scanning direction. The plurality of transport electrodes are configured (and disposed) to generate a traveling wave electric field through application of traveling wave voltages thereto and to be able to transport the developer along a predetermined developer transport direction by the effect of the electric field.

An image forming apparatus of the present invention comprises an electrostatic latent image carrying body serving as the developer carrying body, and a developer supply apparatus.

The electrostatic latent image carrying body has a latent image forming surface. The latent image forming surface is formed in parallel with a predetermined main scanning direction. The latent image forming surface is configured to be able to form an electrostatic latent image thereon by means of electric potential distribution. The electrostatic latent image carrying body is configured such that the latent image forming surface can move along a sub-scanning direction orthogonal to the main scanning direction.

The developer supply apparatus is disposed in such a manner as to face the electrostatic latent image carrying body. The developer supply apparatus is configured to be able to supply a developer in a charged state to the latent image forming surface. The developer supply apparatus comprises the developer electric field transport apparatus.

To achieve the above-mentioned object of the present invention, a developer electric field transport apparatus, a developer supply apparatus, and an image forming apparatus of the present invention can be configured as follows.

[1]

(1) The developer electric field transport apparatus (the developer supply apparatus) comprises an electrode support member and a transport electrode cover member.

The electrode support member is configured to support the transport electrodes. The transport electrodes are supported on the surface of the electrode support member.

The transport electrode cover member is formed in such a manner as to cover the transport electrodes and the surface of the electrode support member. The transport electrode cover member has a developer transport surface. The developer transport surface is in parallel with the main scanning direction and faces the developer carrying surface (the latent image forming surface).

The developer electric field transport apparatus (the developer supply apparatus) can further comprise a transport electrode cover intermediate layer. The transport electrode cover intermediate layer is formed between the transport electrode cover member and the transport electrodes.

The characteristic feature of the present invention resides in that the transport electrode cover member and/or the transport electrode cover intermediate layer is formed such that, in an area in the vicinity of a closest proximity position where the developer carrying surface (the latent image forming surface) and the developer transport surface face in the closest proximity to each other, the transport electrode cover member and/or the transport electrode cover intermediate layer has different relative dielectric constants at first and second portions, respectively, wherein the first portions correspond to the transport electrodes, and the second portions differ from the first portions.

In such a configuration, when traveling wave voltages are applied to the transport electrodes, an electric field component in a direction (vertical direction) perpendicular to the developer transport surface increases at boundaries between the first portions and the second portions. In particular, this phenomenon occurs at opposite ends, with respect to the sub-scanning direction, of each second portion provided between adjacent first portions corresponding to adjacent transport electrodes set to mutually different electrical potentials.

Therefore, a force for lifting the developer in the vertical direction acts more strongly at the boundaries between the first and second portions in the area in the vicinity of the closest proximity position. That is, the developer can be accelerated toward the developer carrying surface in the area where the developer is carried onto the developer carrying surface (the latent image forming surface).

According to such a configuration, in the area in the vicinity of the closest proximity position, the developer can be effectively lifted toward the developer carrying surface (the latent image forming surface). Thus, a proper (sufficient) image density can be obtained.

Further, through proper setting of a range in which relative dielectric constant differs between the first and second portions, it becomes possible to effectively lift the developer in a necessary area, while suppressing unnecessary lifting of the developer in areas unrelated to carrying of the developer onto the developer carrying surface (the latent image forming surface).

As described above, according to such a configuration, the state of transport of the developer in the developer transport direction can be appropriately set. Therefore, image formation by use of the developer can be performed more satisfactorily.

(2) The developer electric field transport apparatus (the developer supply apparatus) can comprise a plurality of counter electrodes, a counter electrode support member, and a counter electrode cover member.

The counter electrodes are disposed in such a manner as to face the transport electrodes with a predetermined gap therebetween. The plurality of counter electrodes are arrayed along the sub-scanning direction and are configured to be able to transport the developer in the developer transport direction through application of traveling wave voltages thereto.

The counter electrode support member is configured to support the counter electrodes on its surface. The counter electrode support member is disposed in such a manner as to face the transport electrode support member via the gap.

The counter electrode cover member is formed in such a manner as to cover the counter electrodes and the surface of the counter electrode support member.

The developer electric field transport apparatus (the developer supply apparatus) can further comprise a counter electrode cover intermediate layer. The counter electrode cover intermediate layer is formed between the counter electrode cover member and the counter electrodes.

The characteristic feature of the present invention resides in that the counter electrode cover member and/or the counter electrode cover intermediate layer is formed such that, in a counter area neighboring area in the vicinity of a counter area where the developer carrying surface (the latent image forming surface) and the developer transport surface face each other, the counter electrode cover member and/or the counter electrode cover intermediate layer has different relative dielectric constants at first and second portions, respectively, wherein the first portions correspond to the counter electrodes, and the second portions differ from the first portions.

In such a configuration, when traveling wave voltages are applied to the counter electrodes, an electric field component in a direction (vertical direction) perpendicular to the developer transport surface increases at boundaries between the first portions and the second portions. In particular, this phenomenon occurs at opposite ends, with respect to the sub-scanning direction, of each second portion provided between adjacent first portions corresponding to adjacent counter electrodes set to mutually different electrical potentials.

Therefore, a force for moving the developer in the vertical direction acts more strongly at the boundaries between the first and second portions in the counter area neighboring area. That is, when the developer is transported in the developer transport direction (toward the counter area) by the counter electrodes, a force for moving the developer toward the transport electrodes strongly acts in the counter area neighboring area.

According to such a configuration, in the area in the vicinity of the closest proximity position, carrying of the developer onto the developer carrying surface can be performed satisfactorily. Therefore, image formation by use of the developer can be performed more satisfactorily.

[2]

(1) The developer electric field transport apparatus (the developer supply apparatus) comprises an electrode support member and a transport electrode cover member.

The electrode support member is configured to support the transport electrodes. The transport electrodes are supported on the surface of the electrode support member.

The transport electrode cover member is formed in such a manner as to cover the transport electrodes and the surface of the electrode support member. The transport electrode cover member has a developer transport surface. The developer transport surface is in parallel with the main scanning direction and faces the developer carrying surface (the latent image forming surface).

The developer electric field transport apparatus (the developer supply apparatus) can further comprise a transport electrode cover intermediate layer. The transport electrode cover intermediate layer is formed between the transport electrode cover member and the transport electrodes.

In the developer electric field transport apparatus (the developer supply apparatus), a counter area where the developer carrying surface and the developer transport surface face each other, and other areas have the following characteristic configurations.

(1-1) The transport electrode cover member can be configured such that relative dielectric constant is higher in those areas which are located upstream of and downstream of the counter area with respect to the developer transport direction, than in the counter area.

In the above-mentioned configuration, when traveling wave voltages are applied to the transport electrodes, electric field strength in a space in the vicinity of the developer transport surface in which the developer can be transported is lower in the upstream area and the downstream area than in the counter area. In other words, the electric field strength is higher in the counter area than in the upstream area and the downstream area.

Thus, in such a configuration, for example, through setting the counter area in the vicinity of the developer carrying position (the developing position) where the developer carrying surface (the latent image forming surface) and the developer transport surface face in the closest proximity to each other, the electric field strength can be made the highest in the vicinity of the developing position.

Consequently, the developer is efficiently supplied toward the area (the counter area) in the vicinity of the developer carrying position (the developing position). Thus, the efficiency of carrying the developer on the developer carrying surface (the latent image forming surface) (the efficiency of development of the electrostatic latent image) can be improved. Therefore, a necessary image density can surely be obtained.

Alternatively, in such a configuration, for example, in the case where a housing (the housing of the developer supply apparatus) which covers the developer electric field transport apparatus has an opening for exposing the developer transport surface to the developer carrying surface (the latent image forming surface), the edge of the opening may be provided in an area in which relative dielectric constant is higher (electric field strength is lower) than in the counter area.

Consequently, undesired jetting of the developer from the housing in the vicinity of the edge of the opening can be effectively suppressed. Thus, generation of the above-mentioned "white-background fogging" can be effectively suppressed.

Thus, according to the above-mentioned configuration, the state of transport of the developer in the developer transport direction can be appropriately set. Therefore, according to the above-mentioned configuration, image formation by use of the developer can be performed more satisfactorily.

(1-2) The transport electrode cover member can comprise an upstream intermediate portion. The upstream intermediate portion is provided between a most upstream area with respect to the developer transport direction and the counter area. The upstream intermediate portion is configured such that its relative dielectric constant falls between that in the most upstream area and that in the counter area.

The transport electrode cover member ranging from the most upstream area to the upstream intermediate portion and then to the counter area may be configured such that relative dielectric constant varies stepwise in the order of the most upstream area, the upstream intermediate portion, and the counter area. Alternatively, the transport electrode cover member ranging from the most upstream area to the upstream intermediate portion and then to the counter area may be configured such that relative dielectric constant varies continuously from the most upstream area to the counter area.

In the above-mentioned configuration, the electric field strength gradually increases in the order of the most upstream area, the upstream intermediate portion, and the counter area.

Thus, for example, in the course of transport of the developer from the most upstream area toward the counter area, the developer can be smoothly accelerated. That is, the developer can be smoothly supplied from the most upstream area to the counter area (the developer carrying position or the developing position).

(1-3) The transport electrode cover member can comprise a downstream intermediate portion. The downstream intermediate portion is provided between a most downstream area with respect to the developer transport direction and the counter area. The downstream intermediate portion is configured such that its relative dielectric constant falls between that in the most downstream area and that in the counter area.

The transport electrode cover member ranging from the counter area to the downstream intermediate portion and then to the most downstream area may be configured such that relative dielectric constant varies stepwise in the order of the counter area, the downstream intermediate portion, and the most downstream area. Alternatively, the transport electrode cover member ranging from the counter area to the downstream intermediate portion and then to the most downstream area may be configured such that relative dielectric constant varies continuously from the counter area to the most downstream area.

In the above-mentioned configuration, the electric field strength gradually decreases in the order of the counter area, the downstream intermediate portion, and the most downstream area.

Therefore, when the developer which has passed the counter area (the developer carrying position or the developing position) is ejected toward the most downstream area (the interior of the housing), stagnation of the developer at a specific location can be effectively prevented, which stagnation would otherwise occur due to local slowdown of the flow of the developer. Thus, discharge of the developer from the counter area (the developer carrying position or the developing position) toward the most downstream area (the interior of the housing) can be performed smoothly.

(1-4) The transport electrode cover intermediate layer can be configured such that relative dielectric constant is higher in those areas which are located upstream of and downstream of the counter area with respect to the developer transport direction, than in the counter area.

In the above-mentioned configuration, when traveling wave voltages are applied to the transport electrodes, the electric field strength is lower in the upstream area and the downstream area than in the counter area.

Thus, as described above, the state of transport of the developer in the developer transport direction can be appropriately set. Therefore, according to the above-mentioned configuration, image formation by use of the developer can be carried out more satisfactorily.

(1-5) The transport electrode cover intermediate layer can comprise an upstream intermediate portion. The upstream intermediate portion is provided between a most upstream area with respect to the developer transport direction and the counter area. The upstream intermediate portion is configured such that its relative dielectric constant falls between that in the most upstream area and that in the counter area.

The transport electrode cover intermediate layer ranging from the most upstream area to the upstream intermediate portion and then to the counter area may be configured such that relative dielectric constant varies stepwise in the order of the most upstream area, the upstream intermediate portion, and the counter area. Alternatively, the transport electrode cover intermediate layer ranging from the most upstream area to the upstream intermediate portion and then to the counter area may be configured such that relative dielectric constant varies continuously from the most upstream area to the counter area.

In the above-mentioned configuration, the electric field strength gradually increases in the order of the most upstream area, the upstream intermediate portion, and the counter area.

(1-6) The transport electrode cover intermediate layer can comprise a downstream intermediate portion. The downstream intermediate portion is provided between a most downstream area with respect to the developer transport direction and the counter area. The downstream intermediate portion is configured such that its relative dielectric constant falls between that in the most downstream area and that in the counter area.

The transport electrode cover intermediate layer ranging from the counter area to the downstream intermediate portion and then to the most downstream area may be configured such that relative dielectric constant varies stepwise in the order of the counter area, the downstream intermediate portion, and the most downstream area. Alternatively, the transport electrode cover intermediate layer ranging from the counter area to the downstream intermediate portion and then to the most downstream area may be configured such that relative dielectric constant varies continuously from the counter area to the most downstream area.

In the above-mentioned configuration, the electric field strength gradually decreases in the order of the counter area, the downstream intermediate portion, and the most downstream area.

(1-7) The transport electrode cover member can be configured in such a manner as to be thicker in those areas which are located upstream of and downstream of the counter area with respect to the developer transport direction, than in the counter area.

In the above-mentioned configuration, when traveling wave voltages are applied to the transport electrodes, the electric field strength is lower in the upstream area and the downstream area than in the counter area.

Thus, as described above, the state of transport of the developer in the developer transport direction can be appropriately set. Therefore, according to the above-mentioned configuration, image formation by use of the developer can be carried out more satisfactorily.

(1-8) The transport electrode cover member can comprise an upstream intermediate portion. The upstream intermediate portion is provided between a most upstream area with respect to the developer transport direction and the counter area. The upstream intermediate portion is configured such that its thickness falls between that in the most upstream area and that in the counter area.

The transport electrode cover member ranging from the most upstream area to the upstream intermediate portion and then to the counter area may be configured such that thickness varies stepwise in the order of the most upstream area, the upstream intermediate portion, and the counter area. Alternatively, the transport electrode cover member ranging from the most upstream area to the upstream intermediate portion and then to the counter area may be configured such that thickness varies continuously from the most upstream area to the counter area.

In the above-mentioned configuration, the electric field strength gradually increases in the order of the most upstream area, the upstream intermediate portion, and the counter area.

(1-9) The transport electrode cover member can comprise a downstream intermediate portion. The downstream intermediate portion is provided between a most downstream area with respect to the developer transport direction and the counter area. The downstream intermediate portion is configured such that its thickness falls between that in the most downstream area and that in the counter area.

The transport electrode cover member ranging from the counter area to the downstream intermediate portion and then to the most downstream area may be configured such that thickness varies stepwise in the order of the counter area, the downstream intermediate portion, and the most downstream area. Alternatively, the transport electrode cover member ranging from the counter area to the downstream intermediate portion and then to the most downstream area may be configured such that thickness varies continuously from the counter area to the most downstream area.

In the above-mentioned configuration, the electric field strength gradually decreases in the order of the counter area, the downstream intermediate portion, and the most downstream area.

(1-10) The transport electrode cover intermediate layer can be configured in such a manner as to be thicker in those areas which are located upstream of and downstream of the counter area with respect to the developer transport direction, than in the counter area.

In the above-mentioned configuration, when traveling wave voltages are applied to the transport electrodes, the electric field strength is lower in the upstream area and the downstream area than in the counter area.

Thus, the state of transport of the developer in the developer transport direction can be appropriately set. Therefore, according to the above-mentioned configuration, image formation by use of the developer can be carried out more satisfactorily.

(1-11) The transport electrode cover intermediate layer can comprise an upstream intermediate portion. The upstream intermediate portion is provided between a most upstream area with respect to the developer transport direction and the counter area. The upstream intermediate portion is configured such that its thickness falls between that in the most upstream area and that in the counter area.

The transport electrode cover intermediate layer ranging from the most upstream area to the upstream intermediate portion and then to the counter area may be configured such that thickness varies stepwise in the order of the most upstream area, the upstream intermediate portion, and the counter area. Alternatively, the transport electrode cover intermediate layer ranging from the most upstream area to the upstream intermediate portion and then to the counter area may be configured such that thickness varies continuously from the most upstream area to the counter area.

In the above-mentioned configuration, the electric field strength gradually increases in the order of the most upstream area, the upstream intermediate portion, and the counter area.

(1-12) The transport electrode cover intermediate layer can comprise a downstream intermediate portion. The downstream intermediate portion is provided between a most downstream area with respect to the developer transport direction and the counter area. The downstream intermediate portion is configured such that its thickness falls between that in the most downstream area and that in the counter area.

The transport electrode cover intermediate layer ranging from the counter area to the downstream intermediate portion and then to the most downstream area may be configured such that thickness varies stepwise in the order of the counter area, the downstream intermediate portion, and the most downstream area. Alternatively, the transport electrode cover intermediate layer ranging from the counter area to the downstream intermediate portion and then to the most downstream area may be configured such that thickness varies continuously from the counter area to the most downstream area.

In the above-mentioned configuration, the electric field strength gradually decreases in the order of the counter area, the downstream intermediate portion, and the most downstream area.

(1-13) In the case where the transport electrode cover intermediate layer is configured in such a manner as to be thicker in those areas which are located upstream of and downstream of the counter area with respect to the developer transport direction, than in the counter area, the transport electrode cover intermediate layer and the transport electrode cover member can be configured such that a laminate of the transport electrode cover intermediate layer and the transport electrode cover member is formed into the form of a flat plate having a substantially fixed thickness and such that the transport electrode cover member is lower in relative dielectric constant than the transport electrode cover intermediate layer.

In the above-mentioned configuration, the (combined) relative dielectric constant of the laminate of the transport electrode cover member and the transport electrode cover intermediate layer is higher in those areas which are located upstream of and downstream of the counter area with respect to the developer transport direction, than in the counter area. Thus, when traveling wave voltages are applied to the transport electrodes, the electric field strength can be lower in the upstream area and the downstream area than in the counter area.

(2) The developer electric field transport apparatus (the developer supply apparatus) can comprise a plurality of counter electrodes, a counter electrode support member, and a counter electrode cover member.

The counter electrodes are disposed in such a manner as to face the transport electrodes with a predetermined gap therebetween. The plurality of counter electrodes are arrayed along the sub-scanning direction and are configured to be able to transport the developer in the developer transport direction through application of traveling wave voltages thereto.

The counter electrode support member is configured to support the counter electrodes on its surface. The counter electrode support member is disposed in such a manner as to face the transport electrode support member via the gap.

The counter electrode cover member is formed in such a manner as to cover the counter electrodes and the surface of the counter electrode support member.

The developer electric field transport apparatus (the developer supply apparatus) can further comprise a counter electrode cover intermediate layer. The counter electrode cover intermediate layer is formed between the counter electrode cover member and the counter electrodes.

In the developer electric field transport apparatus (the developer supply apparatus), a counter area neighboring area in proximity to the counter area, and other areas have the following characteristic configurations.

(2-1) The counter electrode cover member can be configured such that relative dielectric constant is higher in those areas which are located upstream of and downstream of the counter area neighboring area with respect to the developer transport direction, than in the counter area neighboring area.

In the above-mentioned configuration, when traveling wave voltages are applied to the counter electrodes, electric field strength in a space in the vicinity of the counter electrodes (in the vicinity of the surface of the counter electrode cover member) is higher in the upstream area and the downstream area than in the counter area neighboring area. That is, the electric field strength is lower in the counter area neighboring area than in the upstream area. Also, the electric field strength is higher in the downstream area than in the counter area neighboring area.

In the above-mentioned configuration, when traveling wave voltages are applied to the counter electrodes, electric field strength is lower in the upstream area and the downstream area than in the counter area neighboring area. In other words, the electric field strength becomes higher in the counter area neighboring area than in the upstream area and the downstream area.

Thus, such a configuration can increase the strength of the electric field along the developer transport direction from the counter area neighboring area to the area (the counter area) in the vicinity of the developer carrying position (the developing position) where the developer carrying surface (the latent image forming surface) and the developer transport surface face in the closest proximity to each other.

Consequently, the developer is efficiently supplied toward the area (the counter area) in the vicinity of the developer carrying position (the developing position). Thus, the efficiency of carrying the developer on the developer carrying surface (the latent image forming surface) (the efficiency of development of the electrostatic latent image) can be improved. Therefore, a necessary image density can surely be obtained.

Alternatively, in such a configuration, for example, in the case where a housing (the housing of the developer supply apparatus) which covers the developer electric field transport apparatus has an opening for exposing the developer transport surface to the developer carrying surface (the latent image forming surface), the counter area neighboring area in which relative dielectric constant is low (electric field strength is high) can be provided in the vicinity of the edge of the opening.

Consequently, an electric field component which causes the developer to move toward the transport electrode support member (move in the direction opposite the direction from the opening to the outside of the housing) can be made large in the vicinity of the edge of the opening. Accordingly, undesired jetting of the developer from the housing in the vicinity of the edge of the opening can be effectively suppressed. Thus, generation of the above-mentioned "white-background fogging" can be effectively suppressed.

Thus, according to the above-mentioned configuration, the state of transport of the developer in the developer transport direction can be appropriately set. Therefore, according to the above-mentioned configuration, image formation by use of the developer can be carried out more satisfactorily.

(2-2) The counter electrode cover member can comprise an upstream intermediate portion. The upstream intermediate portion is provided between a most upstream area with respect to the developer transport direction and the counter area neighboring area. The upstream intermediate portion is configured such that its relative dielectric constant falls between that in the most upstream area and that in the counter area neighboring area.

The counter electrode cover member ranging from the most upstream area to the upstream intermediate portion and then to the counter area neighboring area may be configured such that relative dielectric constant varies stepwise in the order of the most upstream area, the upstream intermediate portion, and the counter area neighboring area. Alternatively, the counter electrode cover member ranging from the most upstream area to the upstream intermediate portion and then to the counter area neighboring area may be configured such that relative dielectric constant varies continuously from the most upstream area to the counter area neighboring area.

In the above-mentioned configuration, the electric field strength gradually increases in the order of the most upstream area, the upstream intermediate portion, and the counter area neighboring area.

Thus, for example, in the course of transport of the developer from the most upstream area toward the counter area (the counter area neighboring area), the developer can be smoothly accelerated. That is, the developer can be smoothly supplied from the most upstream area to the counter area (the developer carrying position or the developing position).

(2-3) The counter electrode cover member can comprise a downstream intermediate portion. The downstream intermediate portion is provided between a most downstream area with respect to the developer transport direction and the counter area neighboring area. The downstream intermediate portion is configured such that its relative dielectric constant falls between that in the most downstream area and that in the counter area neighboring area.

The counter electrode cover member ranging from the counter area neighboring area to the downstream intermediate portion and then to the most downstream area may be configured such that relative dielectric constant varies stepwise in the order of the counter area neighboring area, the downstream intermediate portion, and the most downstream area. Alternatively, the counter electrode cover member ranging from the counter area neighboring area to the downstream intermediate portion and then to the most downstream area may be configured such that relative dielectric constant varies continuously from the counter area neighboring area to the most downstream area.

In the above-mentioned configuration, the electric field strength gradually decreases in the order of the counter area neighboring area, the downstream intermediate portion, and the most downstream area.

Thus, for example, discharge of the developer from the counter area (the counter area neighboring area) toward the most downstream area can be smoothly performed.

(2-4) The counter electrode cover intermediate layer can be configured such that relative dielectric constant is higher in those areas which are located upstream of and downstream of the counter area neighboring area with respect to the developer transport direction, than in the counter area neighboring area.

In the above-mentioned configuration, when traveling wave voltages are applied to the counter electrodes, the electric field strength is lower in the upstream area and the downstream area than in the counter area neighboring area. In other words, the electric field strength becomes higher in the counter area neighboring area than in the upstream area and the downstream area.

Thus, as described above, the state of transport of the developer in the developer transport direction can be appropriately set. Therefore, according to the above-mentioned configuration, image formation by use of the developer can be carried out more satisfactorily.

(2-5) The counter electrode cover intermediate layer can comprise an upstream intermediate portion. The upstream intermediate portion is provided between a most upstream area with respect to the developer transport direction and the counter area neighboring area. The upstream intermediate portion is configured such that its relative dielectric constant falls between that in the most upstream area and that in the counter area neighboring area.

The counter electrode cover intermediate layer ranging from the most upstream area to the upstream intermediate portion and then to the counter area neighboring area may be configured such that relative dielectric constant varies stepwise in the order of the most upstream area, the upstream intermediate portion, and the counter area neighboring area. Alternatively, the counter electrode cover intermediate layer ranging from the most upstream area to the upstream intermediate portion and then to the counter area neighboring area may be configured such that relative dielectric constant varies continuously from the most upstream area to the counter area neighboring area.

In the above-mentioned configuration, the electric field strength gradually increases in the order of the most upstream area, the upstream intermediate portion, and the counter area neighboring area.

(2-6) The counter electrode cover intermediate layer can comprise a downstream intermediate portion. The downstream intermediate portion is provided between a most downstream area with respect to the developer transport direction and the counter area neighboring area. The downstream intermediate portion is configured such that its relative dielectric constant falls between that in the most downstream area and that in the counter area neighboring area.

The counter electrode cover intermediate layer ranging from the counter area neighboring area to the downstream intermediate portion and then to the most downstream area may be configured such that relative dielectric constant varies stepwise in the order of the counter area neighboring area, the downstream intermediate portion, and the most downstream area. Alternatively, the counter electrode cover intermediate layer ranging from the counter area neighboring area to the downstream intermediate portion and then to the most downstream area may be configured such that relative dielectric constant varies continuously from the counter area neighboring area to the most downstream area.

In the above-mentioned configuration, the electric field strength gradually decreases in the order of the counter area neighboring area, the downstream intermediate portion, and the most downstream area.

(2-7) The counter electrode cover member can be configured in such a manner as to be thicker in those areas which are located upstream of and downstream of the counter area neighboring area with respect to the developer transport direction, than in the counter area neighboring area.

In the above-mentioned configuration, when traveling wave voltages are applied to the counter electrodes, the electric field strength is lower in the upstream area and the downstream area than in the counter area neighboring area. In other words, the electric field strength becomes higher in the counter area neighboring area than in the upstream area and the downstream area.

Thus, as described above, the state of transport of the developer in the developer transport direction can be appropriately set. Therefore, according to the above-mentioned configuration, image formation by use of the developer can be carried out more satisfactorily.

(2-8) The counter electrode cover member can comprise an upstream intermediate portion. The upstream intermediate portion is provided between a most upstream area with respect to the developer transport direction and the counter area neighboring area. The upstream intermediate portion is configured such that its thickness falls between that in the most upstream area and that in the counter area neighboring area.

The counter electrode cover member ranging from the most upstream area to the upstream intermediate portion and then to the counter area neighboring area may be configured such that thickness varies stepwise in the order of the most upstream area, the upstream intermediate portion, and the counter area neighboring area. Alternatively, the counter electrode cover member ranging from the most upstream area to the upstream intermediate portion and then to the counter area neighboring area may be configured such that thickness varies continuously from the most upstream area to the counter area neighboring area.

In the above-mentioned configuration, the electric field strength gradually increases in the order of the most upstream area, the upstream intermediate portion, and the counter area neighboring area.

(2-9) The counter electrode cover member can comprise a downstream intermediate portion. The downstream intermediate portion is provided between a most downstream area with respect to the developer transport direction and the counter area neighboring area. The downstream intermediate portion is configured such that its thickness falls between that in the most downstream area and that in the counter area neighboring area.

The counter electrode cover member ranging from the counter area neighboring area to the downstream intermediate portion and then to the most downstream area may be configured such that thickness varies stepwise in the order of the counter area neighboring area, the downstream intermediate portion, and the most downstream area. Alternatively, the counter electrode cover member ranging from the counter area neighboring area to the downstream intermediate portion and then to the most downstream area may be configured such that thickness varies continuously from the counter area neighboring area to the most downstream area.

In the above-mentioned configuration, the electric field strength gradually decreases in the order of the counter area neighboring area, the downstream intermediate portion, and the most downstream area.

(2-10) The counter electrode cover intermediate layer can be configured in such a manner as to be thicker in those areas which are located upstream of and downstream of the counter area neighboring area with respect to the developer transport direction, than in the counter area neighboring area.

In the above-mentioned configuration, when traveling wave voltages are applied to the counter electrodes, the electric field strength is lower in the upstream area and the downstream area than in the counter area neighboring area. In other words, the electric field strength becomes higher in the counter area neighboring area than in the upstream area and the downstream area.

Thus, as descried above, the state of transport of the developer in the developer transport direction can be appropriately set. Therefore, according to the above-mentioned configuration, image formation by use of the developer can be carried out more satisfactorily.

(2-11) The counter electrode cover intermediate layer can comprise an upstream intermediate portion. The upstream intermediate portion is provided between a most upstream area with respect to the developer transport direction and the counter area neighboring area. The upstream intermediate portion is configured such that its thickness falls between that in the most upstream area and that in the counter area neighboring area.

The counter electrode cover intermediate layer ranging from the most upstream area to the upstream intermediate portion and then to the counter area neighboring area may be configured such that thickness varies stepwise in the order of the most upstream area, the upstream intermediate portion, and the counter area neighboring area. Alternatively, the counter electrode cover intermediate layer ranging from the most upstream area to the upstream intermediate portion and then to the counter area neighboring area may be configured such that thickness varies continuously from the most upstream area to the counter area neighboring area.

In the above-mentioned configuration, the electric field strength gradually increases in the order of the most upstream area, the upstream intermediate portion, and the counter area neighboring area.

(2-12) The counter electrode cover intermediate layer can comprise a downstream intermediate portion. The downstream intermediate portion is provided between a most downstream area with respect to the developer transport direction and the counter area neighboring area. The downstream intermediate portion is configured such that its thickness falls between that in the most downstream area and that in the counter area neighboring area.

The counter electrode cover intermediate layer ranging from the counter area neighboring area to the downstream intermediate portion and then to the most downstream area may be configured such that thickness varies stepwise in the order of the counter area neighboring area, the downstream intermediate portion, and the most downstream area. Alternatively, the counter electrode cover intermediate layer ranging from the counter area neighboring area to the downstream intermediate portion and then to the most downstream area may be configured such that thickness varies continuously from the counter area neighboring area to the most downstream area.

In the above-mentioned configuration, the electric field strength gradually decreases in the order of the counter area neighboring area, the downstream intermediate portion, and the most downstream area.

(2-13) In the case where the counter electrode cover intermediate layer is configured in such a manner as to be thicker in those areas which are located upstream of and downstream of the counter area neighboring area with respect to the developer transport direction, than in the counter area neighboring area, the counter electrode cover intermediate layer and the counter electrode cover member can be configured such that a laminate of the counter electrode cover intermediate layer and the counter electrode cover member is formed into the form of a flat plate having a substantially fixed thickness and such that the counter electrode cover member is lower in relative dielectric constant than the counter electrode cover intermediate layer.

In the above-mentioned configuration, the (combined) relative dielectric constant of the laminate of the counter electrode cover member and the counter electrode cover intermediate layer is higher in those areas which are located upstream of and downstream of the counter area neighboring area with respect to the developer transport direction, than in the counter area neighboring area. Thus, when traveling wave voltages are applied to the counter electrodes, the electric field strength can be lower in the upstream area and the downstream area than in the counter area neighboring area.

(2-14) The counter electrodes can be formed in such a manner as to be thinner in those areas which are located upstream of and downstream of the counter area neighboring area with respect to the developer transport direction, than in the counter area neighboring area.

In the above-mentioned configuration, when traveling wave voltages are applied to the counter electrodes, the electric field strength is higher in the counter area neighboring area than in the upstream area and the downstream area.

Thus, as described above, the state of transport of the developer in the developer transport direction can be appropriately set. Therefore, according to the above-mentioned configuration, image formation by use of the developer can be carried out more satisfactorily.

(2-15) The counter electrodes can be formed such that the counter electrodes in a most upstream area with respect to the developer transport direction are thinner than the counter electrodes in an upstream intermediate area located between the most upstream area and the counter area neighboring area and such that the counter electrodes in the upstream intermediate area are thinner than the counter electrodes in the counter area neighboring area.

The counter electrodes may be configured such that thickness varies stepwise in the order of the most upstream area, the upstream intermediate area, and the counter area neighboring area. Alternatively, the counter electrodes may be configured such that thickness varies continuously from the most upstream area to the counter area neighboring area.

In the above-mentioned configuration, the electric field strength gradually increases in the order of the most upstream area, the upstream intermediate area, and the counter area neighboring area.

(2-16) The counter electrodes can be formed such that the counter electrodes in a most downstream area with respect to the developer transport direction are thinner than the transport electrodes in a downstream intermediate area located between the most downstream area and the counter area neighboring area and such that the counter electrodes in the downstream intermediate area are thinner than the counter electrodes in the counter area neighboring area.

The counter electrodes may be configured such that thickness varies stepwise in the order of the counter area neighboring area, the downstream intermediate area, and the most downstream area. Alternatively, the counter electrodes may be configured such that thickness varies continuously from the counter area neighboring area to the most downstream area.

In the above-mentioned configuration, the electric field strength gradually decreases in the order of the counter area neighboring area, the downstream intermediate area, and the most downstream area.

BEST MODE FOR CARRYING OUT THE INVENTION

Modes for carrying out the present invention (modes which the applicant contemplated as the best at the time of filing the present application) will next be described with reference to the drawings.

[1] First, a first mode of the present invention will be described.

<Overall Configuration of Laser Printer>

Figure 1:
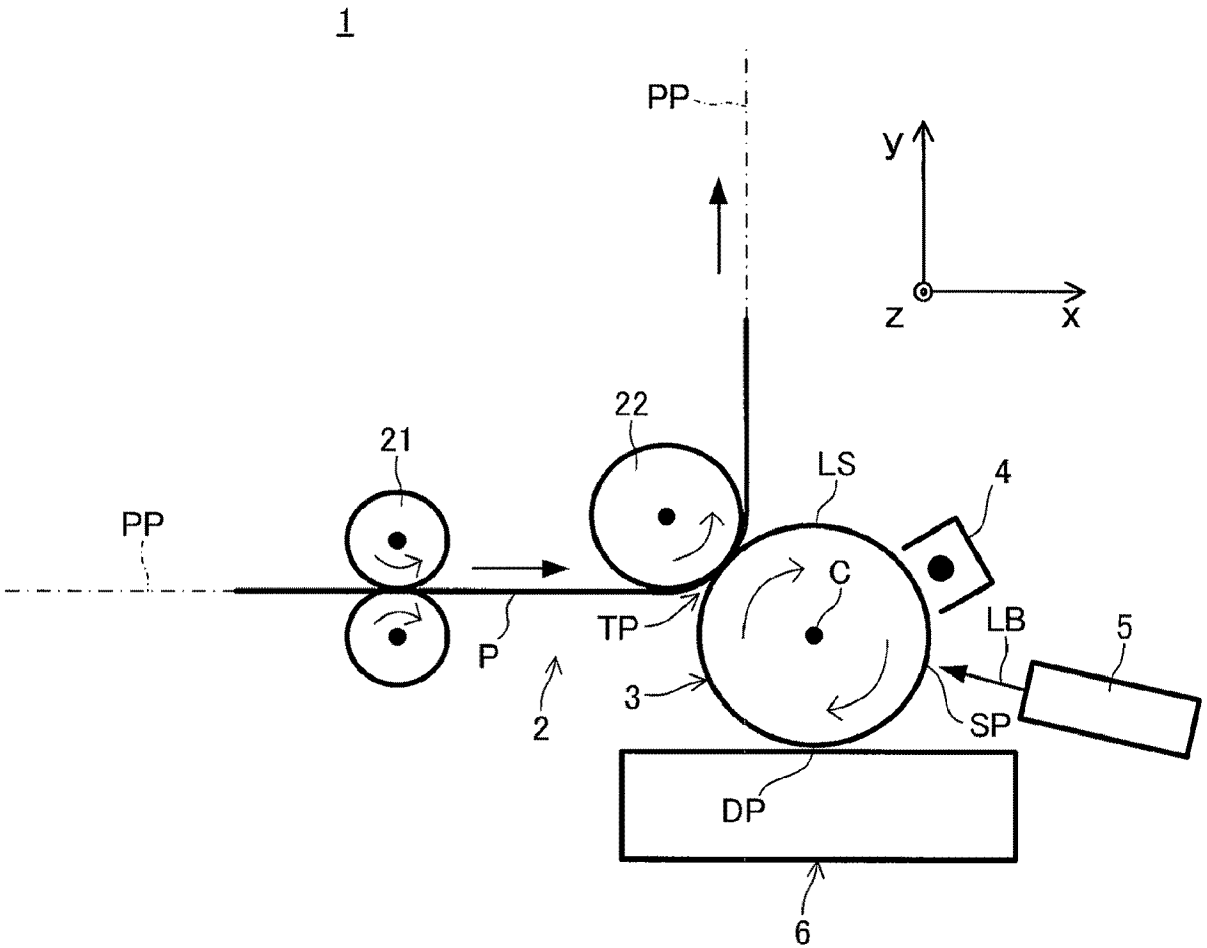
FIG. 1 is a side sectional view showing the schematic configuration of a laser printer which is one mode of an image forming apparatus according to the present invention.

FIG. 1 is a side sectional view showing the schematic configuration of a laser printer 1, which is one mode of an image forming apparatus according to the present invention.

Referring to FIG. 1, the laser printer 1 includes a paper transport mechanism 2, a photoconductor drum 3, a charger 4, a scanner unit 5, and a toner supply apparatus 6.

An unillustrated paper feed tray provided in the laser printer 1 contains sheets of paper P in a stacked state. The paper transport mechanism 2 is configured to be able to transport the paper P along a predetermined paper transport path PP.

A latent image forming surface LS, which serves as a latent image forming surface (developer carrying surface) of the present invention, is formed on the circumferential surface of the photoconductor drum 3, which serves as an electrostatic latent image carrying body (developer carrying body) of the present invention.

The latent image forming surface LS assumes the form of a cylindrical surface parallel to a main scanning direction (z-axis direction in FIG. 1). The latent image forming surface LS is configured to be able to form an electrostatic latent image thereon by means of electric potential distribution.

The photoconductor drum 3 is configured to be able to be rotatably driven about a center axis C in a direction indicated by the arrow of FIG. 1 (clockwise in FIG. 1). That is, the photoconductor drum 3 is configured such that the latent image forming surface LS can move along a predetermined moving direction; i.e., along a sub-scanning direction orthogonal to the main scanning direction.

Notably, the "sub-scanning direction" is an arbitrary direction orthogonal to the main scanning direction. Usually, the sub-scanning direction can be a direction which intersects a vertical direction. That is, the sub-scanning direction can be a direction along a front-rear direction of the laser printer 1 (a direction orthogonal to a paper width direction and to a height direction; i.e., x-axis direction in FIG. 1).

The charger 4 is disposed in such a manner as to face the latent image forming surface LS. The charger 4 is a corotron-type or scorotron-type charger and is configured to be able to uniformly, positively charge the latent image forming surface LS.

The scanner unit 5 is configured to generate a laser beam LB which is modulated according to image data. That is, the scanner unit 5 is configured to generate the laser beam LB of a predetermined wavelength band such that light emission is enabled and disabled in accordance with presence/absence of a pixel.

Also, the scanner unit 5 is configured to focus the generated laser beam LB to a scanning position SP on the latent image forming surface LS (to expose the scanning position SP to the laser beam LB). The scanning position SP is located downstream of the charger 4 with respect to the rotational direction of the photoconductor drum 3 (a direction indicated by the arrow of FIG. 1; i.e., clockwise in FIG. 1).

Furthermore, the scanner unit 5 is configured to be able to form an electrostatic latent image on the latent image forming surface LS by means of moving a position on the latent image forming surface LS where the laser beam LB is focused, at a uniform velocity along the main scanning direction (by means of scanning).

The toner supply apparatus 6, which serves as a developer supply apparatus of the present invention, is disposed in such a manner as to face the photoconductor drum 3. The toner supply apparatus 6 is configured to be able to supply the latent image forming surface LS a toner, which serves as a dry developer to be described later, at a developing position DP. A detailed configuration of the toner supply apparatus 6 will be described later.

Next, specific configurations of various sections of the laser printer 1 will be described.

The paper transport mechanism 2 includes a pair of resist rollers 21 and a transfer roller 22.

The resist rollers 21 are configured to be able to send out the paper P at a predetermined timing toward a gap between the photoconductor drum 3 and the transfer roller 22.

The transfer roller 22 is disposed in such a manner as to face the latent image forming surface LS, which is the outer circumferential surface of the photoconductor drum 3, in a transfer position TP with the paper P nipped therebetween. Also, the transfer roller 22 is configured to be able to be rotatably driven in a direction indicated by the arrow of FIG. 1 (counterclockwise).

The transfer roller 22 is connected to an unillustrated bias power circuit. That is, a predetermined transfer bias voltage is applied between the transfer roller 22 and the photoconductor drum 3 for transferring the toner (developer) adhering to the latent image forming surface LS, onto the paper P.

<Configuration of First Embodiment>

Figure 2:
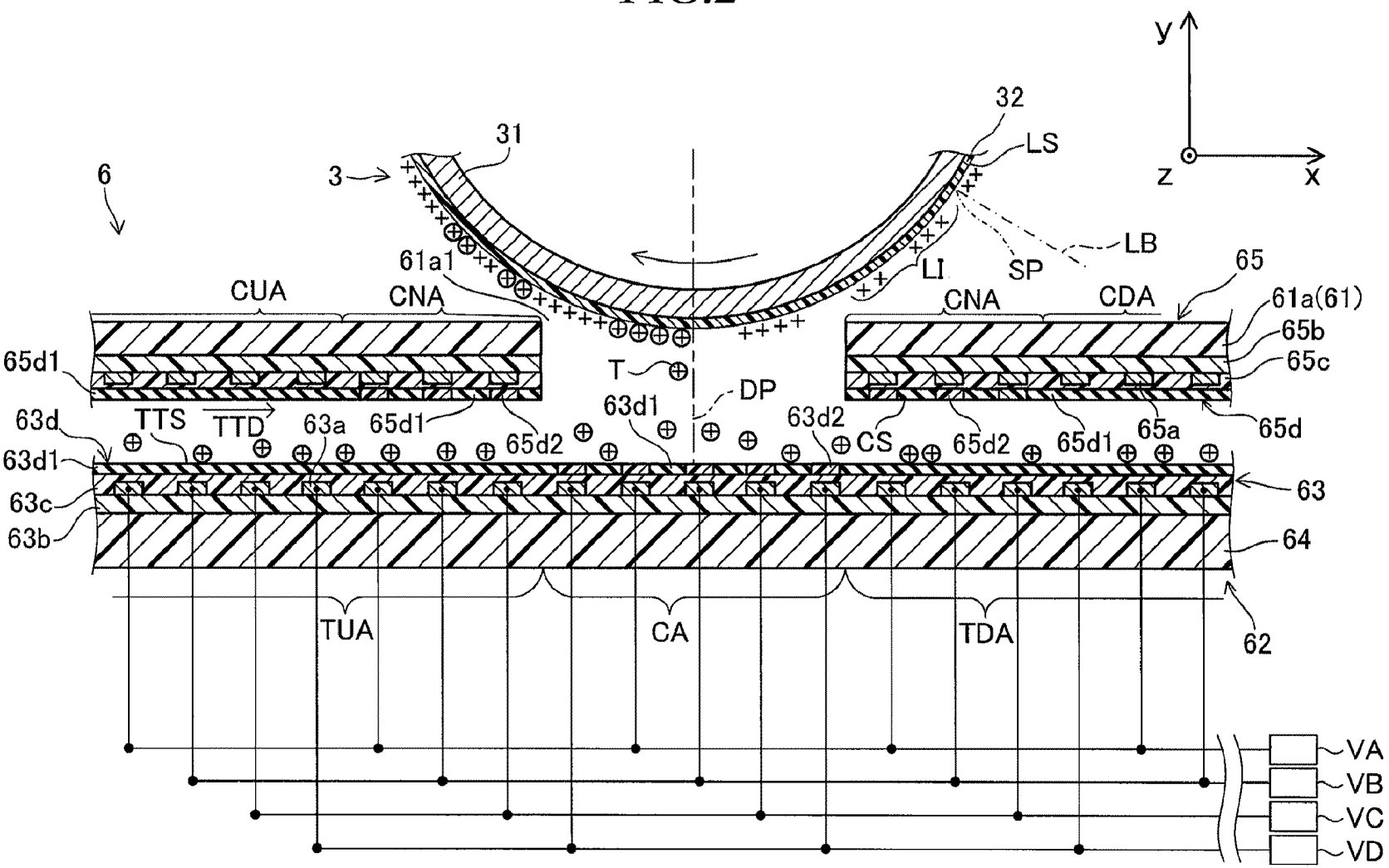
FIG. 2 is a side sectional view showing, on an enlarged scale, a region around a developing position in a first embodiment of a first mode of a toner supply apparatus shown in FIG. 1.

FIG. 2 is a side sectional view showing, on an enlarged scale, the periphery of a developing position DP in a first embodiment of the toner supply apparatus 6 shown in FIG. 1. The configuration of the present embodiment will be described in detail with reference to FIG. 2.

<<Photoconductor Drum>>

The photoconductor drum 3 includes a drum body 31 and a photoconductive layer 32.

The drum body 31 is a cylindrical member having the center axis C parallel to the z-axis and is formed of aluminum or the like. The drum body 31 is grounded.

The photoconductive layer 32 is provided in such a manner as to cover the outer circumferential surface of the drum body 31. The photoconductive layer 32 is a positively chargeable photoconductive layer which becomes electron-conductive upon exposure to a laser beam having a predetermined wavelength.

The latent image forming surface LS is formed of the outer circumferential surface of the photoconductive layer 32. That is, the latent image forming surface LS (photoconductive layer 32) is configured such that, after being uniformly, positively charged by the charger 4 (see FIG. 1), the latent image forming surface LS is subjected to scanning by the laser beam LB at the scanning position SP, whereby an electrostatic latent image LI in the form of a pattern of positive charges is formed thereon.

<<Toner Supply Apparatus>>

A toner box 61, which serves as the casing of the toner supply apparatus 6, is a box-like member and is configured to be able to contain therein a toner T, which is a particulate dry developer. In the present embodiment, the toner T is a positively chargeable, non-magnetic one-component, black toner.

A top plate 61*a* of the toner box 61 is disposed in the vicinity of the photoconductor drum 3. The top plate 61*a* is a rectangular plate-like member as viewed in plane and is disposed in parallel with a horizontal plane.

The top plate 61*a* has a toner passage hole 61*a*1, which is a through-hole for allowing the toner T to move from the inside of the toner box 61 toward the photoconductive layer 32 along a y-axis direction in FIG. 2. As viewed in plane, the toner passage hole 61*a*1 assumes the form of a rectangle whose long sides have substantially the same length as the width of the photoconductive layer 32 along the main scanning direction (z-axis direction in FIG. 2) and whose short sides are in parallel with the sub-scanning direction (x-axis direction in FIG. 2).

The toner passage hole 61*a*1 is provided in the vicinity of a position where the top plate 61*a* and the photoconductive layer 32 are in the closest proximity to each other. The toner passage hole 61*a*1 is formed such that its center with respect to the sub-scanning direction (x-axis direction in FIG. 2) substantially coincides with the developing position DP.

<<<Configuration of Toner Electric Field Transport Body>>>

The toner box 61 houses a toner electric field transport body 62, which serves as a developer electric field transport apparatus provided in a developer supply apparatus of the present invention.

The toner electric field transport body 62 has a toner transport surface TTS. The toner transport surface TTS, which serves as a developer transport surface of the present invention, is formed in parallel with the main scanning direction (z-axis direction in FIG. 2).

The toner electric field transport body 62 is disposed such that the toner transport surface TTS and the latent image forming surface LS face in the closest proximity to each other at the developing position DP. That is, the toner electric field transport body 62 is disposed such that a closest proximity position where the toner transport surface TTS and the latent image forming surface LS are in the closest proximity to each other coincides with the developing position DP.

The toner electric field transport body 62 is a plate-like member having a predetermined thickness. The toner electric field transport body 62 is configured to be able to transport the positively charged toner T on the toner transport surface TTS in the predetermined toner transport direction TTD. The toner transport direction TTD is parallel to the toner transport surface TTS and is perpendicular to the main scanning direction (z-axis direction in FIG. 2). That is, the toner transport direction TTD is a direction along the sub-scanning direction (x-axis direction in FIG. 2).

<<<<Transport Wiring Substrate>>>>

The toner electric field transport body 62 includes a transport wiring substrate 63. The transport wiring substrate 63 is disposed in such a manner as to face the latent image forming surface LS with the top plate 61*a* and the toner passage hole 61*a*1 of the toner box 61 therebetween.

As described below, the transport wiring substrate 63 has a configuration similar to that of a flexible printed wiring substrate.

A plurality of transport electrodes 63*a* are formed in a strip-shaped wiring pattern such that their longitudinal direction is in parallel with the main scanning direction (the longitudinal direction is orthogonal to the sub-scanning direction). Specifically, the transport electrodes 63*a* are formed of a copper foil having a thickness of several tens of micrometers. The plurality of transport electrodes 63*a* are disposed in parallel with one another. The transport electrodes 63*a* are arrayed along the sub-scanning direction.

Also, the transport electrodes 63*a* are disposed along the toner transport surface TTS. That is, the transport electrodes 63*a* are disposed in the vicinity of the toner transport surface TTS.

A large number of the transport electrodes 63*a* arrayed along the sub-scanning direction are connected to power circuits such that every fourth transport electrode 63*a* is connected to the same power circuit.

Specifically, the transport electrode 63*a* connected to a power circuit VA, the transport electrode 63*a* connected to a power circuit VB, the transport electrode 63*a* connected to a power circuit VC, the transport electrode 63*a* connected to a power circuit VD, the transport electrode 63*a* connected to the power circuit VA, the transport electrode 63*a* connected to the power circuit VB, the transport electrode 63*a* connected to the power circuit VC . . . are sequentially arrayed along the sub-scanning direction.

The power circuits VA to VD are configured to be able to output AC voltages (transport voltages) of substantially the same waveform. Also, the power circuits VA to VD are configured such that the waveforms of voltages generated by the power circuits VA to VD shift 90° in phase from one another. That is, in the sequence of the power circuits VA to VD, the phase of voltage delays in increments of 90°.

The transport electrodes 63*a* are formed on the surface of a transport electrode support film 63*b*, which serves as a transport electrode support member of the present invention. The transport electrode support film 63*b* is a flexible film and is formed of an electrically insulative synthetic resin, such as polyimide resin.

A transport electrode coating layer 63*c*, which serves as a transport electrode cover intermediate layer of the present invention, is formed of an electrically insulative synthetic resin. The transport electrode coating layer 63*c* is provided in such a manner as to cover the transport electrodes 63*a* and the surface of the transport electrode support film 63*b* on which the transport electrodes 63*a* are provided.

A transport electrode overcoating layer 63*d*, which serves as a transport electrode cover member of the present invention, is provided on the transport electrode coating layer 63*c*. In other words, the above-mentioned transport electrode coating layer 63*c* is formed between the transport electrode overcoating layer 63*d* and the transport electrodes 63*a*.

The above-mentioned toner transport surface TTS is implemented by the surface of the transport electrode overcoating layer 63*d* and is formed as a smooth surface with much less pits and projections.

In the present embodiment, the transport electrode overcoating layer 63*d* includes low relative dielectric constant portions 63*d*1 and high relative dielectric constant portions 63*d*2. The high relative dielectric constant portions 63*d*2 are formed of a material which is high in relative dielectric constant than the material of the low relative dielectric constant portions 63*d*1.

Here, a counter area CA in FIG. 2 is an area of the toner electric field transport body 62 where the latent image forming surface LS and the toner transport surface TTS face each other with the toner passage hole 61*a*1 therebetween. That is, the counter area CA is an area corresponding to the toner passage hole 61*a*1 (an area located just under the toner passage hole 61*a*1). Further, the counter area CA is an area in the vicinity of the developing position DP, which is a closest proximity position at which the latent image forming surface LS and the toner transport surface TTS face in the closest proximity to each other.

An upstream area TUA in FIG. 2 is an area of the toner electric field transport body 62 located upstream of the counter area CA with respect to the toner transport direction TTD. Further, a downstream area TDA in FIG. 2 is an area of the toner electric field transport body 62 located downstream of the counter area CA with respect to the toner transport direction TTD.

In the counter area CA, the low relative dielectric constant portions 63*d*1 and the high relative dielectric constant portions 63*d*2 are alternately arranged along the sub-scanning direction. The low relative dielectric constant portion 63*d*1 is provided in each of the upstream area TUA and the downstream area TDA.

In the present embodiment, the high relative dielectric constant portions 63*d*2 are provided at portions (first portions) corresponding to the transport electrodes 63*a*; and the low relative dielectric constant portions 63*d*1 are provided at portions (second portions) each located between two transport electrodes 63*a* adjacent to each other.

The toner electric field transport body 62 also includes a transport substrate support member 64. The transport substrate support member 64 is formed of a plate material of a synthetic resin and is provided so as to support the transport wiring substrate 63 from underneath.

In summary, the toner electric field transport body 62 is configured as follows: the above-mentioned transport voltages are applied to the transport electrodes 63*a* of the transport wiring substrate 63 so as to generate a traveling wave electric field along the sub-scanning direction, whereby the positively charged toner T can be transported in the toner transport direction TTD.

<<<Counter Wiring Substrate>>>

Referring to FIG. 2, a counter wiring substrate 65 is attached to the inner surface (a surface which faces a space where the toner T is contained) of the top plate 61*a* of the toner box 61. The counter wiring substrate 65 is disposed in such a manner as to face the toner transport surface TTS with a predetermined gap therebetween.

The counter wiring substrate 65 has a configuration similar to that of the above-mentioned transport wiring substrate 63.

Specifically, the counter wiring substrate 65 has a counter wiring substrate surface CS parallel to the main scanning direction. The counter wiring substrate surface CS is provided in such a manner as to face the toner transport surface TTS with a predetermined gap therebetween.

A large number of counter electrodes 65*a* are provided along the counter wiring substrate surface CS. That is, the counter electrodes 65*a* are disposed in the vicinity of the counter wiring substrate surface CS.

The plurality of counter electrodes 65*a* are formed in a strip-shaped wiring pattern such that their longitudinal direction is in parallel with the main scanning direction (the longitudinal direction is orthogonal to the sub-scanning direction). Specifically, the counter electrodes 65*a* are formed of a copper foil having a thickness of several tens of micrometers. The plurality of counter electrodes 65*a* are disposed in parallel with one another. The counter electrodes 65*a* are arrayed along the sub-scanning direction.

A large number of the counter electrodes 65*a* arrayed along the sub-scanning direction are connected to power circuits such that every fourth transport electrode 63*a* is connected to the same power circuit.

The counter electrodes 65*a* are formed on the surface of a counter electrode support film 65*b*, which serves as a counter electrode support member of the present invention. The counter electrode support film 65*b* is a flexible film and is formed of an electrically insulative synthetic resin, such as polyimide resin.

A counter electrode coating layer 65*c*, which serves as a counter electrode cover intermediate layer of the present invention, is formed of an electrically insulative synthetic resin. The counter electrode coating layer 65*c* is provided in such a manner as to cover the counter electrodes 65*a* and the surface of the counter electrode support film 65*b* on which the counter electrodes 65*a* are provided.

A counter electrode overcoating layer 65*d*, which serves as a counter electrode cover member of the present invention, is provided on the counter electrode coating layer 65*c*. In other words, the above-mentioned counter electrode coating layer 65*c* is formed between the counter electrode overcoating layer 65*d* and the counter electrodes 65*a*.

The above-mentioned counter wiring substrate surface CS is implemented by the surface of the counter electrode overcoating layer 65*d* and is formed as a smooth surface with much less pits and projections.

In the present embodiment, the counter electrode overcoating layer 65*d* includes low relative dielectric constant portions 65*d*1 and high relative dielectric constant portions 65*d*2. The high relative dielectric constant portions 65*d*2 are formed of a material which is high in relative dielectric constant than the material of the low relative dielectric constant portions 65*d*1.

A counter area neighboring area CNA in FIG. 2 is an area of the counter wiring substrate 65 in the vicinity of the toner passage hole 61*a*1. That is, the counter area neighboring area CNA is an area of the counter wiring substrate 65 in the vicinity of the counter area CA of the toner electric field transport body 62 (transport wiring substrate 63).

An upstream area CUA in FIG. 2 is an area of the counter wiring substrate 65 located upstream of the counter area neighboring area CNA with respect to the toner transport direction TTD. Further, a downstream area CDA in FIG. 2 is an area of the counter wiring substrate 65 located downstream of the counter area neighboring area CNA with respect to the toner transport direction TTD.

In the counter area neighboring area CNA, the low relative dielectric constant portions 65*d*1 and the high relative dielectric constant portions 65*d*2 are alternately arranged along the sub-scanning direction. The low relative dielectric constant portion 65*d*1 is provided in each of the upstream area CUA and the downstream area CDA.

In the present embodiment, the high relative dielectric constant portions 65*d*2 are provided at portions (first portions) corresponding to the counter electrodes 65*a*; and the low relative dielectric constant portions 65*d*1 are provided at portions (second portions) each located between two counter electrodes 65*a* adjacent to each other.

<Operation of Laser Printer>

Next, the operation of the laser printer 1 having the above-described configuration will be described with reference to the relevant drawings.

<<Paper Feed Operation>>

First, referring to FIG. 1, the leading end of the paper P stacked on an unillustrated paper feed tray is sent to the resist rollers 21 along the paper path PP. The resist rollers 21 correct a skew of the paper P and adjust transport timing. Subsequently, the paper P is transported to the transfer position TP along the paper path PP.

<<Carrying Toner Image on Latent Image Forming Surface>>

While the paper P is being transported toward the transfer position TP as described above, an image in the toner T is formed as described below on the latent image forming surface LS, which is the circumferential surface of the photoconductor drum 3.

<<<Formation of Electrostatic Latent Image>>>

First, the charger 4 uniformly charges a portion of the latent image forming surface LS of the photoconductor drum 3 to positive polarity.

As a result of the rotation of the photoconductor drum 3 in the direction (clockwise) indicated by the arrow of FIG. 1, the portion of the latent image forming surface LS which has been charged by the charger 4 moves along the sub-scanning direction to the scanning position SP, where the portion of the latent image forming surface LS faces (faces straight toward) the scanner unit 5.

Referring to FIG. 2, at the scanning position SP, the charged portion of the latent image forming surface LS is irradiated with the laser beam LB which has been modulated on the basis of image information, while the laser beam LB sweeps along the main scanning direction. Certain positive charges are lost from the charged portion of the latent image forming surface LS according to a state of modulation of the laser beam LB. By this procedure, an electrostatic latent image LI in the form of a pattern (an imagewise distribution) of positive charges is formed on the latent image forming surface LS.

As a result of the rotation of the photoconductor drum 3 in the direction (clockwise) indicated by the arrow of FIG. 2, the electrostatic latent image LI formed on the latent image forming surface LS moves toward the developing position DP, where the electrostatic latent image LI faces the toner supply apparatus 6.

<<<Transport and Supply of Charged Toner>>>

Referring to FIG. 2, traveling wave transport voltages are applied to the plurality of transport electrodes 63*a* of the toner electric field transport body 62. Accordingly, a predetermined traveling wave electric field is formed on the toner transport surface TTS. By the effect of the traveling wave electric field, the positively charged toner T is transported on the toner transport surface TTS along the toner transport direction TTD.

Figure 3:
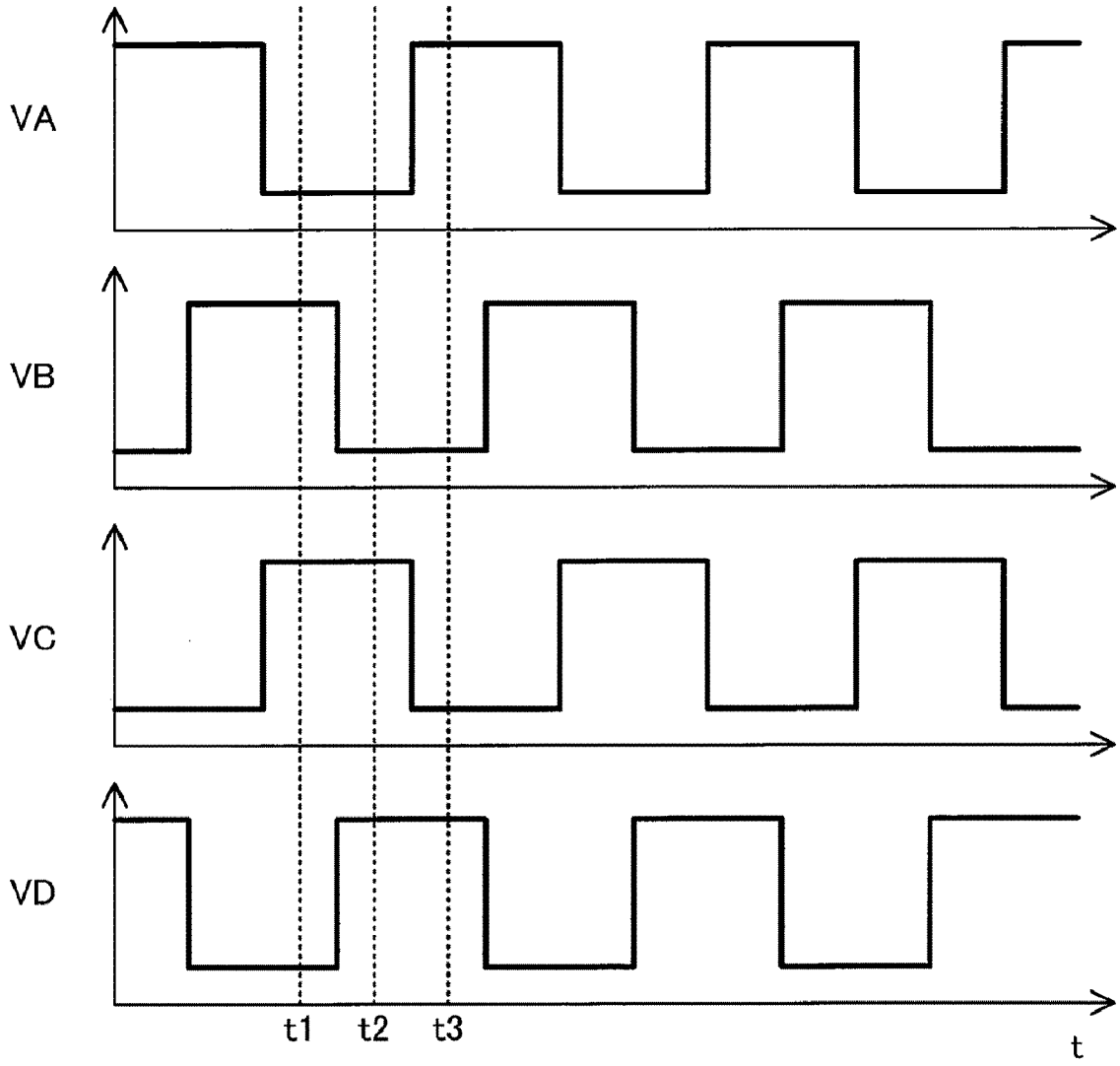
FIG. 3 is a diagram showing waveforms of voltages generated by power circuits shown in FIG. 2.
Figure 4:
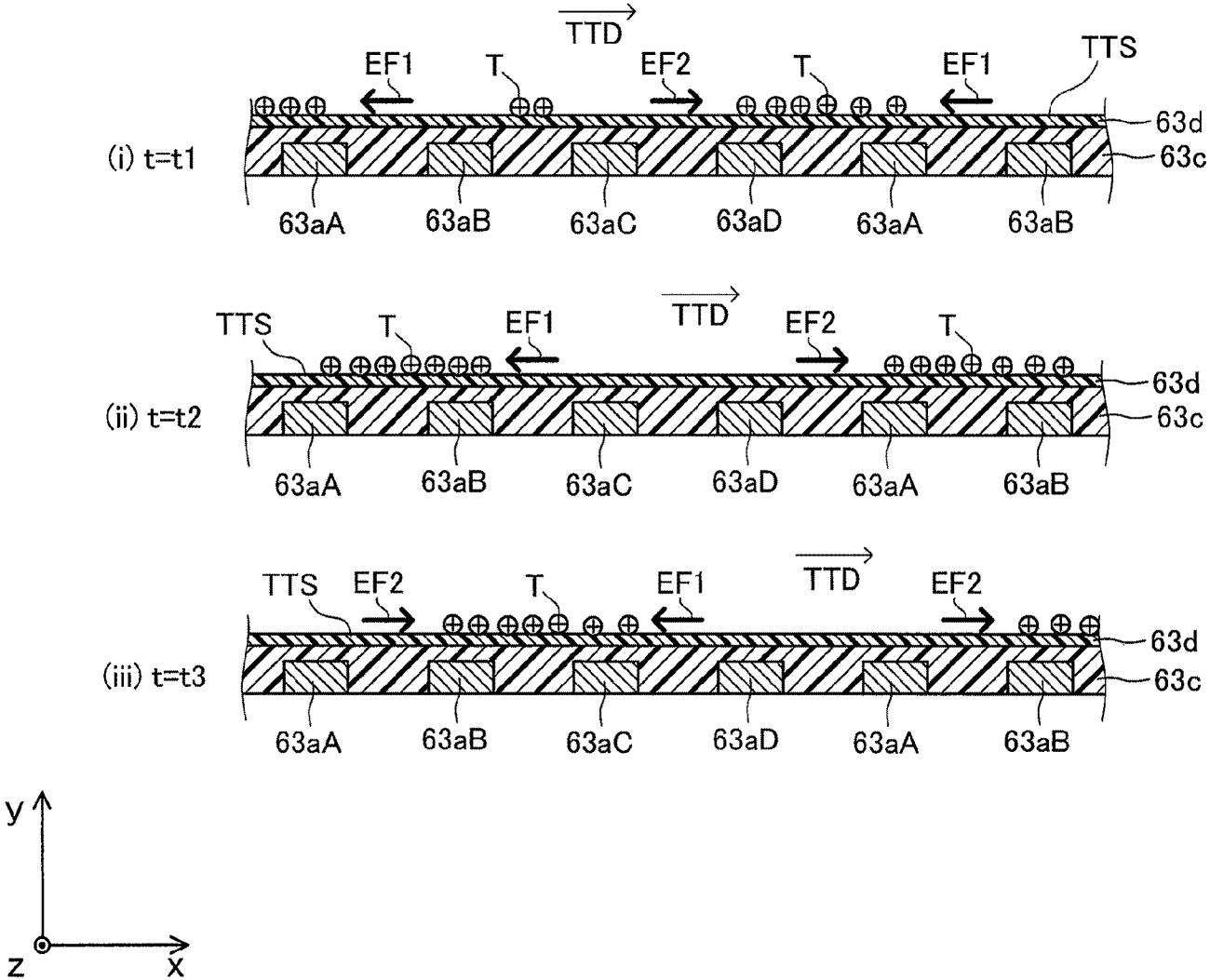
FIG. 4 is a series of side sectional views showing, on an enlarged scale, the periphery of a toner transport surface shown in FIG. 2.

FIG. 3 is a diagram showing waveforms of voltages generated by the power circuits VA to VD shown in FIG. 2. FIG. 4 is a series of side sectional views showing, on an enlarged scale, the periphery of the toner transport surface TTS shown in FIG. 2. In FIG. 4, the transport electrodes 63*a* which are connected to the power circuit VA in FIG. 2 are referred to as the transport electrodes 63*a*A. The same convention also applies to the transport electrodes 63*a*B to 63*a*D.

How the positively charged toner T is transported on the toner transport surface TTS along the toner transport direction TTD will be described below with reference to FIGS. 3 and 4.

As shown in FIG. 3, the power circuits VA to VD output AC voltages having the substantially same waveform in such a manner that, in the sequence of the power circuits VA to VD, the phase of voltage delays in increments of 90°.

At time t1 in FIG. 3, an electric field EF1 directed opposite the toner transport direction TTD (directed opposite the x-axis direction in FIG. 4) is formed in a section AB between the transport electrode 63*a*A and the transport electrode 63*a*B, as shown in FIG. 4(*i*).

Meanwhile, an electric field EF2 directed in the toner transport direction TTD (x-axis direction in FIG. 4) is formed in a section CD between the transport electrode 63*a*C and the transport electrode 63*a*D.

No electric field directed along the toner transport direction TTD is formed in a BC section between the transport electrode 63*a*B and the transport electrode 63*a*C and in a DA section between the transport electrode 63*a*D and the transport electrode 63*a*A.

That is, at time t1, the positively charged toner T in the sections AB is subjected to electrostatic force directed opposite the toner transport direction TTD.

The positively charged toner T in the sections BC and DA is hardly subjected to electrostatic force directed along the toner transport direction TTD.

The positively charged toner T in the CD sections is subjected to electrostatic force directed in the toner transport direction TTD.

Thus, at time t1, the positively charged toner T is collected in the DA sections. Similarly, at time t2, as shown in FIG. 4(*ii*), the positively charged toner T is collected in the sections AB. When time t3 is reached, as shown in FIG. 4(*iii*), the positively charged toner T is collected in the sections BC.

That is, areas where the toner T is collected move with time on the toner transport surface TTS along the toner transport direction TTD.

In this manner, by means of voltages shown in FIG. 3 being applied to the transport electrodes 63*a*, a traveling wave electric field is formed on the toner transport surface TTS. Thus, the positively charged toner T is transported along the toner transport direction TTD while hopping in the y-axis direction in FIG. 5.

Referring to FIG. 2, transport of the toner T by means of the counter wiring substrate 65 is similar to that by means of the transport wiring substrate 63 as mentioned above.

<<<Development of Electrostatic Latent Image>>>

Referring to FIG. 2, the positively charged toner T is transported on the toner transport surface TTS in the toner transport direction TTD as described above. As a result, the toner T is supplied to the developing position DP.

In the vicinity of the developing position DP, the electrostatic latent image LI formed on the latent image forming surface LS is developed with the toner T. That is, the toner T adheres to portions of the electrostatic latent image LI on the latent image forming surface LS at which positive charges are lost. Thus, an image in the toner T (hereinafter referred to as the "toner image") is carried on the latent image forming surface LS.

<<Transfer of Toner Image from Latent Image Forming Surface to Paper>>

Referring to FIG. 1, as a result of rotation of the latent image forming surface LS in the direction (clockwise) indicated by the illustrated arrow, the toner image which has been carried on the latent image forming surface LS of the photoconductor drum 3 as mentioned above is transported toward the transfer position TP. At the transfer position TP, the toner image is transferred from the latent image forming surface LS onto the paper P.

<Actions and Effects of Configuration of First Embodiment>

Figure 5:
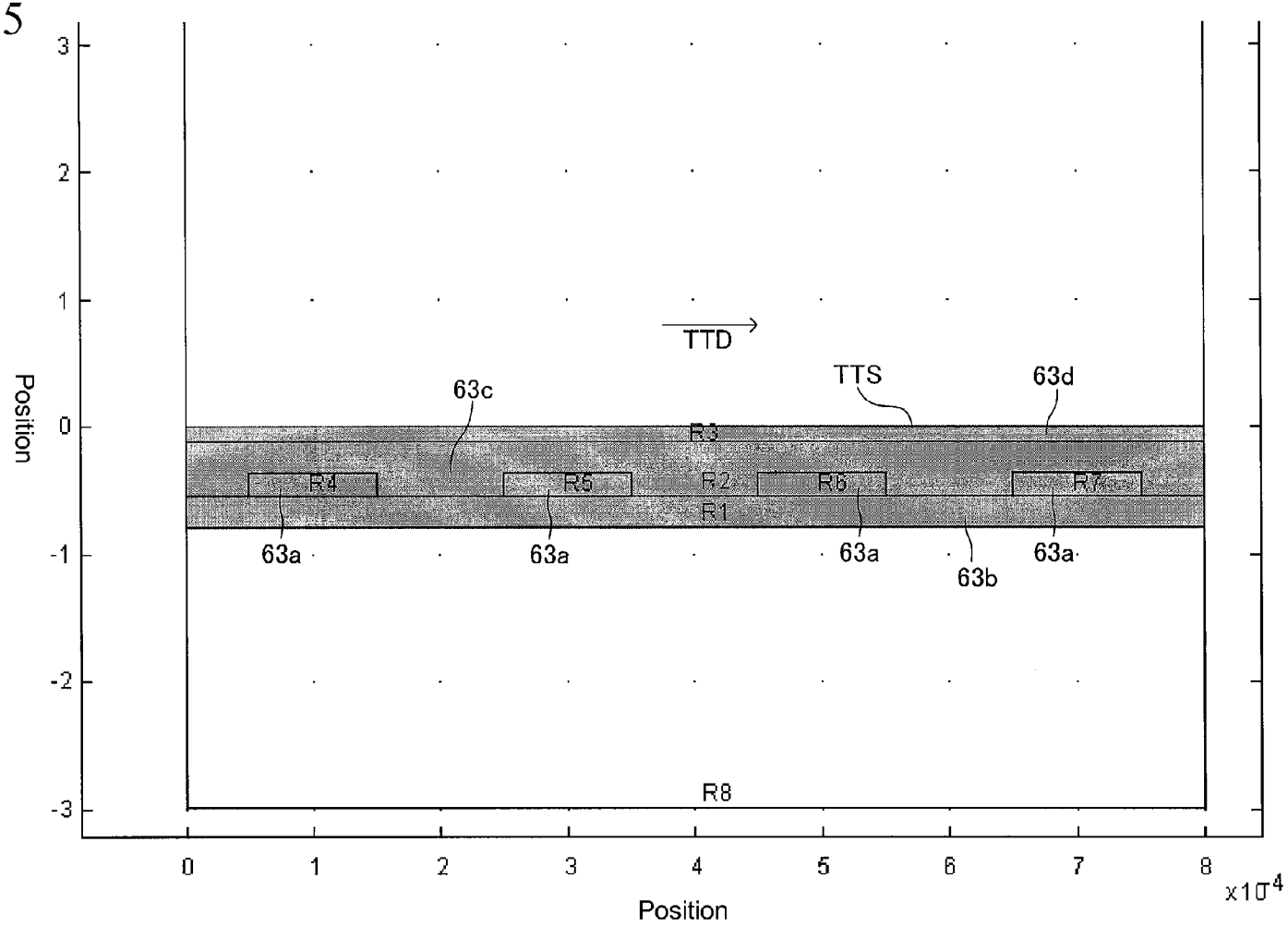
FIG. 5 is a side sectional view showing, on a further enlarged scale, a transport wiring substrate shown in FIG. 3.
Figure 6:
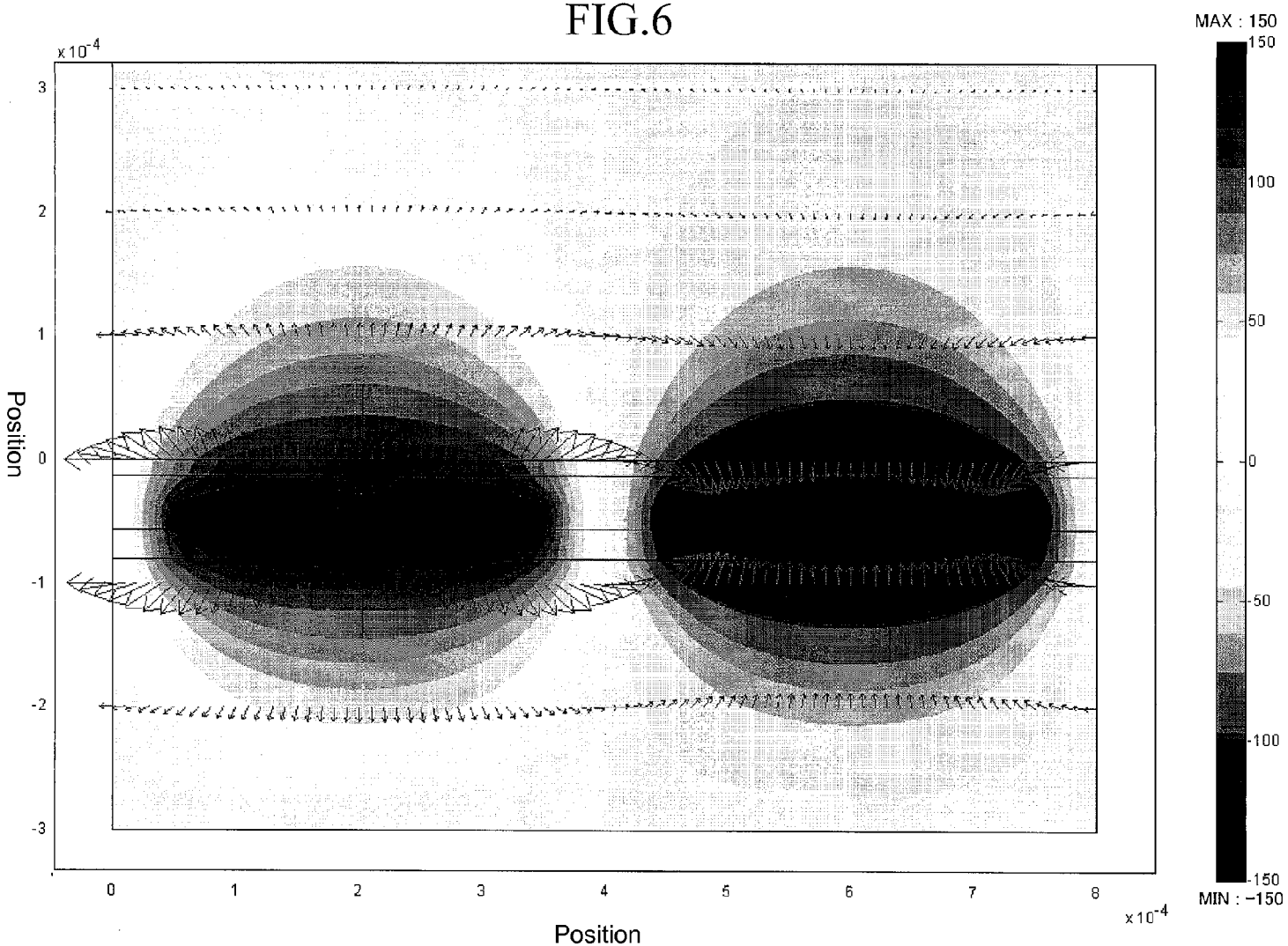
FIG. 6 is a view showing the results of analysis of electric potential distribution, electric field direction, and electric field strength by a finite-element method under the condition that, in FIG. 5, two leftmost transport electrodes have an electric potential of +150 V, and two rightmost transport electrodes have an electric potential of −150 V in the case where a transport electrode overcoating layer in FIG. 5 has a relative dielectric constant of 4 (comparative example).
Figure 7:
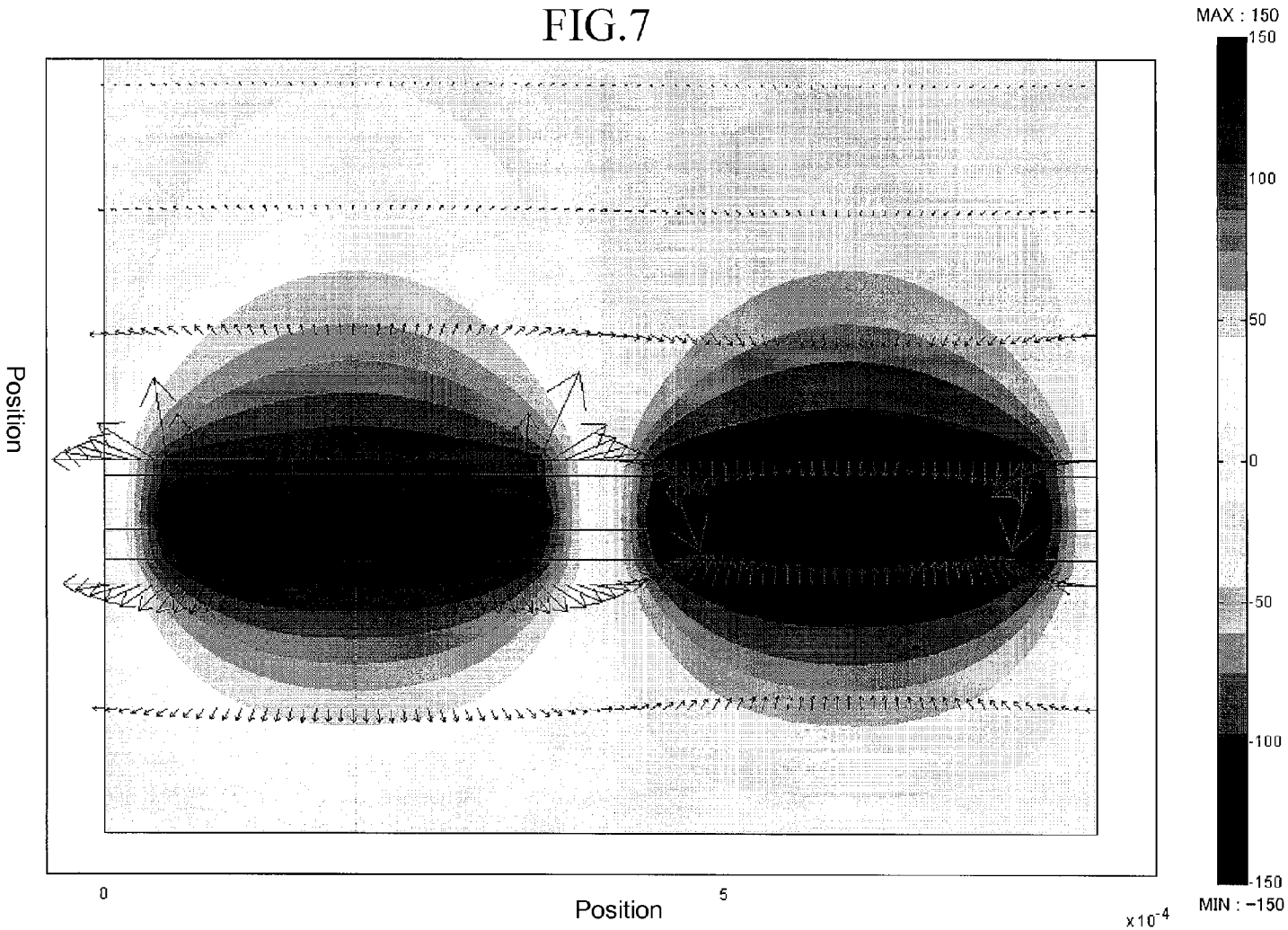
FIG. 7 is a view showing the results of analysis of electric potential distribution, electric field direction, and electric field strength by the finite-element method under the condition that, in FIG. 5, two leftmost transport electrodes have an electric potential of +150 V, and two rightmost transport electrodes have an electric potential of −150 V in the case where a low relative dielectric constant portion of the transport electrode overcoating layer in FIG. 5 has a relative dielectric constant of 4 and a high relative dielectric constant portion thereof has a relative dielectric constant of 300.

FIGS. 5 to 7 show the results of computer simulations of electric field strength and toner behavior in relation to relative dielectric constant of the transport electrode overcoating layer 63*d* (similar results were obtained for electric field strength and toner behavior in relation to relative dielectric constant of the counter electrode overcoating layer 65*d*).

FIG. 5 is a side sectional view showing, on a further enlarged scale, the transport wiring substrate 63 shown in FIG. 2. In FIG. 5, the vertical axis and the horizontal axis represent position (distance) in a unit of $10^{-4}$ m.

The dimensions of the transport electrode 63*a* was 18 μm in thickness and 100 μm in electrode width (width along the sub-scanning direction). A pitch between the transport electrodes 63*a* was 100 μm.

The transport electrode support film 63*b* had a thickness of 25 μm and a relative dielectric constant of 5.

The transport electrode coating layer 63*c* had a maximum thickness (thickness of a portion where the transport electrodes 63*a* are not provided) of 43 μm and a relative dielectric constant of 2.3.

The transport electrode overcoating layer 63*d* had a thickness of 12.5 μm and a relative dielectric constant of 4 or 300.

Under the above-mentioned conditions, an electric field analysis was conducted by a finite-element method.

FIGS. 6 and 7 show the results of analysis of electric potential distribution, electric field direction, and electric field strength by the finite-element method under the condition that, in FIG. 5, the two leftmost transport electrodes 63*a* had an electric potential +150 V, and the two rightmost transport electrodes 63*a* had an electric potential of −150 V. Electric potential distribution is represented by darkness of color (the darker the color, the greater the absolute value of electric field); an electric field direction is represented by the direction of an arrow; and electric field strength is represented by the length of an arrow.

FIG. 6 shows the case (comparative example) where the transport electrode overcoating layer 63*d* in FIG. 5 has a relative dielectric constant of 4. FIG. 7 shows the case where the transport electrode overcoating layer 63*d* in FIG. 5 has the low relative dielectric constant portions 63*d*1 whose relative dielectric constant is 4 and the high relative dielectric constant portions 63*d*2 whose relative dielectric constant is 300 as shown in FIG. 2. Further, FIG. 8 is a graph showing a distribution of the y component (a component along the vertical direction) of the electric field along the x-direction (the toner transport direction TTD) in the comparative example and the present embodiment.

Figure 8:
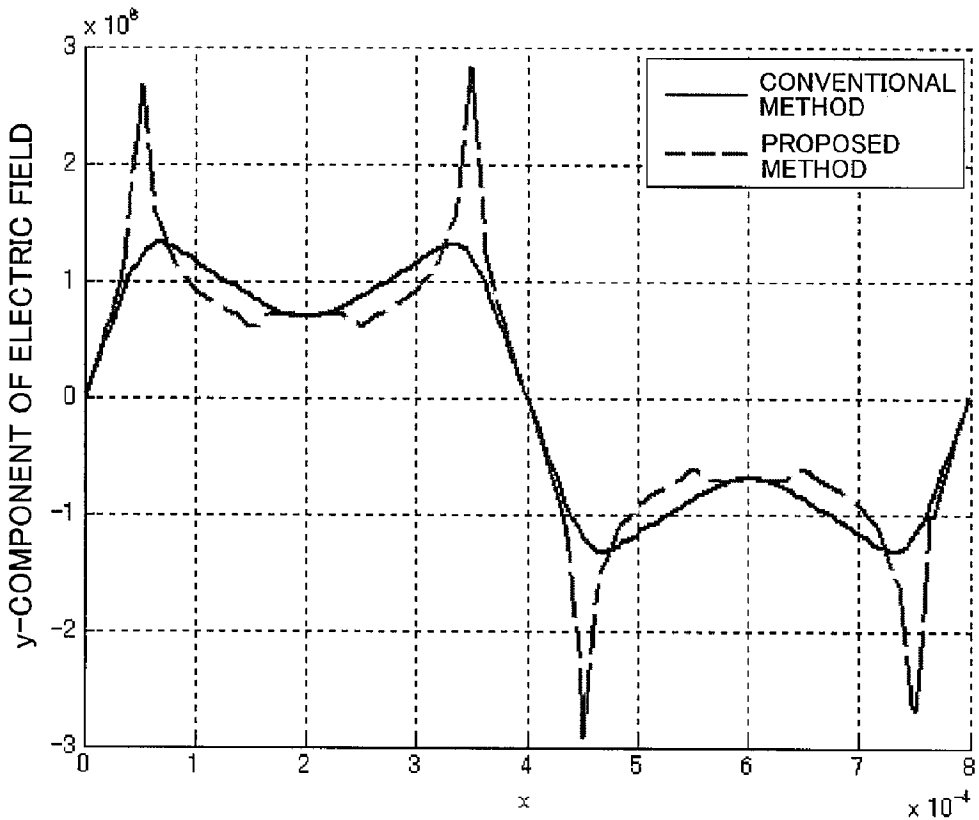
FIG. 8 is a graph showing distribution of the y-component (component in the vertical direction) of electric field along the x direction (toner transport direction) in the comparative example and the present mode.

Referring to FIGS. 5, 6, and 8, in the case of the structure of the comparative example, the electric field strength changes relatively smoothly along the toner transport direction TTD.

In contrast, referring to FIGS. 2, 5, 7, and 8, in the case of the structure of the present embodiment, a large peak appeared in the distribution of the electric field in the y-axis (a direction parallel to a direction along which the toner T flies from the toner transport surface TTS of the transport wiring substrate 63 to the latent image forming surface LS of the photoconductor drum 3). The peak appears at each of opposite ends, with respect to the x-direction (the toner transport direction TTD), of each high relative dielectric constant portion 63*d*2 between adjacent transport electrodes 63*a* maintained at potentials different from each other.

As described above, according to the configuration of the present embodiment, a force for lifting the toner T along the y-direction (the vertical direction) strongly acts at the boundaries between the low relative dielectric constant portion 63*d*1 and the high relative dielectric constant portion 63*d*2 in the counter area CA. That is, the toner T can be accelerated toward the latent image forming surface LS in the counter area CA where the toner T is carried onto the latent image forming surface LS.

Further, in the present embodiment, an electric field component which vibrates the toner T along the y-direction (the vertical direction) and an electric field component which transports the toner T in the x-axis direction (the toner transport direction TTD) increase at the boundaries between the low relative dielectric constant portion 65*d*1 and the high relative dielectric constant portion 65*d*2 in the counter area neighboring area CNA. Accordingly, in the counter area neighboring area CNA, it is possible to satisfactorily transport the toner T to the counter area CA, while effectively suppressing the lifting of the toner T in the vicinity of the opening edge of the toner passage hole 61*a*1.

The above-described configuration can effectively lift the toner T in the counter area CA, while suppressing unnecessary lifting of the toner T in the vicinity of the toner passage hole 61*a*1. Thus, it becomes possible to satisfactorily obtain a necessary image density by the toner T, while suppressing generation of so-called "white-background fogging."

<Second Embodiment of Toner Supply Apparatus>

The configuration of a second embodiment will now be described with reference to FIG. 9.

In the following description of the second embodiment, members similar in structure and function to those used in the above-described embodiment can be denoted by the same reference numerals as those of the above-described embodiment. As for the description of these members, an associated description appearing in the description of the above embodiment can be cited, so long as no technical inconsistencies are involved (the same convention also applies to the third and subsequent embodiments to be described later).

Figure 9:
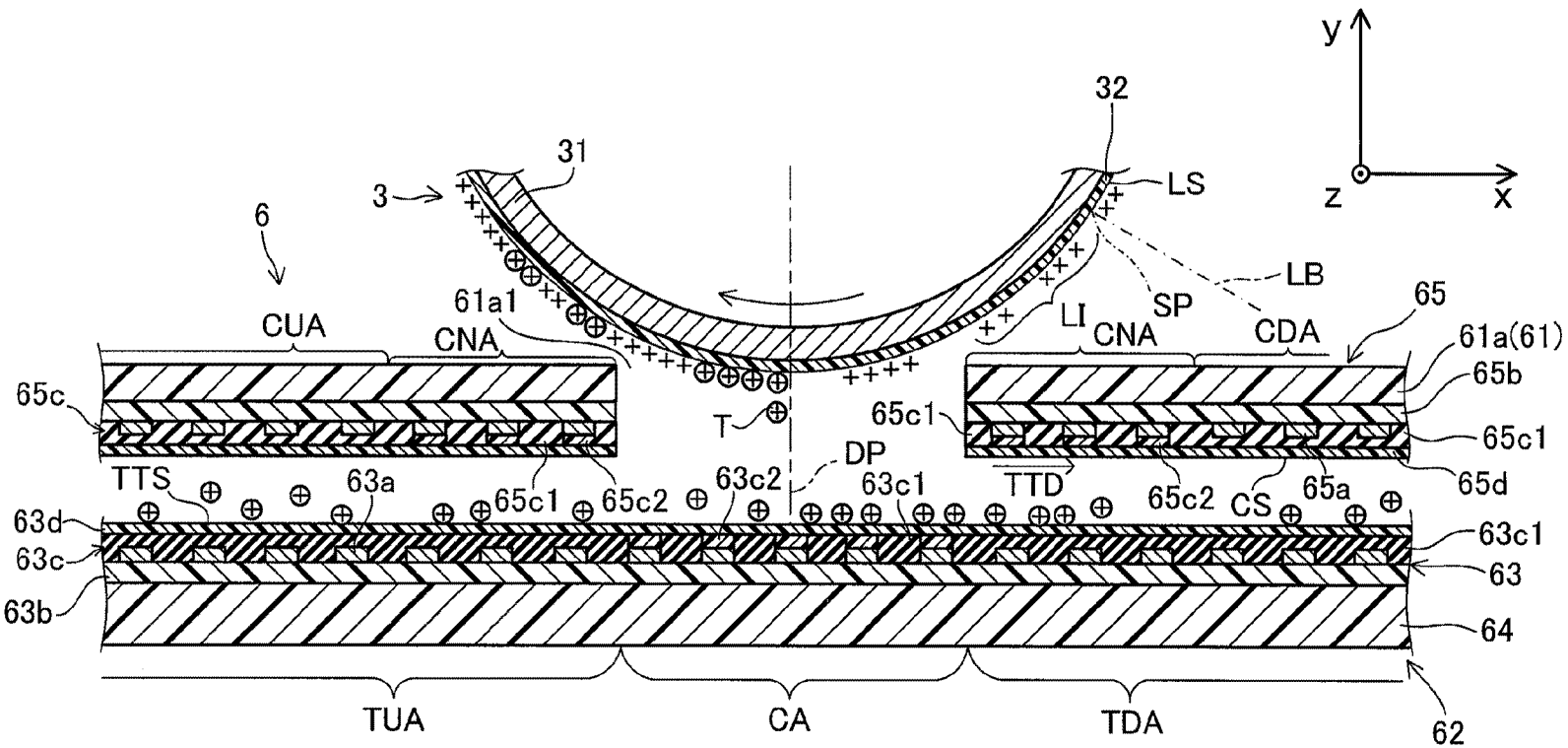
FIG. 9 is a side sectional view showing, on an enlarged scale, the periphery of the developing position in a second embodiment of the toner supply apparatus shown in FIG. 2.

FIG. 9 is a side sectional view showing, on an enlarged scale, the periphery of the developing position DP in the second embodiment of the toner supply apparatus 6 shown in FIG. 2.

Referring to FIG. 9, in the present embodiment, in place of the transport electrode overcoating layer 63*d*, the transport electrode coating layer 63*c* includes low relative dielectric constant portions 63*c*1 and high relative dielectric constant portions 63*c*2. The high relative dielectric constant portions 63*c*2 are formed of a material whose relative dielectric constant is higher than that of the low relative dielectric constant portions 63*c*1.

In the present embodiment, the high relative dielectric constant portions 63*c*2 are provided at portions (first portions) corresponding to the transport electrodes 63*a* in the counter area CA; and the low relative dielectric constant portions 63*c*1 are provided at portions (second portions) each located between two transport electrodes 63*a* adjacent to each other in the counter area CA, a portion corresponding to the upstream area TUA, and a portion corresponding to the downstream area TDA.

Further, in the present embodiment, in place of the counter electrode overcoating layer 65*d*, the counter electrode coating layer 65*c* includes low relative dielectric constant portions 65*c*1 and high relative dielectric constant portions 65*c*2. The high relative dielectric constant portions 65*c*2 are formed of a material whose relative dielectric constant is higher than that of the low relative dielectric constant portions 65*c*1.

In the present embodiment, the high relative dielectric constant portions 65*c*2 are provided at portions (first portions) corresponding to the counter electrodes 65*a* in the counter area neighboring area CNA; and the low relative dielectric constant portions 65*c*1 are provided at portions (second portions) each located between two counter electrodes 65*a* adjacent to each other in the counter area neighboring area CNA, a portion corresponding to the upstream area CUA, and a portion corresponding to the downstream area CDA.

Even the above-mentioned configuration yields actions and effects similar to those which the above-described first embodiment yields.

<Third Embodiment of Toner Supply Apparatus>

The configuration of a third embodiment will now be described with reference to FIG. 10.

Figure 10:
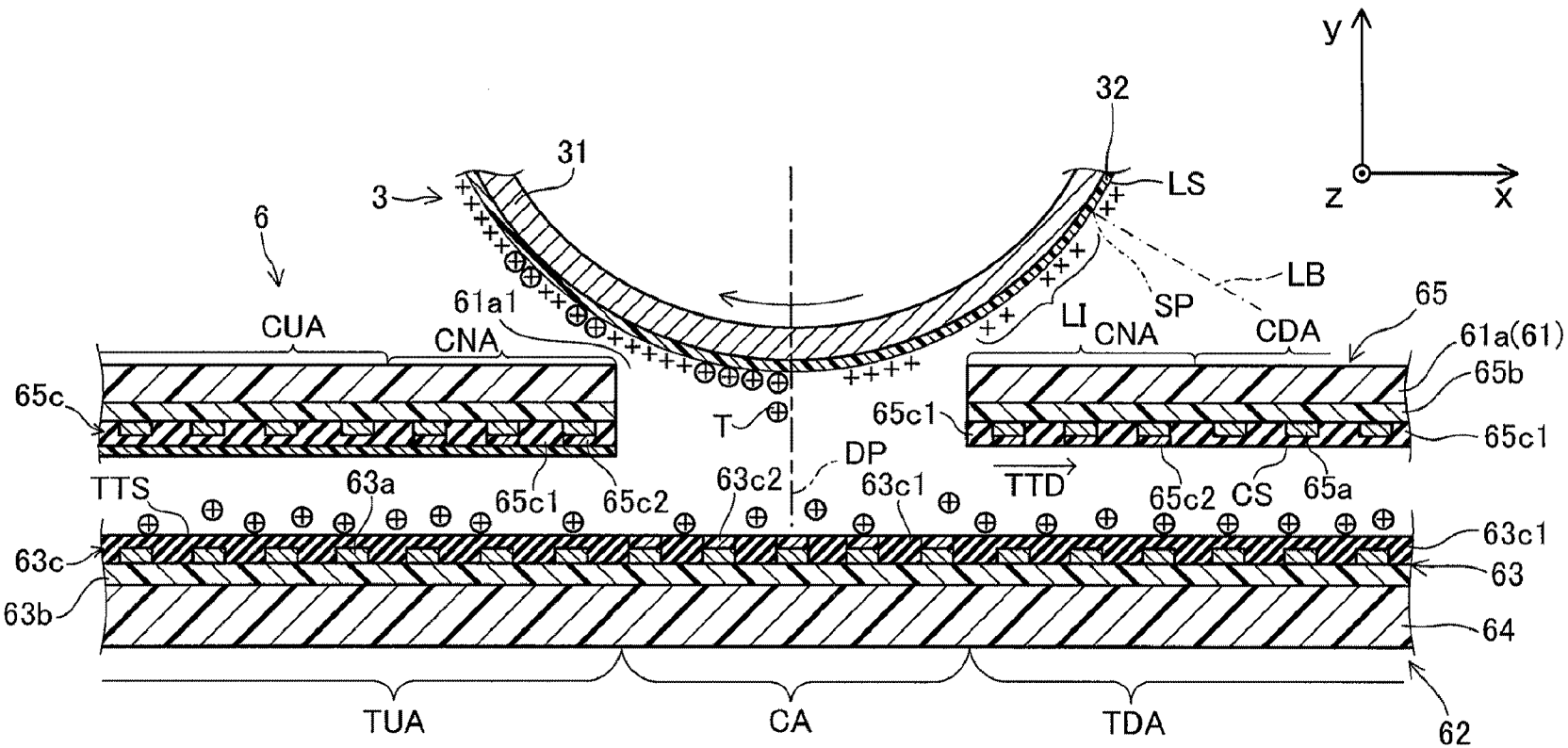
FIG. 10 is a side sectional view showing, on an enlarged scale, the periphery of the developing position in a third embodiment of the toner supply apparatus shown in FIG. 2.

FIG. 10 is a side sectional view showing, on an enlarged scale, the periphery of the developing position DP in the third embodiment of the toner supply apparatus 6 shown in FIG. 2.

Referring to FIG. 10, in the present embodiment, the transport electrode overcoating layer 63*d* (see FIG. 9) employed in the configuration of the above-described second embodiment is eliminated. That is, in the present embodiment, the transport electrode coating layer 63*c* serves as the transport electrode cover member of the present invention.

Also, in the present embodiment, the counter electrode overcoating layer 65*d* (see FIG. 9) employed in the configuration of the above-described second embodiment is eliminated. That is, in the present embodiment, the counter electrode coating layer 65*c* serves as the counter electrode cover member of the present invention.

Even the above-mentioned configuration yields actions and effects similar to those which the above-described embodiments yield.

<Modifications of First Mode>

In the following description of modifications, members similar in structure and function to those used in the above-described mode and embodiments can be denoted by the same reference numerals as those of the above-described mode and embodiments. As for the description of these members, an associated description appearing in the description of the above mode and embodiments can be cited, so long as no technical inconsistencies are involved (the same convention also applies to a second mode to be described later).

(1) In FIG. 2, the high relative dielectric constant portion 63*d*2 of the transport wiring substrate 63 may be provided in such a manner as to slightly project from the upstream and/or downstream end of the counter area CA with respect to the toner transport direction TTD. Alternatively, the high relative dielectric constant portion 63*d*2 of the transport wiring substrate 63 may be provided only in a region in the vicinity of the developing position DP (a region corresponding a portion of the width of the toner passage hole 61*a*1 with respect to the sub-scanning direction; for example, a region whose center coincides with the developing position DP and whose width is about half the width of the toner passage hole 61*a*1 with respect to the sub-scanning direction).

(2) In FIG. 2, the low relative dielectric constant portion 63*d*1 in the upstream area TUA and the low relative dielectric constant portion 63*d*1 in the downstream area TDA may differ in relative dielectric constant.

Alternatively, in FIG. 2, the low relative dielectric constant portion 65*d*1 in the upstream area CUA and the low relative dielectric constant portion 65*d*1 in the downstream area CDA may differ in relative dielectric constant.

Alternatively, in FIGS. 9 and 10, the low relative dielectric constant portion 63*c*1 in the upstream area TUA and the low relative dielectric constant portion 63*c*1 in the downstream area TDA may differ in relative dielectric constant.

Alternatively, in FIGS. 9 and 10, the low relative dielectric constant portion 65*c*1 in the upstream area CUA and the low relative dielectric constant portion 65*c*1 in the downstream area CDA may differ in relative dielectric constant.

(3) In the above-described embodiments and modifications thereof, a layer having a low relative dielectric constant may be provided at positions corresponding to the transport electrodes 63*a* and/or the counter electrodes 65*a*, and a layer having a high relative dielectric constant may be provided at other positions. That is, for example, the relation of magnitude between the relative dielectric constant of the low relative dielectric constant portion 63*d*1 and that of the high relative dielectric constant portion 63*d*2 may be reversed.

[2] Next, a second mode of the present invention will be described.

<Configuration of Laser Printer of Second Mode>

The present mode has the same basic configuration as that of the first mode described above. Thus, the above description of the basic configuration is cited, so long as no technical inconsistencies are involved. Configurational features peculiar to the present mode will be mainly described below.

Figure 11:
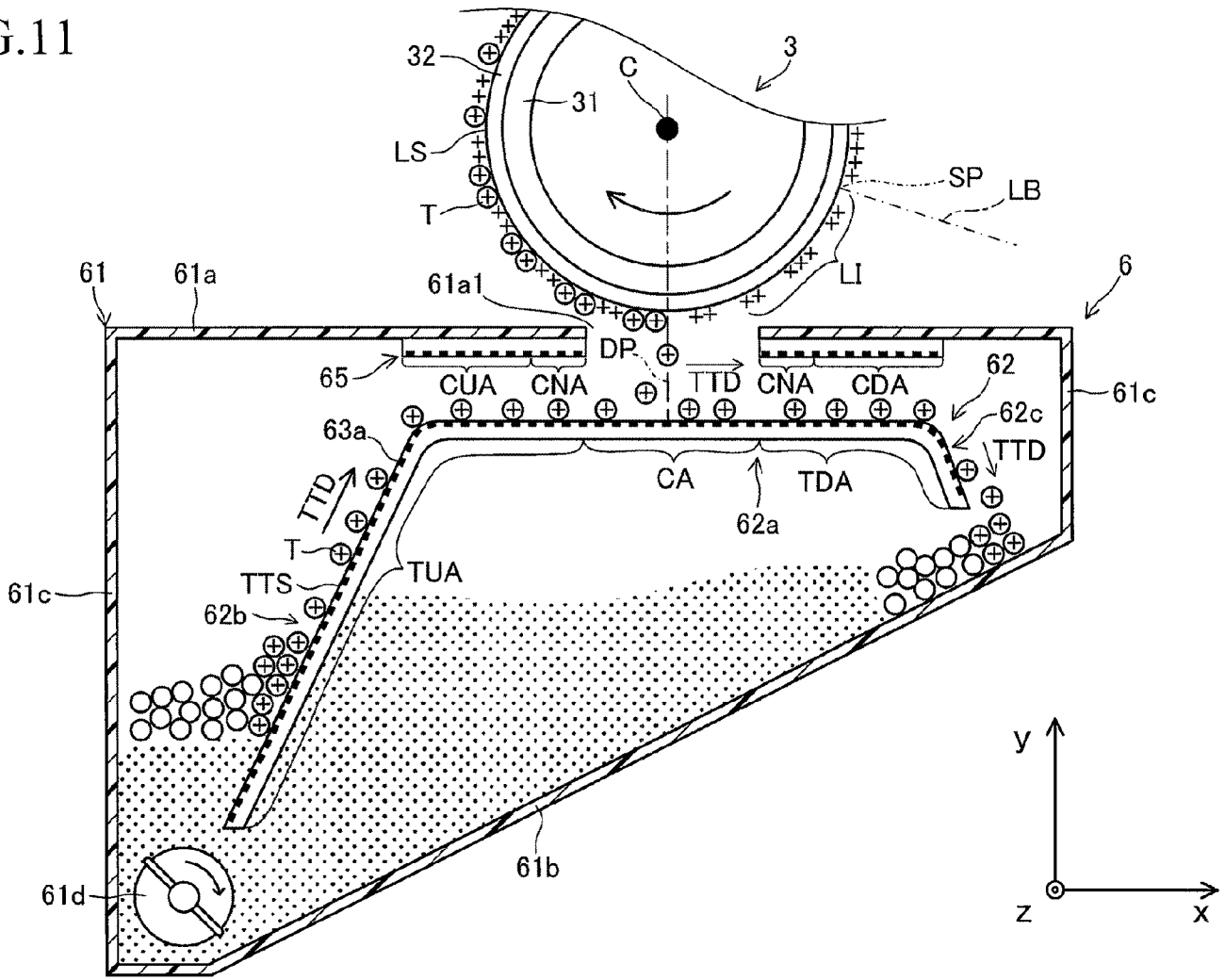
FIG. 11 is a side sectional view showing, on an enlarged scale, an area where a photoconductor drum and a toner supply apparatus face each other in a second mode of the laser printer shown in FIG. 1.

FIG. 11 is a side sectional view showing, on an enlarged scale, an area where the photoconductor drum 3 and the toner supply apparatus 6 shown in FIG. 1 face each other.

<<Toner Supply Apparatus>>

A bottom plate 61*b* of the toner box 61 is a rectangular plate-like member as viewed in plane and is disposed under the top plate 61*a*. The bottom plate 61*b* is disposed in such an inclined manner as to rise in the y-axis direction with distance along the x-axis direction in FIG. 11.

Four side edges of each of the top plate 61*a* and the bottom plate 61*b* are surrounded by four side plates 61*c* (FIG. 11 shows only two side plates 61*c*). Upper ends and lower ends of the four side plates 61*c* are integrally connected to the top plate 61*a* and the bottom plate 61*b*, respectively, whereby the toner box 61 can contain the toner T in such a manner as not to allow leakage of the toner T to the exterior thereof.

A toner stirrer 61*d* is provided in a deepest portion of the toner box 61. The toner stirrer 61*d* is configured to be able to impart fluidity like that of fluid to aggregates of the toner T stored within the toner box 61 by means of stirring the toner T (the toner T before being transported in a predetermined toner transport direction TTD to be described later).

In the present mode, the toner stirrer 61*d* is formed of a rotary member resembling a vane wheel and rotatably supported by the pair of side plates 61*c* of the toner box 61.

<<<Toner Electric Field Transport Body>>

The toner electric field transport body 62 includes a central component portion 62*a*, an upstream component portion 62*b*, and a downstream component portion 62*c*.

As viewed in plane, the central component portion 62*a* assumes substantially the form of a rectangle whose long sides have a length approximately equal to the width of the photoconductor drum 3 along the main scanning direction and whose short sides have a length longer than the diameter of the photoconductor drum 3. The central component portion 62*a* is provided at a position where its center with respect to the sub-scanning direction (x-axis direction in FIG. 11) coincides with the center of the toner passage hole 61*a*1 with respect to the sub-scanning direction. That is, the central component portion 62*a* is disposed substantially in parallel with the top plate 61*a* in such a manner as to face the latent image forming surface LS with the toner passage hole 61*a*1 therebetween.

The upstream component portion 62*b* extends upstream and obliquely downward with respect to the toner transport direction TTD from an upstream end portion of the central component portion 62*a* with respect to the toner transport direction TTD. That is, the upstream component portion 62*b* is a plate-like member disposed in such a manner as to obliquely rise toward the central component portion 62*a*.

A lower end portion of the upstream component portion 62*b* is provided in the vicinity of the toner stirrer 61*d*. That is, the upstream component portion 62*b* is provided such that its most upstream end portion with respect to the toner transport direction TTD reaches the vicinity of a deepest portion of the toner box 61, whereby, even in the case of a small amount of the toner T, a portion (a lower end portion) of the upstream component portion 62*b* is buried in the toner T.

The downstream component portion 62*c* extends downstream and obliquely downward from a downstream end portion of the central component portion 62*a* with respect to the toner transport direction TTD. That is, the downstream component portion 62*c* is a plate-like member disposed in such a manner as to obliquely lower with distance from the central component portion 62*a*.

A lower end portion of the downstream component portion 62*c* is provided in the proximity of the bottom plate 61*b* of the toner box 61. That is, the downstream component portion 62*c* is provided such that its most downstream end portion with respect to the toner transport direction TTD reaches the vicinity of the bottom plate 61*b* of the toner box 61, whereby the toner T can smoothly return to the bottom plate 61*b*.

<First Embodiment of Toner Supply Apparatus of the Present Mode>

The configuration of a first embodiment of the present mode will next be described with reference to FIGS. 12 to 19.

Figure 12:
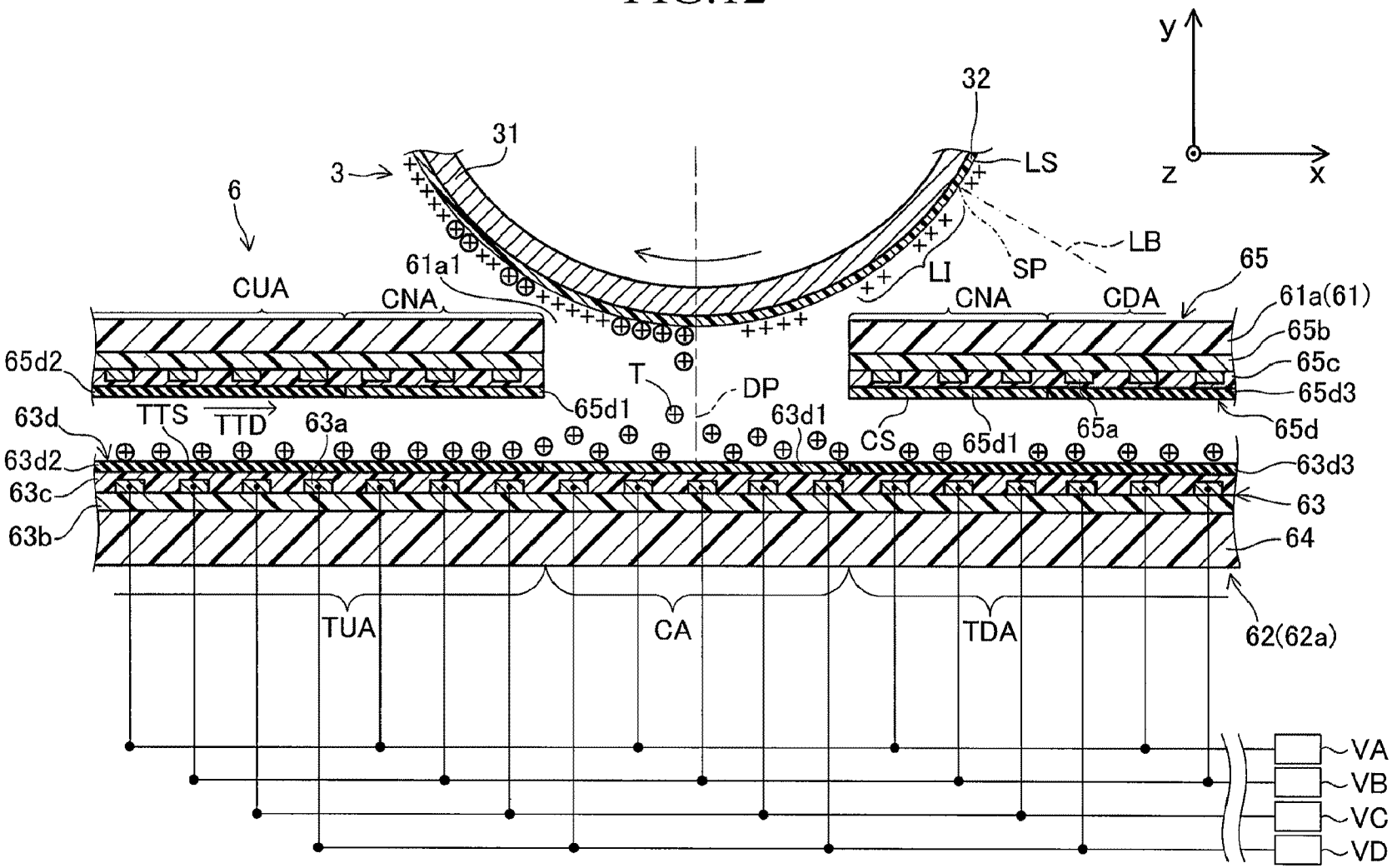
FIG. 12 is a side sectional view showing, on an enlarged scale, a region around a developing position in a first embodiment of a toner supply apparatus shown in FIG. 11.

FIG. 12 is a side sectional view showing, on an enlarged scale, the periphery of the developing position DP in the first embodiment of the toner supply apparatus 6 shown in FIG. 11.

<<Transport Wiring Substrate>>

In the present embodiment, the transport electrode overcoating layer 63*d* includes a low relative dielectric constant portion 63*d*1, an upstream high relative dielectric constant portion 63*d*2, and a downstream high relative dielectric constant portion 63*d*3.

The low relative dielectric constant portion 63*d*1 is provided at a position corresponding to a counter area CA. The counter area CA in the present embodiment is an area of the toner electric field transport body 62 where the latent image forming surface LS and the toner transport surface TTS face each other with the toner passage hole 61*a*1 therebetween. That is, the counter area CA is an area corresponding to the toner passage hole 61*a*1 (an area located just under the toner passage hole 61*a*1).

Specifically, in the present embodiment, the low relative dielectric constant portion 63*d*1 is provided between an upstream opening edge of the toner passage hole 61*a*1 with respect to the toner transport direction TTD and a downstream opening edge of the toner passage hole 61*a*1 with respect to the toner transport direction TTD.

The upstream high relative dielectric constant portion 63*d*2 is formed of a material higher in relative dielectric constant than the low relative dielectric constant portion 63*d*1. The upstream high relative dielectric constant portion 63*d*2 is provided at a position corresponding to an upstream area TUA.

The upstream area TUA is an area of the toner electric field transport body 62 located upstream of the counter area CA with respect to the toner transport direction TTD. That is, the upstream high relative dielectric constant portion 63*d*2 is provided such that the downstream edge of the upstream area TUA with respect to the toner transport direction TTD corresponds to the downstream edge of the upstream high relative dielectric constant portion 63*d*2 with respect to the toner transport direction TTD.

The downstream high relative dielectric constant portion 63*d*3 is formed of a material higher in relative dielectric constant than the low relative dielectric constant portion 63*d*1. The downstream high relative dielectric constant portion 63*d*3 is provided at a position corresponding to a downstream area TDA.

The downstream area TDA is an area of the toner electric field transport body 62 located downstream of the counter area CA with respect to the toner transport direction TTD. That is, the downstream high relative dielectric constant portion 63*d*3 is provided such that the upstream edge of the downstream area TDA with respect to the toner transport direction TTD corresponds to the upstream edge of the downstream high relative dielectric constant portion 63*d*3 with respect to the toner transport direction TTD.

As described above, the transport electrode overcoating 63*d* is formed such that relative dielectric constant is higher in the upstream area TUA and the downstream area TDA than in the counter area CA.

<<Counter Wiring Substrate>>

In the present embodiment, the counter electrode overcoating layer 65*d* includes a low relative dielectric constant portion 65*d*1, an upstream high relative dielectric constant portion 65*d*2, and a downstream high relative dielectric constant portion 65*d*3.

The low relative dielectric constant portion 65*d*1 is provided at a position corresponding to a counter area neighboring area CNA. The counter area neighboring area CNA is an area of the counter wiring substrate 65 in the vicinity of the toner passage hole 61*a*1. That is, the counter area neighboring area CNA is an area of the counter wiring substrate 65 in the vicinity of the counter area CA of the toner electric field transport body 62 (transport wiring substrate 63).

The upstream high relative dielectric constant portion 65*d*2 is provided at a position corresponding to an upstream area CUA. The upstream area CUA is an area of the counter wiring substrate 65 located upstream of the counter area neighboring area CNA with respect to the toner transport direction TTD. The upstream high relative dielectric constant portion 65*d*2 is formed of a material higher in relative dielectric constant than the counter area neighboring area CNA.

The downstream high relative dielectric constant portion 65*d*3 is provided at a position corresponding to a downstream area CDA. The downstream area CDA is an area of the counter wiring substrate 65 located downstream of the counter area neighboring area CNA with respect to the toner transport direction TTD. The downstream high relative dielectric constant portion 65*d*3 is formed of a material higher in relative dielectric constant than the counter area neighboring area CNA.

That is, the counter electrode overcoating layer 65*d* is formed such that relative dielectric constant is higher in the upstream area CUA and the downstream area CDA than in the counter area neighboring area CNA.

<Operation of Laser Printer>

As for operations provided by the structure of the present mode, corresponding descriptions in the first mode are cited, except for operations peculiar to the present mode described below, so long as no technical inconsistencies are involved.

<<<Transport and Supply of Charged Toner>>>

Referring to FIG. 11, the toner stirrer 61*d* fluidizes the toner T contained in the toner box 61. Specifically, the vane wheel of the toner stirrer 61*d* rotates in the direction (clockwise) indicated by the illustrated arrow.

The operation of the toner stirrer 61*d* causes friction between the toner T and the toner transport surface TTS (surface of the transport electrode overcoating layer 63*d* made of a synthetic resin in FIG. 12) of the upstream component portion 62*b*. Thus, the toner T is positively charged.

As mentioned previously, an upstream (left in FIG. 11) end portion of the toner electric field transport body 62 (upstream component portion 62*b*) with respect to the toner transport direction TTD is buried in the toner T. Thus, the toner T contained in the toner box 61 is supplied at all times onto the toner transport surface TTS in the upstream area TUA.

Also, traveling wave transport voltages are applied to the plurality of transport electrodes 63*a* of the toner electric field transport body 62. Accordingly, a predetermined traveling wave electric field is formed on the toner transport surface TTS. By the effect of the traveling wave electric field, the positively charged toner T is transported on the toner transport surface TTS along the toner transport direction TTD.

FIGS. 13 to 18 show the results of computer simulations of electric field strength and toner behavior in relation to relative dielectric constant of the transport electrode overcoating layer 63*d*.

Figure 13:
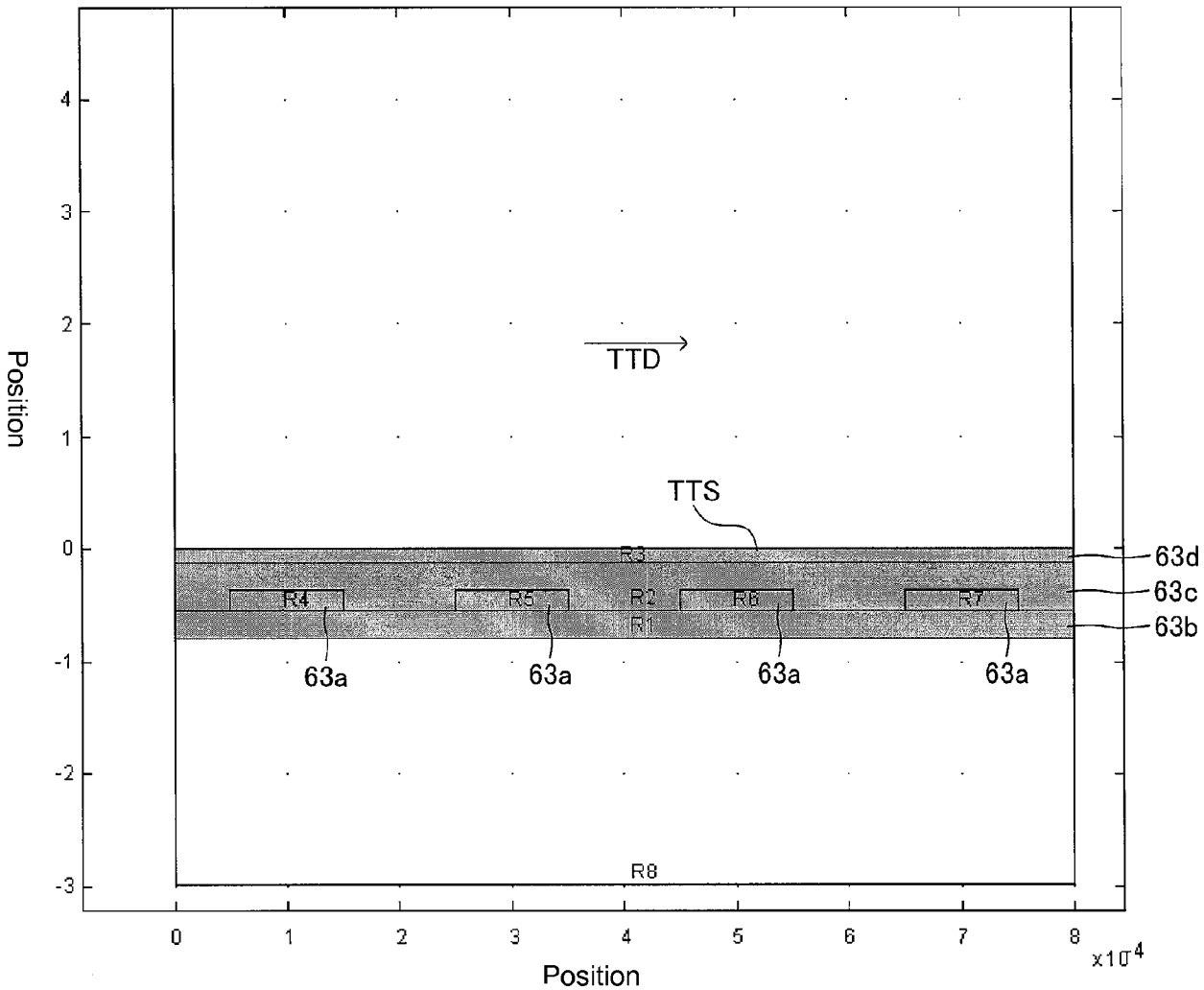
FIG. 13 is a side sectional view showing, on a further enlarged scale, a transport wiring substrate shown in FIG. 12.

FIG. 13 is a side sectional view showing, on a further enlarged scale, the transport wiring substrate 63 shown in FIG. 12. In FIG. 13, the vertical axis and the horizontal axis represent position (distance) in a unit of $10^{-4}$ m.

The dimensions of the transport electrode 63*a* was 18 μm in thickness and 100 μm in electrode width (width along the sub-scanning direction). A pitch between the transport electrodes 63*a* was 100 μm.

The transport electrode support film 63*b* had a thickness of 25 μm and a relative dielectric constant of 5.

The transport electrode coating layer 63*c* had a maximum thickness (thickness of a portion where the transport electrodes 63*a* are not provided) of 43 μm and a relative dielectric constant of 2.3.

The transport electrode overcoating layer 63*d* had a thickness of 12.5 μm and a relative dielectric constant of 4 or 300.

Under the above-mentioned conditions, electric field analysis was conducted by a finite-element method, and particle behavior analysis was conducted by a distinct-element method.

Figure 14:
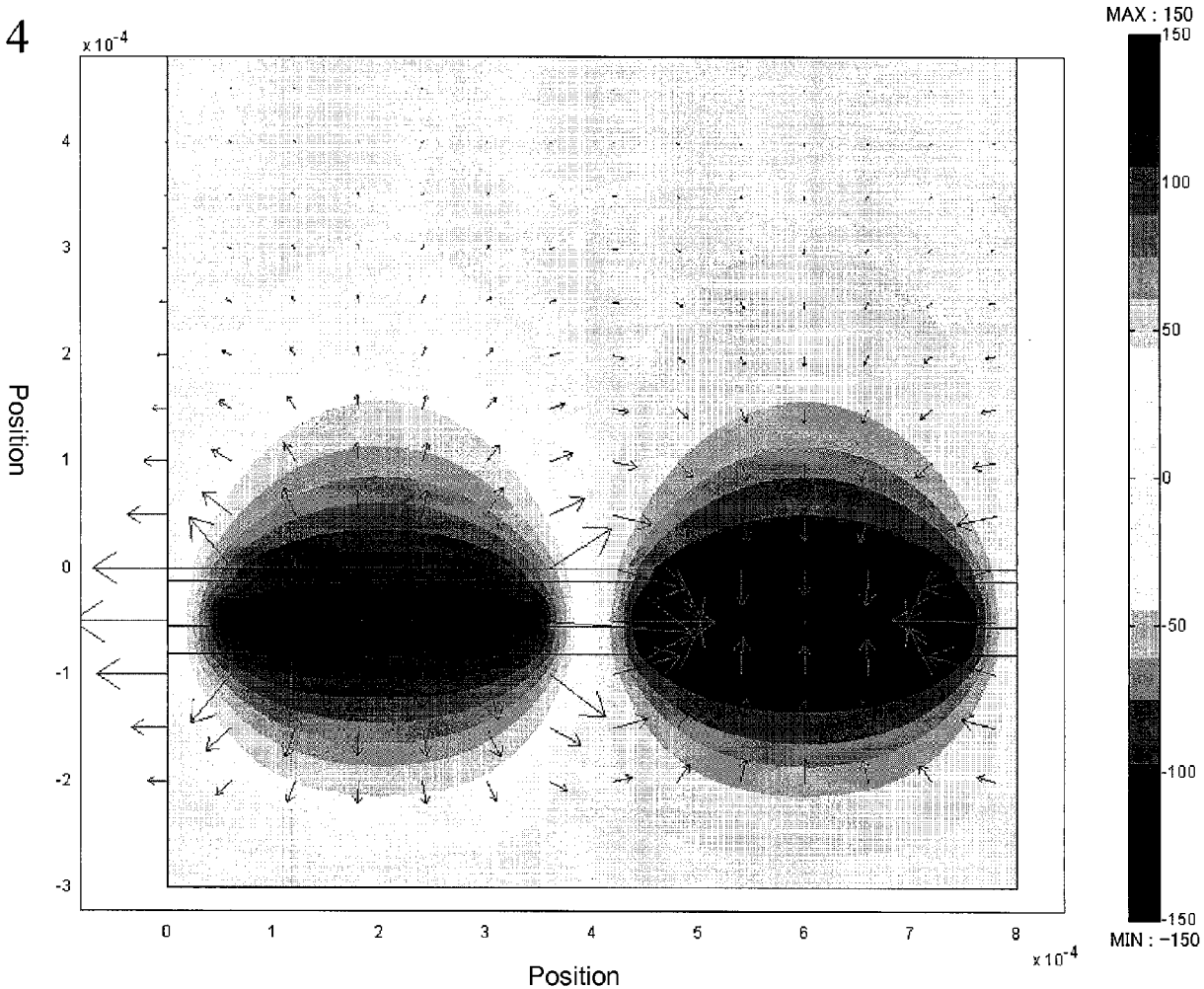
FIG. 14 is a view showing the results of analysis of electric potential distribution, electric field direction, and electric field strength by a finite-element method under the condition that, in FIG. 13, two leftmost transport electrodes have an electric potential of +150 V, and two rightmost transport electrodes have an electric potential of −150 V in the case where a transport electrode overcoating layer in FIG. 13 has a relative dielectric constant of 4.
Figure 15:
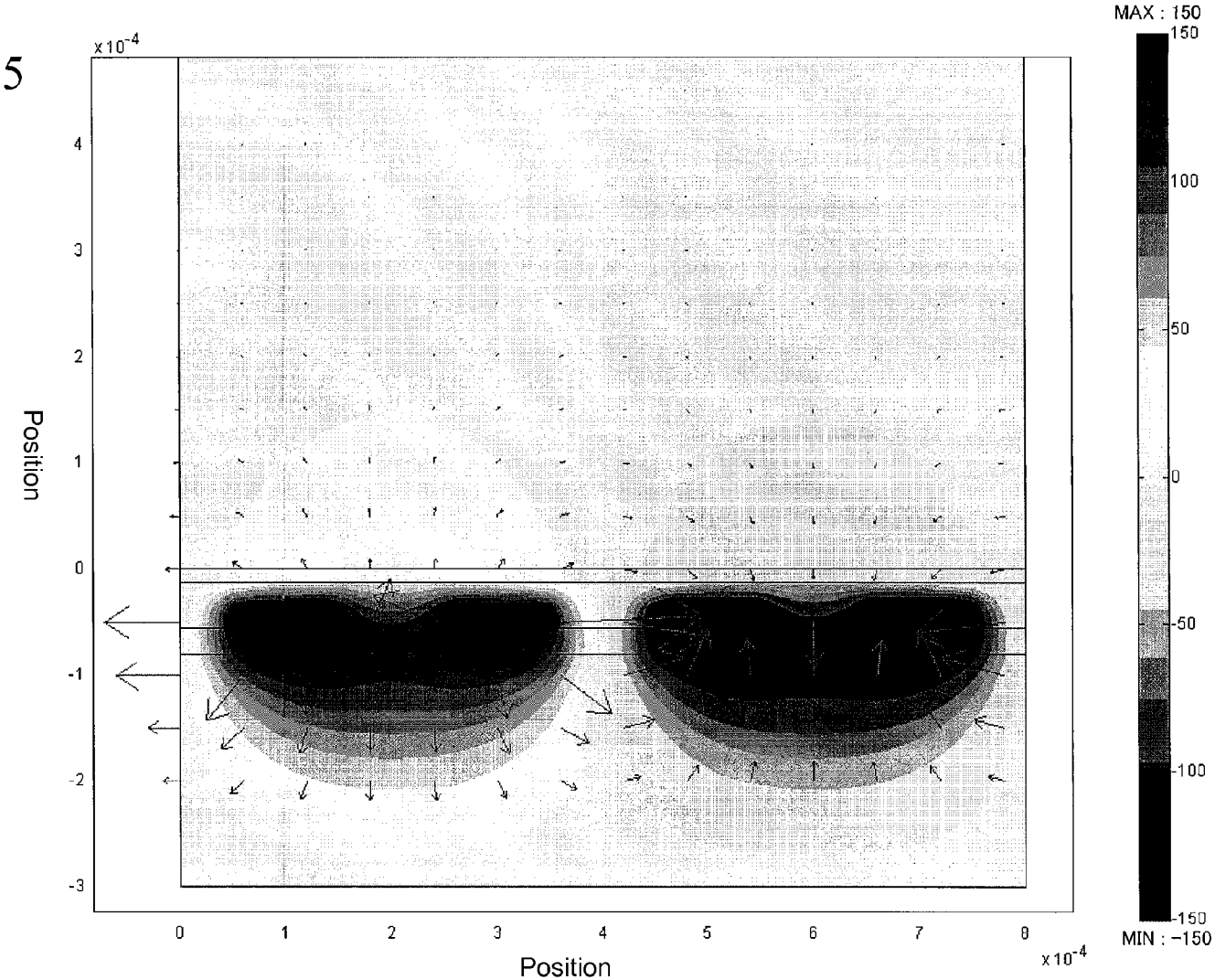
FIG. 15 is a view showing the results of analysis of electric potential distribution, electric field direction, and electric field strength by the finite-element method under the condition that, in FIG. 13, two leftmost transport electrodes have an electric potential of +150 V, and two rightmost transport electrodes have an electric potential of −150 V in the case where the transport electrode overcoating layer in FIG. 13 has a relative dielectric constant of 300.

FIGS. 14 and 15 show the results of analysis of electric potential distribution, electric field direction, and electric field strength by the finite-element method under the condition that, in FIG. 13, the two leftmost transport electrodes 63*a* had an electric potential +150 V, and the two rightmost transport electrodes 63*a* had an electric potential of −150 V. Electric potential distribution is represented by darkness of color (the darker the color, the greater an absolute value of electric field); an electric field direction is represented by the direction of an arrow; and electric field strength is represented by the length of an arrow.

FIG. 14 shows the case where the transport electrode overcoating layer 63*d* in FIG. 13 has a relative dielectric constant of 4. FIG. 15 shows the case where the transport electrode overcoating layer 63*d* in FIG. 13 has a relative dielectric constant of 300.

As is apparent from FIGS. 13 to 15, the case of the transport electrode overcoating layer 63*d* having the higher relative dielectric constant is lower in electric field strength on the toner transport surface TTS with respect to the toner transport direction TTD and the height direction.

Figure 16:
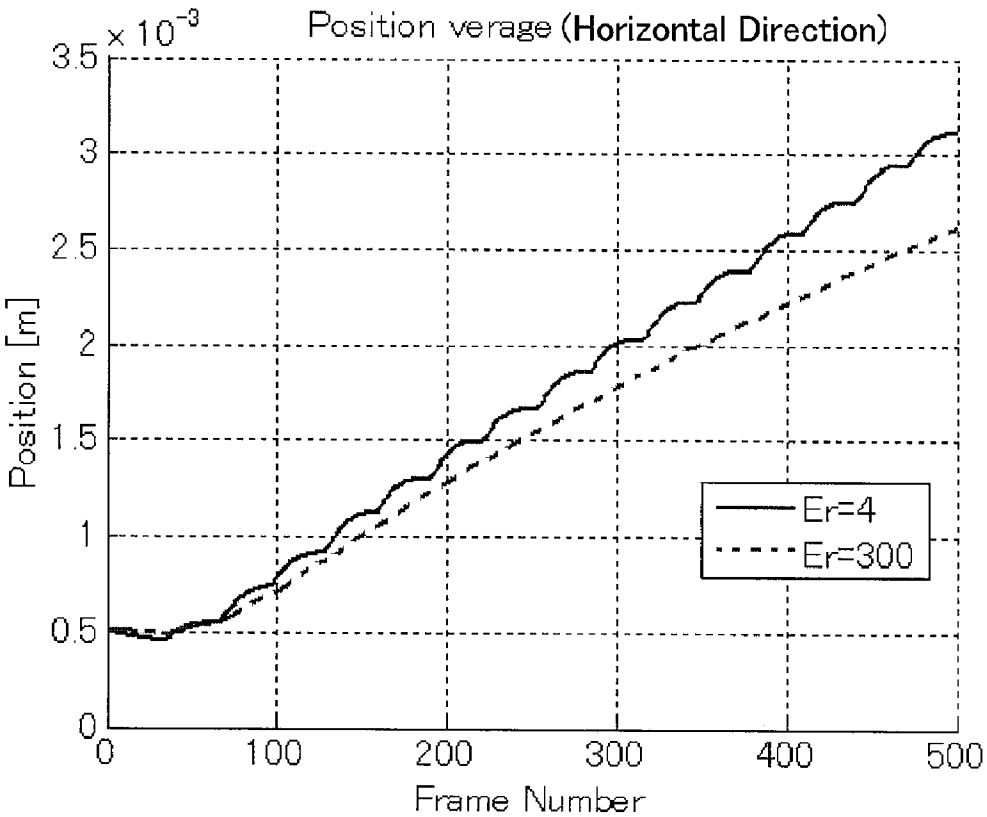
FIG. 16 is a graph showing the results of analysis of toner position along a toner transport direction (horizontal direction) by a distinct-element method in the case where traveling wave voltages are applied to the plurality of transport electrodes in FIG. 13.
Figure 17:
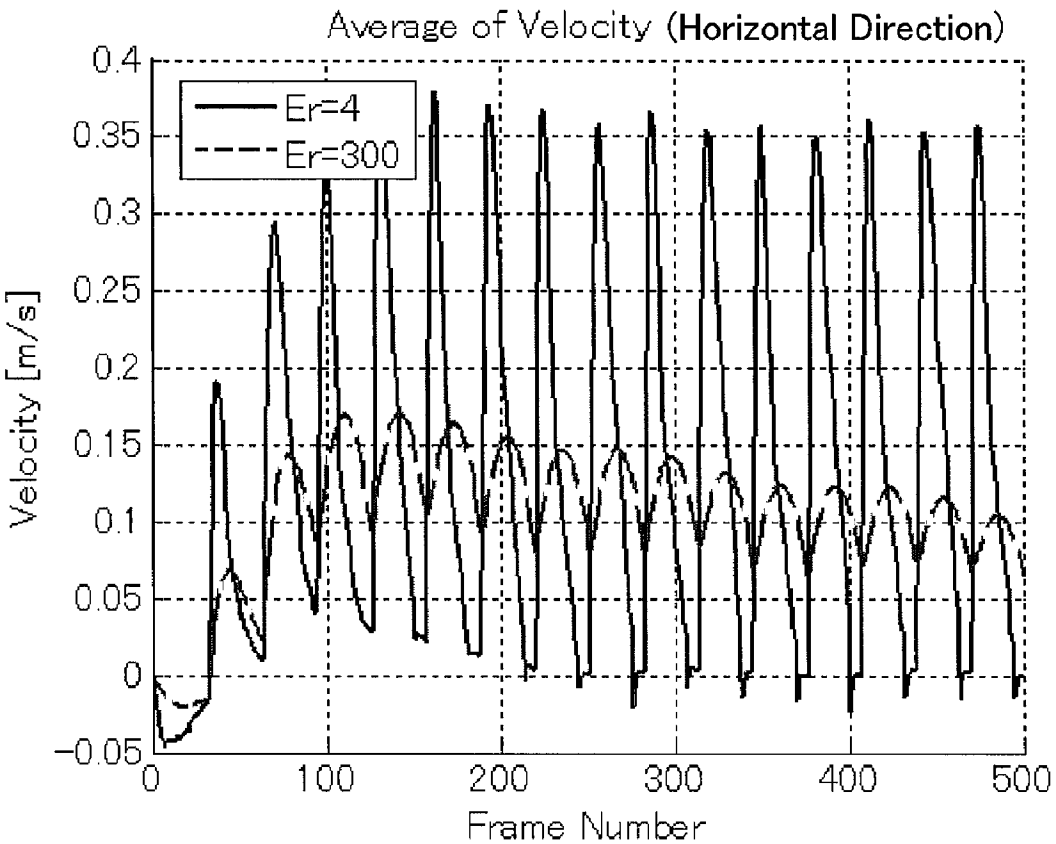
FIG. 17 is a graph showing the results of analysis of toner velocity along the toner transport direction (horizontal direction) by the distinct-element method in the case where traveling wave voltages are applied to the plurality of transport electrodes in FIG. 13.

FIG. 16 is a graph showing the results of analysis of toner position along the toner transport direction TTD (horizontal direction) by the distinct-element method in the case where traveling wave voltages were applied to the plurality of transport electrodes 63*a* in FIG. 13. FIG. 17 is a graph showing the results of analysis of toner velocity along the toner transport direction TTD (horizontal direction) by the distinct-element method in the case where traveling wave voltages were applied to the plurality of transport electrodes 63*a* in FIG. 13.

Figure 18:
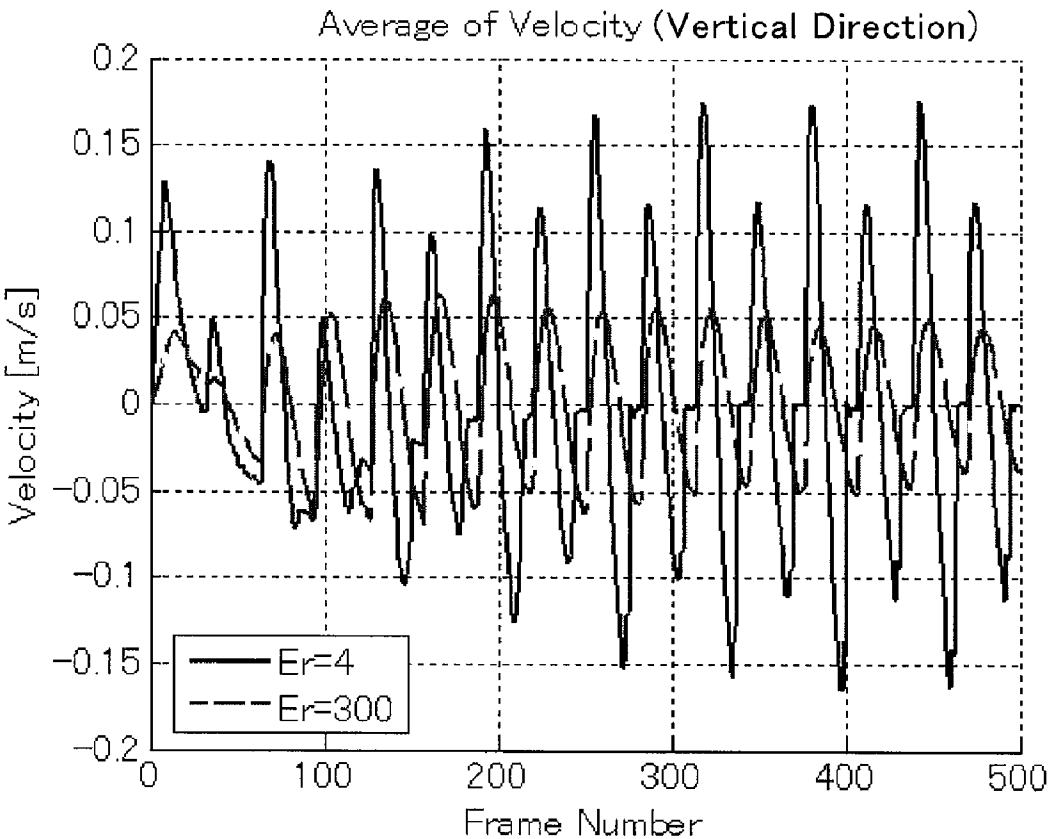
FIG. 18 is a graph showing the results of analysis of toner velocity along the height direction by the distinct-element method in the case where traveling wave voltages were applied to the plurality of transport electrodes in FIG. 13.

FIG. 18 is a graph showing the results of analysis of toner velocity along the height direction by the distinct-element method in the case where traveling wave voltages were applied to the plurality of transport electrodes 63*a* in FIG. 13.

In FIGS. 16 to 18, the horizontal axis which represents "Frame Number" corresponds to a time axis (1 Frame is equivalent to 40 μsec).

In the simulations whose results are shown in FIGS. 16 to 18, in an initial state in which 300 spherical toner particles each having a radius of 10 μm were laid on the toner transport surface TTS within a width of 1 mm along the toner transport direction TTD, the average position and the average velocity of the 300 toner particles were obtained (thus, at a Frame Number of 0, Position is 0.5 mm in FIG. 16).

Also, the density of toner was 1.2 g/cc, and the amount of charge of toner was 30 μC/g (the amount of charge per toner particle is $1.89\times10^{-14}$ C).

Furthermore, the frequency of transport voltage was 800 Hz.

As is apparent from FIGS. 13, 16, and 17, the case of the transport electrode overcoating layer 63*d* having the lower relative dielectric constant is higher in toner transport velocity in the toner transport direction TTD.

Also, as is apparent from FIGS. 13 and 18, the case of the transport electrode overcoating layer 63*d* having the lower relative dielectric constant is higher in velocity component of toner in the height direction. That is, in the case of the transport electrode overcoating layer 63*d* having the lower relative dielectric constant, the toner can fly higher from the toner transport surface TTS.

Referring to FIG. 11, by the effect of a traveling wave electric field formed on the toner transport surface TTS as mentioned above, the positively charged toner T moves upward on the sloped toner transport surface TTS of the upstream component portion 62*b*. Then, the toner T reaches the central component portion 62*a*.

In addition to the above-mentioned traveling wave electric field generated by the transport wiring substrate 63, a traveling wave electric field generated by the counter wiring substrate 65 also acts on the toner T which has reached the central component portion 62*a*.

Referring to FIG. 12, the toner T which has reached the central component portion 62*a* is transported in the toner transport direction TTD and reaches a position corresponding to the counter area neighboring area CNA (a position just under the counter area neighboring area CNA).

A portion of the counter electrode overcoating layer 65*d* in the counter area neighboring area CNA (low relative dielectric constant portion 65*d*1) is lower in relative dielectric constant than a portion of the counter electrode overcoating layer 65*d* in the upstream area CUA (upstream high relative dielectric constant portion 65*d*2).

Thus, the strength of the traveling wave electric field which is generated by the counter wiring substrate 65 and travels along the toner transport direction TTD is higher in the counter area neighboring area CNA than in the upstream area CUA. Accordingly, the velocity of transport of the toner T along the toner transport direction TTD is increased.

Further, the strength of a component of the electric field generated by the counter wiring substrate 65, the component acting in the direction from the counter wiring substrate surface CS toward the toner transport surface TTS (the direction opposite the y-direction in FIG. 12; i.e., the downward direction in FIG. 12), is also higher in the counter area neighboring area CNA than in the upstream area CUA. Accordingly, in the vicinity of the open edges of the toner passage hole 61*a*1, the toner T is pressed, with a relatively strong force, in the direction from the counter wiring substrate surface CS toward the toner transport surface TTS.

The toner T whose transport velocity has been increased in the counter area neighboring area CNA then reaches the counter area CA. In the counter area CA, the counter wiring substrate 65 is not provided. Accordingly, in the counter area CA, the toner T is transported solely by the effect of the traveling wave electric field generated by the transport wiring substrate 63.

A portion of the transport electrode overcoating layer 63*d* in the counter area CA (low relative dialectic constant portion 63*d*1) is lower in relative dielectric constant than a portion of the transport electrode overcoating layer 63*d* in the upstream area TUA (upstream high relative dielectric constant portion 63*d*2).

Thus, the strength of the traveling wave electric field generated by the transport wiring substrate 63 and acting along the toner transport direction TTD is high in the counter area CA than in the upstream area TUA.

Thus, the strength of a component of the electric field generated by the transport wiring substrate 63, the component acting in the direction from the toner transport surface TTS toward the counter wiring substrate surface CS (the y-direction in FIG. 12; i.e., the upward direction in FIG. 12), increases. Further, the above-mentioned force which is generated by the counter wiring substrate 65 and by which the toner T is pressed in the direction from the counter wiring substrate surface CS toward the toner transport surface TTS is removed or reduced.

Accordingly, the in the counter area CA located near the developing position DP, the toner T can fly vigorously toward the latent image forming surface LS.

The toner T which has passed the counter area CA then reaches a position corresponding to the counter area neighboring area CNA. At the position, the toner T again receives the electric field generated by the counter wiring substrate 65 and traveling along the toner transport direction TTD and the electric field component in the direction from the counter wiring substrate surface CS toward the toner transport surface TTS (the direction opposite the y-direction in FIG. 12; i.e., the downward direction in FIG. 12).

The toner T which has passed the counter area CA reaches the downstream area TDA. A portion of the transport electrode overcoating layer 63*d* in the downstream area TDA (downstream high relative dielectric constant portion 63*d*3) is higher in relative dielectric constant than a portion of the transport electrode overcoating layer 63*d* in the counter area CA (low relative dielectric constant portion 63*d*1). Accordingly, the strength of a component of the electric field generated by the transport wiring substrate 63, the component acting in the direction from the toner transport surface TTS toward the counter wiring substrate surface CS (the y-direction in FIG. 12; i.e., the upward direction in FIG. 12), becomes lower in the downstream area TDA than in the counter area CA.

Referring to FIG. 11, the toner T which has passed the counter area CA is transported from the central component portion 62*a* toward the downstream component portion 62*c*. Then, the toner T drops from the downstream component portion 62*c* and thus returns to a bottom portion of the toner box 61.

<Actions and Effects of Configuration of First Embodiment>

Referring to FIGS. 11 and 12, in the configuration of the present embodiment, the relative dielectric constant of the transport electrode overcoating layer 63*d* is higher in an area (upstream area TUA) located upstream of and an area (downstream area TDA) located downstream of the counter area CA with respect to the toner transport direction TTD than in the counter area CA. In other words, the relative dielectric constant of the transport electrode overcoating layer 63*d* is lower in the counter area CA than in the area (upstream area TUA) located upstream of and the area (downstream area TDA) located downstream of the counter area CA with respect to the toner transport direction TTD.

Thus, when traveling wave transport voltages are applied to the transport electrodes 63*a*, as mentioned above, the electric field strength in a space in the vicinity of the toner transport surface TTS is lower in the upstream area TUA and the downstream area TDA than in the counter area CA. In other words, the electric field strength in the space in the vicinity of the toner transport surface TTS is higher in the counter area CA than in the upstream area TUA and the downstream area TDA. Further, the electric field strength becomes the maximum in the counter area CA.

According to the above-mentioned configuration, the toner T can be efficiently supplied to the developing position DP. Further, in the counter area CA located near the developing position DP, the toner T can fly vigorously toward the latent image forming surface LS.

Thus, the electrostatic latent image LI can be satisfactorily developed. That is, selective adhesion of the toner T to the latent image forming surface LS in accordance with the pattern of positive charges in the electrostatic latent image LI can be performed with good responsiveness. Further, a required image density (an adhering amount of the toner T required to impart a predetermined density to a single dot) can surely be obtained.

In the above-described configuration, the upstream high relative dielectric constant portion 63*c*2 and the downstream high relative dielectric constant portion 63*c*3 are provided such that they reach positions near the opening edges of the toner passage hole 61*a*1. By virtue of this configuration, the electric field strength on the toner transport surface TTS is lowered near the opening edges of the toner passage hole 61*a*1.

Therefore, undesired jetting of the toner T to the outside of the toner box 61 at locations near the opening edges of the toner passage hole 61*a*1 can be effectively suppressed. That is, leakage of the toner T from the toner passage hole 61*a*1 can be restrained.

Accordingly, adhesion of the toner T to a white background portion (where pixels in the toner T are not formed) of the latent image forming surface LS of the photoconductor drum 3; i.e., "white-background fogging," can be effectively suppressed.

Referring to FIGS. 11 and 12, in the configuration of the present embodiment, the relative dielectric constant of the counter electrode overcoating layer 65*d* is higher in an area (upstream area CUA) located upstream of and an area (downstream area CDA) located downstream of the counter area neighboring area CNA with respect to the toner transport direction TTD than in the counter area neighboring area CNA. In other words, the relative dielectric constant of the counter electrode overcoating layer 65*d* is lower in the counter area neighboring area CNA than in the area (upstream area CUA) located upstream of and the area (downstream area CDA) located downstream of the counter area neighboring area CNA with respect to the toner transport direction TTD.

Thus, when traveling wave transport voltages are applied to the counter electrodes 65*a*, as mentioned above, electric field strength in a space in the vicinity of the toner transport surface TTS is lower in the upstream area CUA and the downstream area CDA than in the counter area neighboring area CNA. In other words, the electric field strength in the space in the vicinity of the toner transport surface TTS is higher in the counter area neighboring area CNA than in the upstream area CUA and the downstream area CDA.

According to the above-mentioned configuration, the strength of the electric field which is generated by the counter wring substrate 65 and travels along the toner transport direction TTD becomes higher in the counter area neighboring area CNA. Thus, supply of the toner T to the counter are CA can be performed satisfactorily.

Further, the strength of a component of the electric field generated by the counter wring substrate 65, the component corresponding to a direction from the counter wiring substrate surface CS toward the toner transport surface TTS, becomes higher in the counter area neighboring area CNA. Thus, in the vicinity of the opening edges of the toner passage hole 61*a*1, the toner T is pressed, by a relatively strong force, in the direction from the counter wiring substrate surface CS toward the toner transport surface TTS.

Therefore, according to the above-mentioned configuration, undesired jetting of the toner T to the outside of the toner box 61 at locations near the opening edges of the toner passage hole 61*a*1 can be effectively suppressed. Thus, the above-described "white-background fogging" can be effectively suppressed.

Referring to FIGS. 11 and 12, in the configuration of the present embodiment, the counter area neighboring areas CNA (low relative dielectric constant portions 65*d*1) are respectively provided upstream of and downstream of the counter area CA (low relative dielectric constant portion 63*d*1) with respect to the toner transport direction TTD. That is, the counter area CA (low relative dielectric constant portion 63*d*1) is provided between the counter area neighboring area CNA (low relative dielectric constant portions 65*d*1) located upstream of the toner passage hole 61*a*1 with respect to the toner transport direction TTD and the counter area neighboring area CNA (low relative dielectric constant portions 65*d*1) located downstream of the toner passage hole 61*a*1 with respect to the toner transport direction TTD.

Thus, a region where the toner transport surface TTS of the toner electric field transport body 62 (central component portion 62*a*) and the counter wiring substrate surface CS of the counter wiring substrate 65 face each other with a predetermined gap therebetween is configured as follows.

(a) An area where the upstream area CUA (upstream high relative dielectric constant portion 65*d*2) of the counter wiring substrate 65 and the upstream area TUA (upstream high relative dielectric constant portion 63*d*2) of the toner electric field transport body 62 face each other, (b) an area where the counter area neighboring area CNA (low relative dielectric constant portion 65*d*1) of the counter wiring substrate 65 and the upstream area TUA (upstream high relative dielectric constant portion 63*d*2) of the toner electric field transport body 62 face each other, (c) an area where the toner passage hole 61*a*1 and the counter area CA (low relative dielectric constant portion 63*d*1) of the toner electric field transport body 62 face each other, (d) an area where the counter area neighboring area CNA (low relative dielectric constant portion 65*d*1) of the counter wiring substrate 65 and the downstream area TDA (downstream high relative dielectric constant portion 63$d$3) of the toner electric field transport body 62 face each other, and (e) an area where the downstream area CDA (downstream high relative dielectric constant portion 65$d$3) of the counter wiring substrate 65 and the downstream area TDA (downstream high relative dielectric constant portion 63$d$3) of the toner electric field transport body 62 face each other, can be arrayed in this order along the toner transport direction TTD.

In the above-mentioned configuration, electric field strength increases in the order of (a), (b), and (c). Also, electric field strength decreases in the order of (c), (d), and (e).

In the above-mentioned configuration, the toner T can be smoothly accelerated in the course of transport from (a) to (b) and then toward (c). Also, the toner T can be smoothly decelerated in the course of transport from (c) to (d) and then toward (e).

Thus, it becomes possible to effectively prevent the toner T from stagnating at a specific location or becoming very thin (decreasing in amount) locally, which would otherwise occur due to local slowdown of the flow of the toner T. Thus, transport of the toner T along the toner transport direction TTD can be performed smoothly.

<Second Embodiment of Toner Supply Apparatus>

The configuration of a second embodiment will be described with reference to FIG. 19.

In the following description of the second embodiment, members similar in structure and function to those used in the above-described embodiment can be denoted by the same reference numerals as those of the above-described embodiment. As for the description of these members, an associated description appearing in the description of the above embodiment can be cited, so long as no technical inconsistencies are involved (the same convention also applies to the third and subsequent embodiments to be described later).

Figure 19:
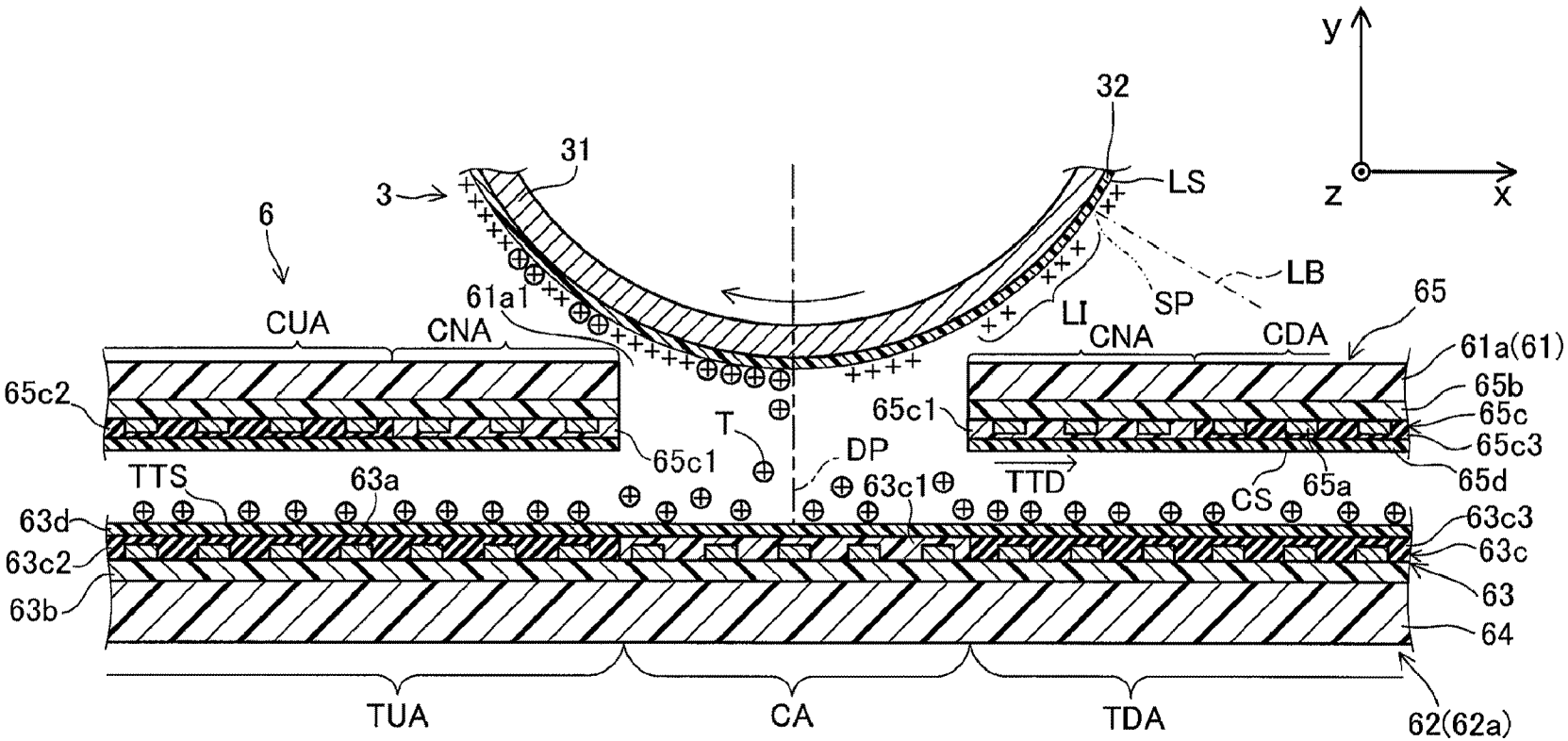
FIG. 19 is a side sectional view showing, on an enlarged scale, a region around the developing position in a second embodiment of the toner supply apparatus shown in FIG. 11.

FIG. 19 is a side sectional view showing, on an enlarged scale, the periphery of the developing position DP in the second embodiment of the toner supply apparatus 6 shown in FIG. 11.

Referring to FIG. 19, in the present embodiment, in place of the transport electrode overcoating layer 63$d$, the transport electrode coating layer 63$c$ includes a low relative dielectric constant portion 63$c$1, an upstream high relative dielectric constant portion 63$c$2, and a downstream high relative dielectric constant portion 63$c$3.

The low relative dielectric constant portion 63$c$1 is provided at a position corresponding to the counter area CA. The upstream high relative dielectric constant portion 63$c$2 is provided at a position corresponding to the upstream area TUA. The downstream high relative dielectric constant portion 63$c$3 is provided at a position corresponding to the downstream area TDA.

The upstream high relative dielectric constant portion 63$c$2 is formed of a material higher in relative dielectric constant than the low relative dielectric constant portion 63$c$1. The downstream high relative dielectric constant portion 63$c$3 is formed of a material higher in relative dielectric constant than the low relative dielectric constant portion 63$c$1. That is, the transport electrode coating layer 63$c$ is formed such that the upstream area TUA and the downstream area TDA are higher in relative dielectric constant than the counter area CA.

Also, in the present embodiment, in place of the counter electrode overcoating layer 65$d$, the counter electrode coating layer 65$c$ includes a low relative dielectric constant portion 65$c$1, an upstream high relative dielectric constant portion 65$c$2, and a downstream high relative dielectric constant portion 65$c$3.

The low relative dielectric constant portion 65$c$1 is provided at a position corresponding to the counter area neighboring area CNA. The upstream high relative dielectric constant portion 65$c$2 is provided at a position corresponding to the upstream area CUA. The downstream high relative dielectric constant portion 65$c$3 is provided at a position corresponding to the downstream area CDA.

The upstream high relative dielectric constant portion 65$c$2 is formed of a material higher in relative dielectric constant than the counter area neighboring area CNA. The downstream high relative dielectric constant portion 65$c$3 is formed of a material higher in relative dielectric constant than the counter area neighboring area CNA. That is, the counter electrode overcoating layer 65$c$ is formed such that the upstream area CUA and the downstream area CDA are higher in relative dielectric constant than the counter area neighboring area CNA.

Even the above-mentioned configuration yields actions and effects similar to those which the above-described first embodiment yields.

<Third Embodiment of Toner Supply Apparatus>

The configuration of a third embodiment will be described with reference to FIG. 20.

Figure 20:
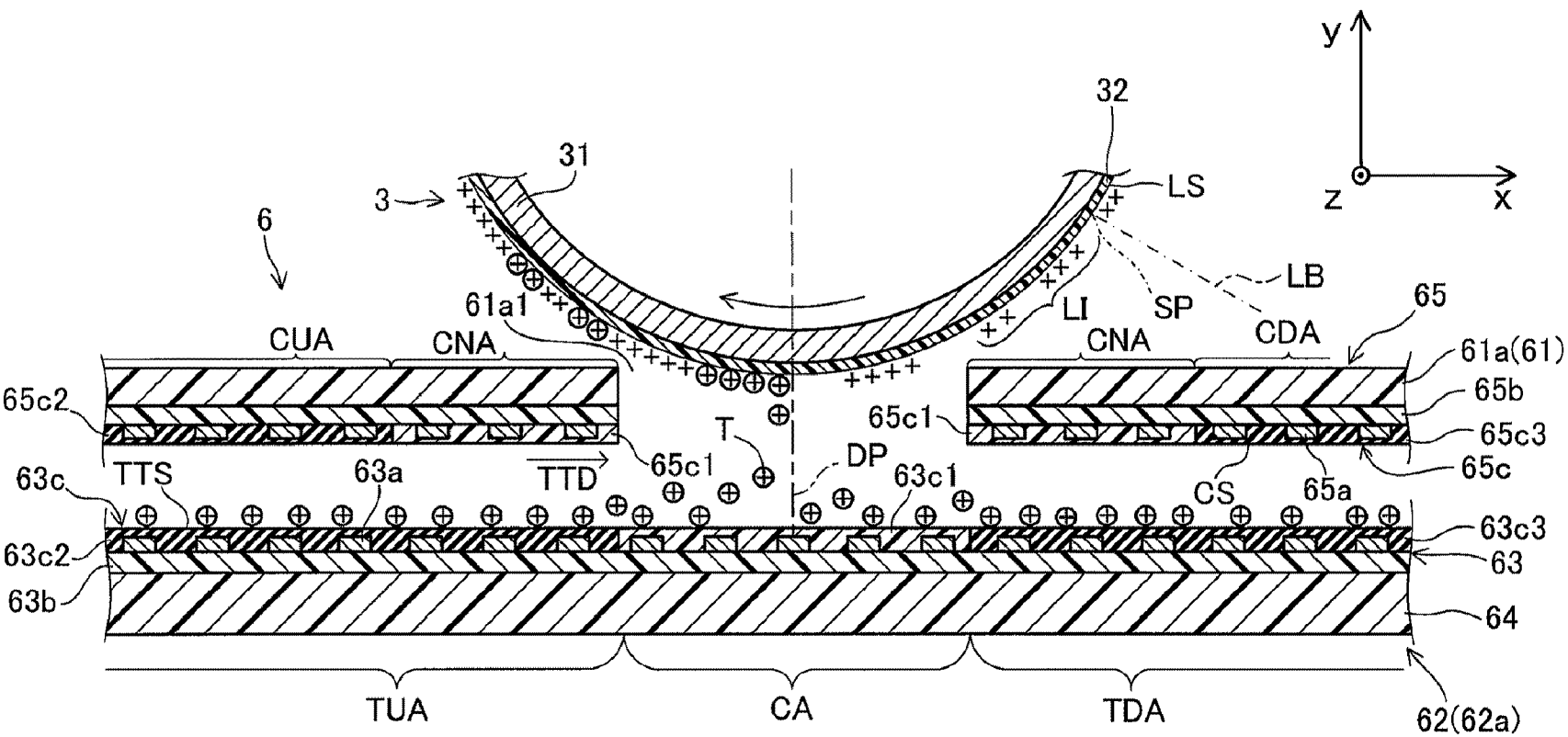
FIG. 20 is a side sectional view showing, on an enlarged scale, a region around the developing position in a third embodiment of the toner supply apparatus shown in FIG. 11.

FIG. 20 is a side sectional view showing, on an enlarged scale, the periphery of the developing position DP in the third embodiment of the toner supply apparatus 6 shown in FIG. 11.

Referring to FIG. 20, in the present embodiment, the transport electrode overcoating layer 63$d$ (see FIG. 19) employed in the configuration of the above-described second embodiment is eliminated. That is, in the present embodiment, the transport electrode coating layer 63$c$ serves as the transport electrode cover member of the present invention.

Also, in the present embodiment, the counter electrode overcoating layer 65$d$ (see FIG. 19) employed in the configuration of the above-described second embodiment is eliminated. That is, in the present embodiment, the counter electrode coating layer 65$c$ serves as the counter electrode cover member of the present invention.

Even the above-mentioned configuration yields actions and effects similar to those which the above-described embodiments yield.

<Fourth Embodiment of Toner Supply Apparatus>

The configuration of a fourth embodiment will be described with reference to FIG. 21.

Figure 21:
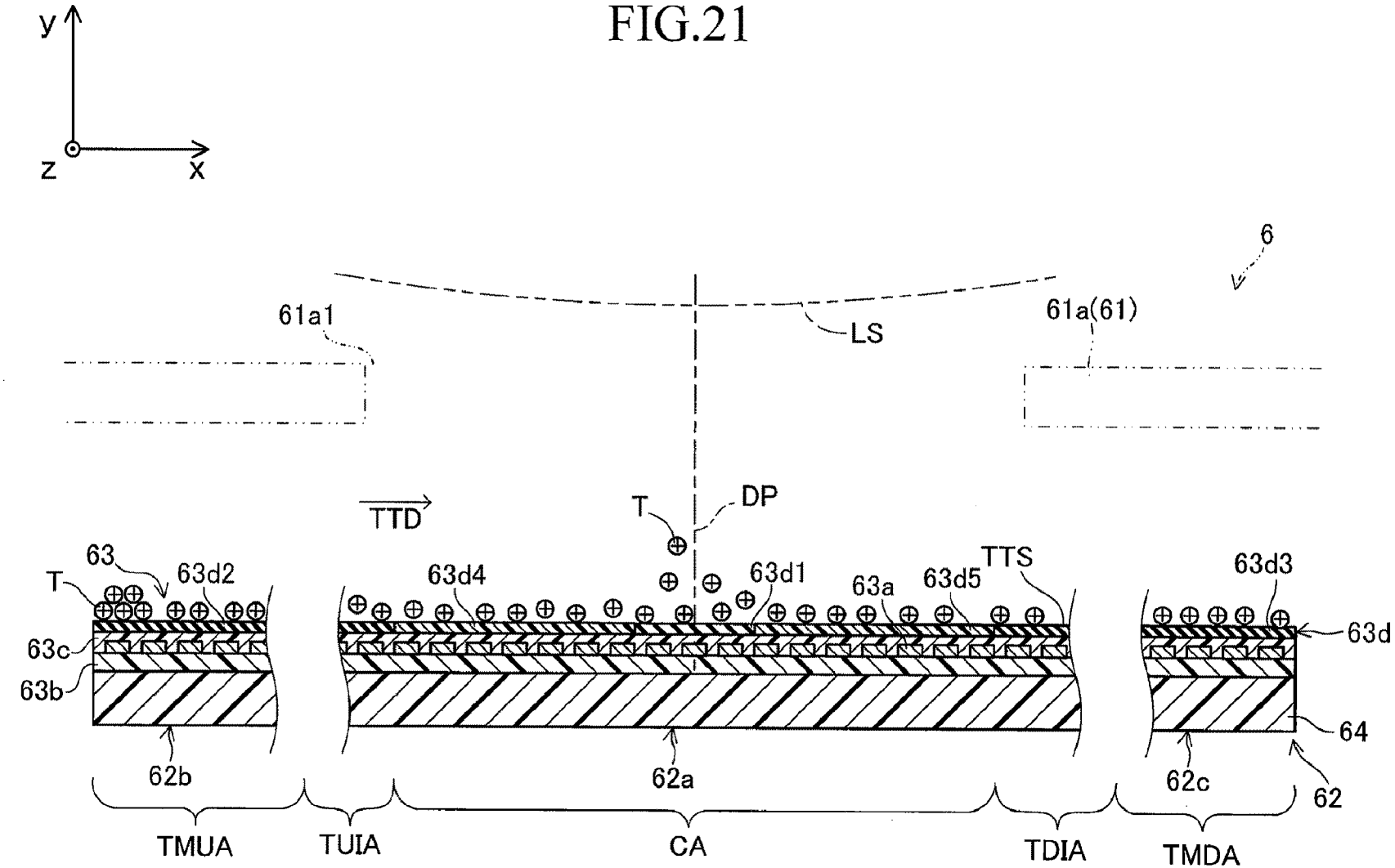
FIG. 21 is a side sectional view showing, on an enlarged scale, a transport wiring substrate in a fourth embodiment of the toner supply apparatus shown in FIG. 11.

FIG. 21 is a side sectional view showing, on an enlarged scale, the transport wiring substrate 63 in the fourth embodiment of the toner supply apparatus 6 shown in FIG. 11.

In FIG. 21, for convenience of explanation, illustration of portions of the transport wiring substrate 63 is omitted, and the transport wiring substrate 63 is illustrated such that the central component portion 62$a$, the upstream component portion 62$b$, and the downstream component portion 62$c$ are arrayed straight (the same convention also applies to FIG. 22 to FIG. 28).

Referring to FIG. 21, the transport electrode overcoating layer 63$d$ of the present embodiment includes the low relative dielectric constant portion 63$d$1, the upstream high relative dielectric constant portion 63$d$2, the downstream high relative dielectric constant portion 63$d$3, an upstream intermediate relative dielectric constant portion 63$d$4, and a downstream intermediate relative dielectric constant portion 63$d$5.

The low relative dielectric constant portion 63$d$1 is provided in a portion of the counter area CA very close to the developing position DP.

The upstream intermediate relative dielectric constant portion 63$d$4 is provided upstream of the low relative dielectric constant portion 63*d*1 with respect to the toner transport direction TTD. The upstream end of the upstream intermediate relative dielectric constant portion 63*d*4 with respect to the toner transport direction TTD is provided in the counter area CA. The upstream intermediate relative dielectric constant portion 63*d*4 is formed of a material higher in relative dielectric constant than the low relative dielectric constant portion 63*d*1.

The upstream high relative dielectric constant portion 63*d*2 is provided upstream of the upstream intermediate relative dielectric constant portion 63*d*4 with respect to the toner transport direction TTD. The upstream high relative dielectric constant portion 63*d*2 is formed of a material higher in relative dielectric constant than the upstream intermediate relative dielectric constant portion 63*d*4.

The upstream high relative dielectric constant portion 63*d*2 is provided to cover a most upstream area TMUA and an upstream intermediate area TUIA.

The most upstream area TMUA is an area of the toner electric field transport body 62 located most upstream with respect to the toner transport direction TTD. That is, the most upstream area TMUA corresponds to a portion of the upstream component portion 62*b* which is located most upstream with respect to the toner transport direction TTD. The upstream intermediate area TUIA is an area of the toner electric field transport body 62 located between the most upstream area TMUA and the counter area CA.

Further, the downstream end of the upstream high relative dielectric constant portion 63*d*2 with respect to the toner transport direction TTD is provided within the counter area CA.

The downstream intermediate relative dielectric constant portion 63*d*5 is provided downstream of the low relative dielectric constant portion 63*d*1 with respect to the toner transport direction TTD. The downstream end of the downstream intermediate relative dielectric constant portion 63*d*5 with respect to the toner transport direction TTD is provided in the counter area CA. The downstream intermediate relative dielectric constant portion 63*d*5 is formed of a material higher in relative dielectric constant than the low relative dielectric constant portion 63*d*1.

The downstream high relative dielectric constant portion 63*d*3 is provided downstream of the downstream intermediate relative dielectric constant portion 63*d*5 with respect to the toner transport direction TTD. The downstream high relative dielectric constant portion 63*d*3 is formed of a material higher in relative dielectric constant than the downstream intermediate relative dielectric constant portion 63*d*5.

The downstream high relative dielectric constant portion 63*d*3 is provided to cover a most downstream area TMDA and a downstream intermediate area TDIA.

The most downstream area TMDA is an area of the toner electric field transport body 62 located most downstream with respect to the toner transport direction TTD. That is, the most downstream area TMDA corresponds to a portion of the downstream component portion 62*c* which is located most downstream with respect to the toner transport direction TTD. The downstream intermediate area TDIA is an area of the toner electric field transport body 62 located between the most downstream area TMDA and the counter area CA.

Further, the upstream end of the downstream high relative dielectric constant portion 63*d*3 with respect to the toner transport direction TTD is provided within the counter area CA.

That is, the transport electrode overcoating layer 63*d* is configured such that relative dielectric constant decreases gradually from the most upstream area TMUA toward the developing position DP. Further, the transport electrode overcoating layer 63*d* is configured such that relative dielectric constant increases gradually from the developing position DP toward the most downstream area TMDA.

Moreover, the toner box 61 and the toner electric field transport body 62 (transport wiring substrate 63) are configured and disposed in such a manner that the opening edges of the toner passage hole 61*a*1 are located at positions corresponding to the upstream high relative dielectric constant portion 63*d*2 and the downstream high relative dielectric constant portion 63*d*3, respectively.

According to the toner electric field transport body 62 (transport wiring substrate 63) of the present embodiment having the above-described configuration, the electric field strength increases gradually from the most upstream area TMUA toward the developing position DP.

Therefore, the toner T is smoothly accelerated when it is transported from the most upstream area TMUA toward the developing position DP. Thus, the toner T can be supplied satisfactorily toward the developing position DP.

Further, according to the toner electric field transport body 62 (transport wiring substrate 63) of the present embodiment having the above-described configuration, the electric field strength decreases gradually from the developing position DP toward the most downstream area TMDA.

Therefore, when the toner T which has passed the developing position DP is ejected from the developing position DP toward the bottom portion of the toner box 61 via the most downstream area TMDA, stagnation of the toner T at a specific location can be effectively prevented, which stagnation would otherwise occur due to local slowdown of the flow of the toner T. Thus, discharge of the toner T from the developing position DP toward the bottom portion of the toner box 61 via the most downstream area TMDA can be performed smoothly.

According to the present embodiment having the above-described configuration, in an area inside the toner passage hole 61*a*1, the electric field strength can be made the lowest at the opening edges of the toner passage hole 61*a*1. Further, the electric field strength can be made the highest in an area very close to the developing position DP.

Accordingly, it becomes possible to cause the toner T to fly vigorously toward the latent image forming surface LS in an area very close to the developing position DP, while suppressing undesired leakage of the toner T at the opening edges of the toner passage hole 61*a*1. Thus, it becomes possible to obtain a required image density, while suppressing "white-background fogging."

<Fifth Embodiment of Toner Supply Apparatus>

The configuration of a fifth embodiment will now be described with reference to FIG. 22.

Figure 22:
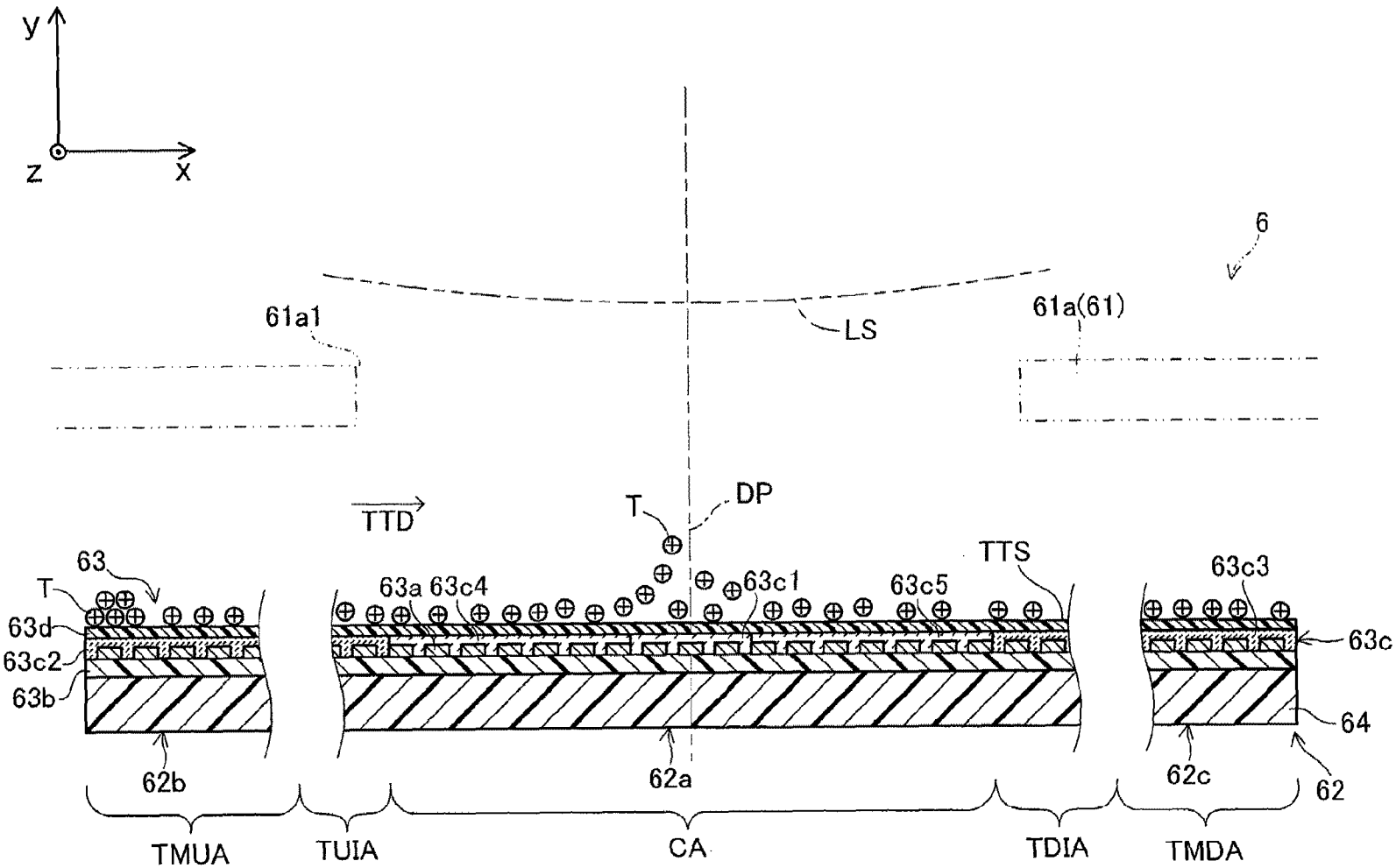
FIG. 22 is a side sectional view showing, on an enlarged scale, a transport wiring substrate in a fifth embodiment of the toner supply apparatus shown in FIG. 11.

FIG. 22 is a side sectional view showing, on an enlarged scale, the transport wiring substrate 63 in the fifth embodiment of the toner supply apparatus 6 shown in FIG. 11.

Referring to FIG. 22, in the present embodiment, in place of the transport electrode overcoating layer 63*d* in FIG. 21, the transport electrode coating layer 63*c* includes a low relative dielectric constant portion 63*c*1, an upstream high relative dielectric constant portion 63*c*2, a downstream high relative dielectric constant portion 63*c*3, an upstream intermediate relative dielectric constant portion 63*c*4, and a downstream intermediate relative dielectric constant portion 63*c*5.

Even the above-mentioned configuration yields actions and effects similar to those which the above-described fourth embodiment yields.

<Sixth Embodiment of Toner Supply Apparatus>

The configuration of a sixth embodiment will now be described with reference to FIG. 23.

Figure 23:
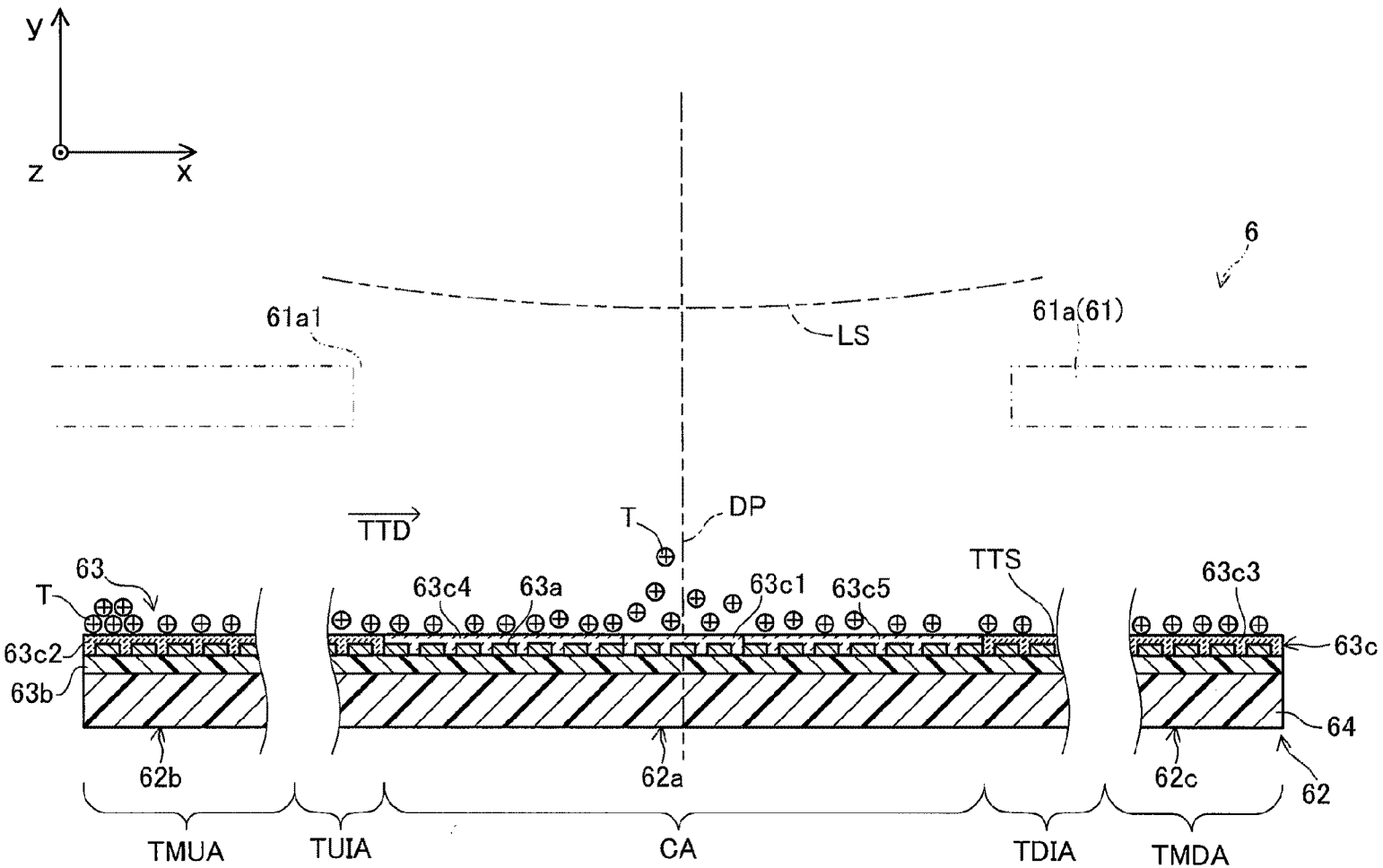
FIG. 23 is a side sectional view showing, on an enlarged scale, a transport wiring substrate in a sixth embodiment of the toner supply apparatus shown in FIG. 11.

FIG. 23 is a side sectional view showing, on an enlarged scale, the transport wiring substrate 63 in the sixth embodiment of the toner supply apparatus 6 shown in FIG. 11.

Referring to FIG. 23, in the present embodiment, the transport electrode overcoating layer 63*d* (see FIG. 22) employed in the structure of the fifth embodiment is omitted. That is, in the present embodiment, the transport electrode coating layer 63*c* serves as the transport electrode cover member of the present invention.

Even the above-mentioned configuration yields actions and effects similar to those which the above-described fourth and fifth embodiments yield.

<Seventh Embodiment of Toner Supply Apparatus>

The configuration of a seventh embodiment of the present invention will be described with reference to FIG. 24.

Figure 24:
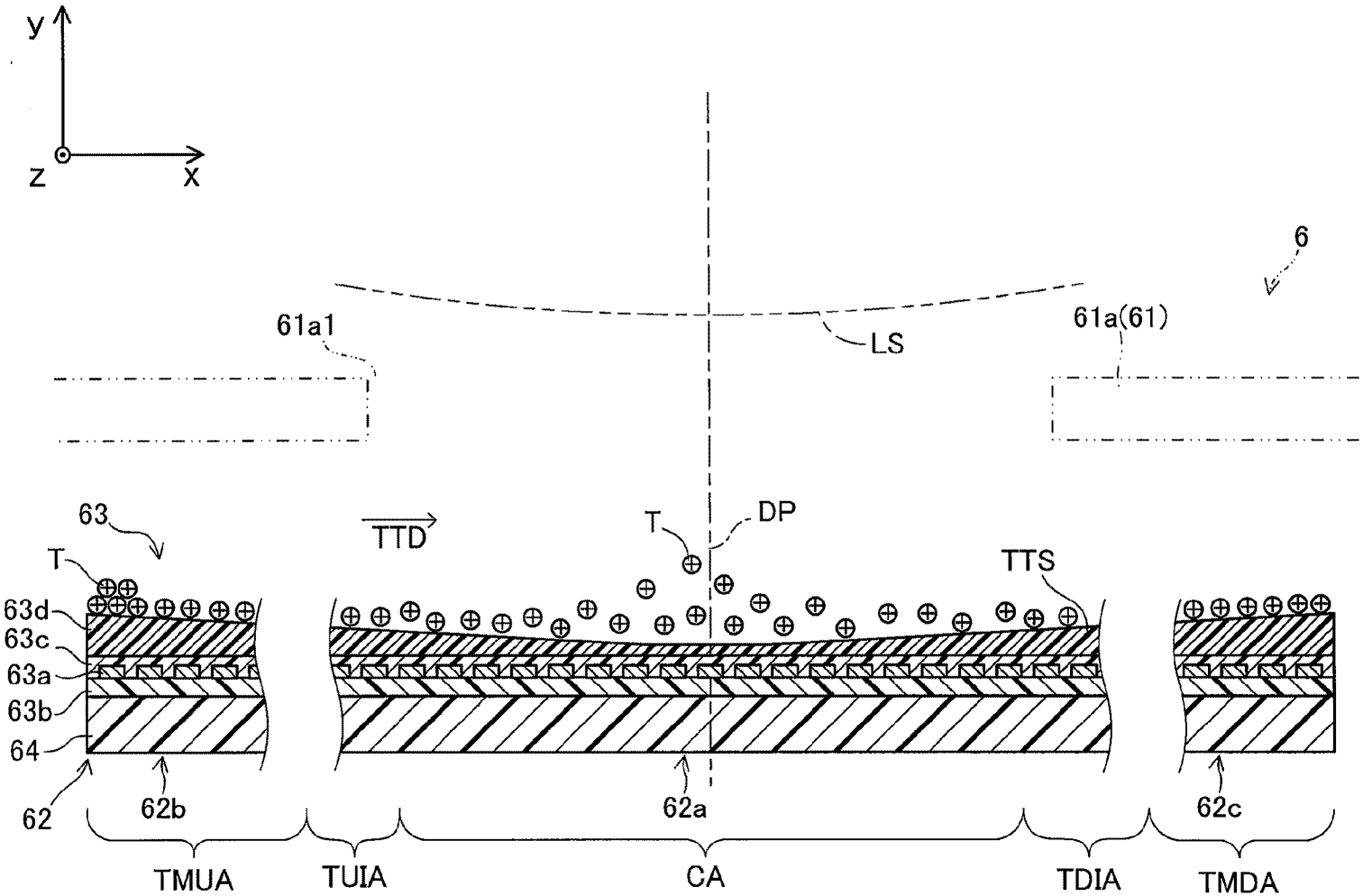
FIG. 24 is a side sectional view showing, on an enlarged scale, a transport wiring substrate in a seventh embodiment of the toner supply apparatus shown in FIG. 11.

FIG. 24 is a side sectional view showing, on an enlarged scale, the transport wiring substrate 63 in the seventh embodiment of the toner supply apparatus 6 shown in FIG. 11.

Referring to FIG. 24, in the present embodiment, the transport electrode overcoating layer 63*d* is configured such that its thickness decreases in the direction from the most upstream area TMUA to the upstream intermediate area TUIA and then toward the counter area CA. Also, the transport electrode overcoating layer 63*d* is configured such that its thickness increases in the direction from the counter area CA to the downstream intermediate area TDIA and then toward the most downstream area TMDA.

According to the above-mentioned configuration, the electric field strength on the toner transport surface TTS gradually increases in the direction from the most upstream area TMUA to the upstream intermediate area TUIA and then toward the counter area CA. Also, the electric field strength on the toner transport surface TTS gradually decreases in the direction from the counter area CA to the downstream intermediate area TDIA and then toward the most downstream area TMDA.

According to the above-described configuration, the electric field strength on the toner transport surface TTS gradually varies in the toner transport direction TTD. Thus, actions and effects similar to those of the above-described fourth to sixth embodiments can be attained.

<Eighth Embodiment of Toner Supply Apparatus>

The configuration of an eighth embodiment will be described with reference to FIG. 25.

Figure 25:
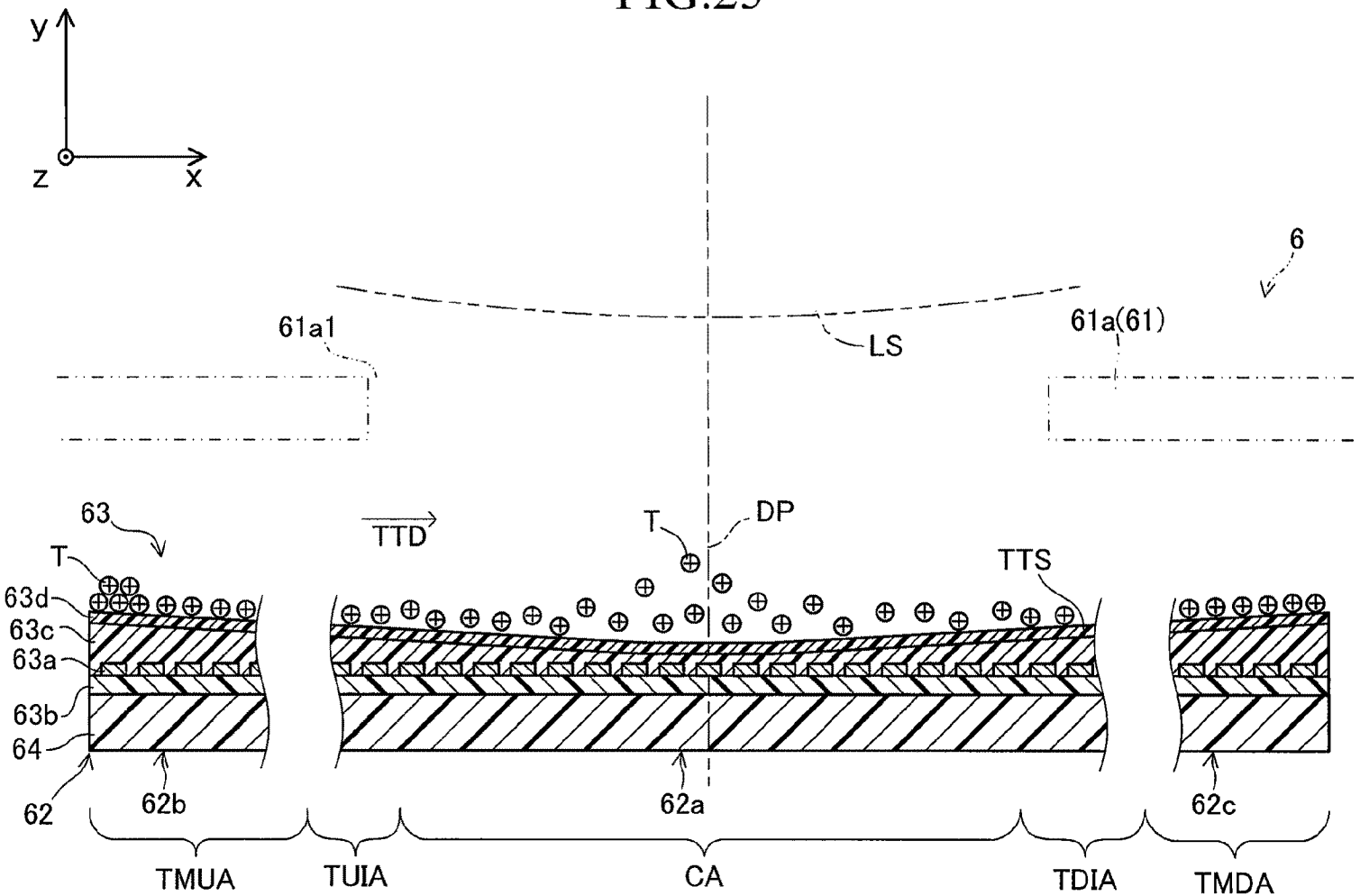
FIG. 25 is a side sectional view showing, on an enlarged scale, a transport wiring substrate in an eighth embodiment of the toner supply apparatus shown in FIG. 11.

FIG. 25 is a side sectional view showing, on an enlarged scale, the transport wiring substrate 63 in the eighth embodiment of the toner supply apparatus 6 shown in FIG. 11.

Referring to FIG. 25, in the present embodiment, in place of the transport electrode overcoating layer 63*d* in FIG. 24, the transport electrode coating layer 63*c* is configured such that its thickness gradually varies in the toner transport direction TTD.

Specifically, the transport electrode coating layer 63*c* is configured such that its thickness decreases in the direction from the most upstream area TMUA to the upstream intermediate area TUIA and then toward the counter area CA. Also, the transport electrode coating layer 63*c* is configured such that its thickness increases in the direction from the counter area CA to the downstream intermediate area TDIA and then toward the most downstream area TMDA.

According to the above-mentioned configuration, similar to the above-described seventh embodiment, electric field strength on the toner transport surface TTS and that on the counter wiring substrate surface CS gradually varies in the toner transport direction TTD. Thus, actions and effects similar to those of the above-described seventh embodiment can be attained.

<Ninth Embodiment of Toner Supply Apparatus>

The configuration of a ninth embodiment will be described with reference to FIG. 26.

Figure 26:
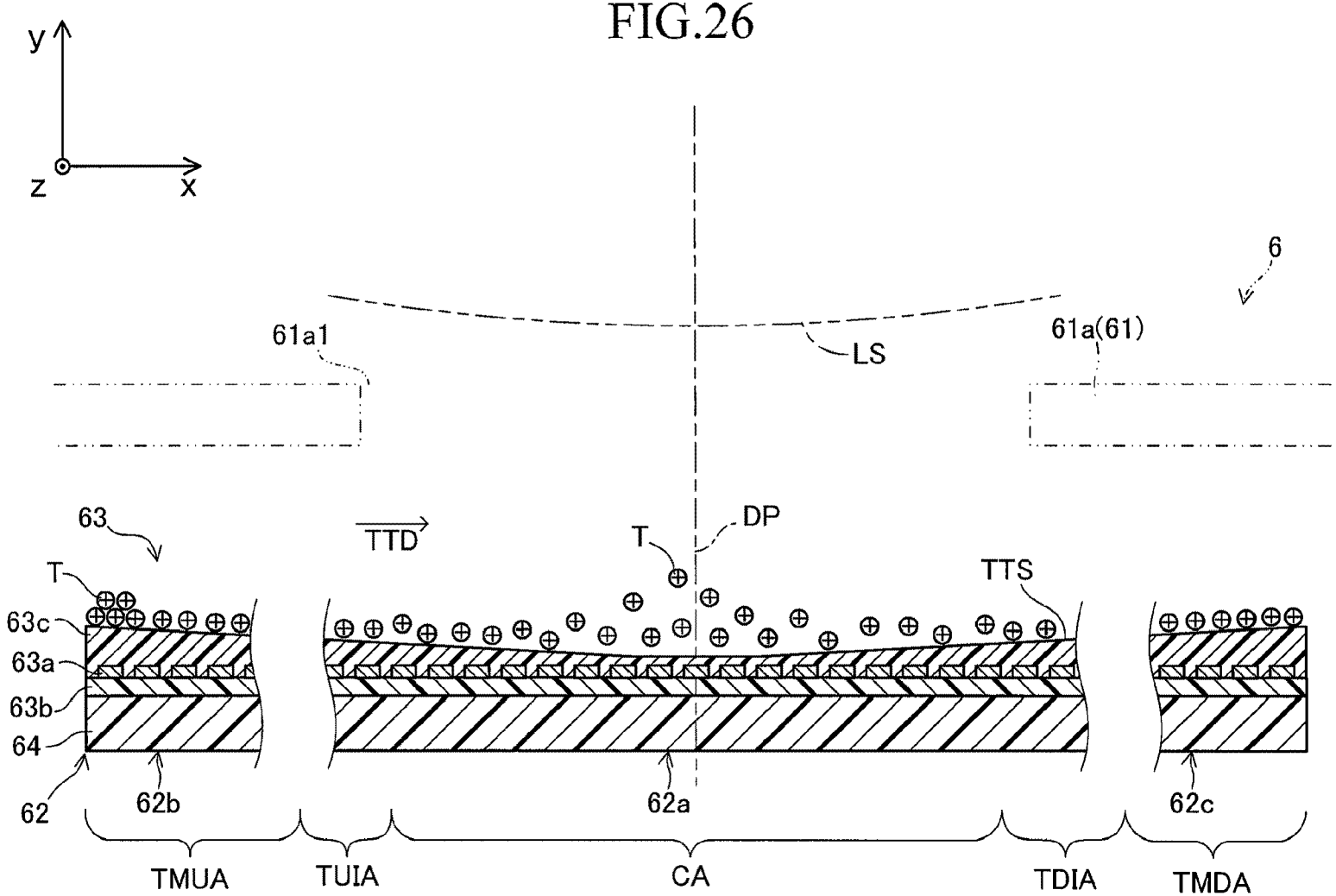
FIG. 26 is a side sectional view showing, on an enlarged scale, a transport wiring substrate in a ninth embodiment of the toner supply apparatus shown in FIG. 11.

FIG. 26 is a side sectional view showing, on an enlarged scale, the transport wiring substrate 63 in the ninth embodiment of the toner supply apparatus 6 shown in FIG. 11.

Referring to FIG. 26, in the present embodiment, the transport electrode overcoating layer 63*d* (see FIG. 25) employed in the configuration of the above-described eighth embodiment is eliminated. That is, in the present embodiment, the transport electrode coating layer 63*c* serves as the transport electrode cover member of the present invention.

Even the above-mentioned configuration yields actions and effects similar to those which the above-described eighth embodiment yields.

<Tenth Embodiment of Toner Supply Apparatus>

The configuration of a tenth embodiment will be described with reference to FIG. 27.

Figure 27:
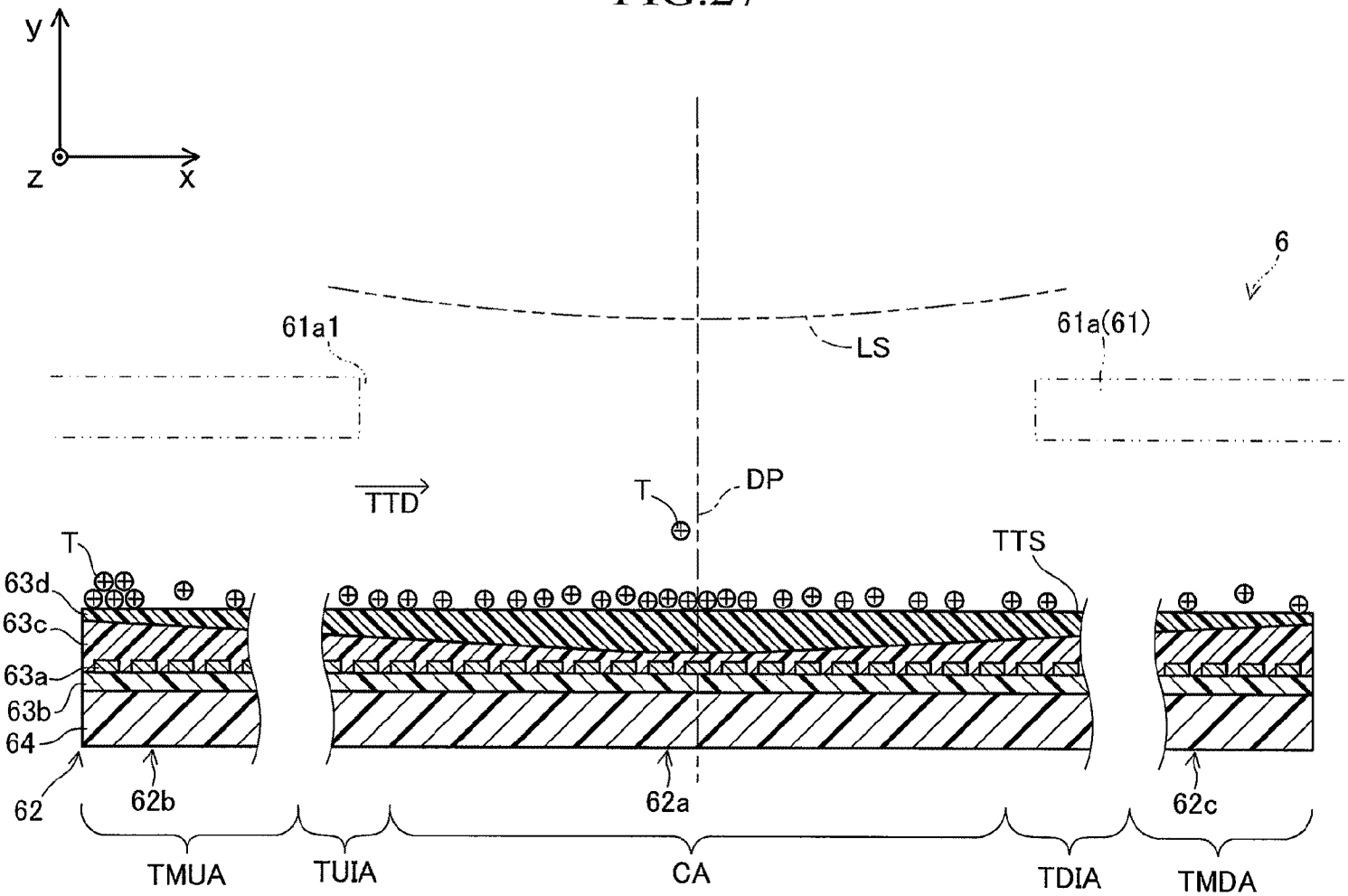
FIG. 27 is a side sectional view showing, on an enlarged scale, a transport wiring substrate in a tenth embodiment of the toner supply apparatus shown in FIG. 11.

FIG. 27 is a side sectional view showing, on an enlarged scale, the transport wiring substrate 63 in the tenth embodiment of the toner supply apparatus 6 shown in FIG. 11.

Referring to FIG. 27, in the present embodiment, the transport electrode coating layer 63*c* is formed thicker in those areas which are located upstream of and downstream of the counter area CA with respect to the toner transport direction TTD, than in the counter area CA.

That is, the transport electrode coating layer 63*c* is configured such that its thickness gradually decreases in the direction from the most upstream area TMUA to the upstream intermediate area TUIA and then toward the counter area CA. Also, the transport electrode coating layer 63*c* is configured such that its thickness gradually increases in the direction from the counter area CA to the downstream intermediate area TDIA and then toward the most downstream area TMDA.

Also, the transport electrode overcoating layer 63*d* is formed thinner in those areas which are located upstream of and downstream of the counter area CA with respect to the toner transport direction TTD, than in the counter area CA.

That is, the transport electrode overcoating layer 63*d* is configured such that its thickness gradually increases in the direction from the most upstream area TMUA to the upstream intermediate area TUIA and then toward the counter area CA. Also, the transport electrode overcoating layer 63*d* is configured such that its thickness gradually decreases in the direction from the counter area CA to the downstream intermediate area TDIA and then toward the most downstream area TMDA.

A laminate of the transport electrode coating later 63*c* and the transport electrode overcoating layer 63*d* is formed into the form of a flat plate so as to have a substantially fixed thickness. Furthermore, the transport electrode overcoating layer 63*d* is formed of a material whose relative dielectric constant is lower than that of the transport electrode coating layer 63*c*.

In the toner electric field transport body 62 (transport wiring substrate 63) of the present embodiment having the above-mentioned configuration, the (combined) relative dielectric constant of the laminate of the transport electrode overcoating layer 63*d* and the transport electrode coating layer 63*c* is higher in those areas which are located upstream of and downstream of the counter area CA with respect to the toner transport direction TTD, than in the counter area CA.

That is, the relative dielectric constant of the laminate gradually decreases in the direction from the most upstream area TMUA to the upstream intermediate area TUIA and then toward the counter area CA. Also, the relative dielectric constant of the laminate gradually increases in the direction from the counter area CA to the downstream intermediate area TDIA and then toward the most downstream area TMDA.

Thus, when traveling wave voltages are applied to the transport electrodes 63*a*, electric field strength is higher in the counter area CA than in the upstream and downstream areas with respect to the toner transport direction TTD.

That is, the electric field strength gradually increases in the direction from the most upstream area TMUA to the upstream intermediate area TUIA and then toward the counter area CA. Also, the electric field strength gradually decreases in the direction from the counter area CA to the downstream intermediate area TDIA and then toward the most downstream area TMDA.

The above-mentioned configuration yields actions and effects similar to those which the above-described embodiments yield.

<Eleventh Embodiment of Toner Supply Apparatus>

The configuration of an eleventh embodiment will be described with reference to FIG. 28.

Figure 28:
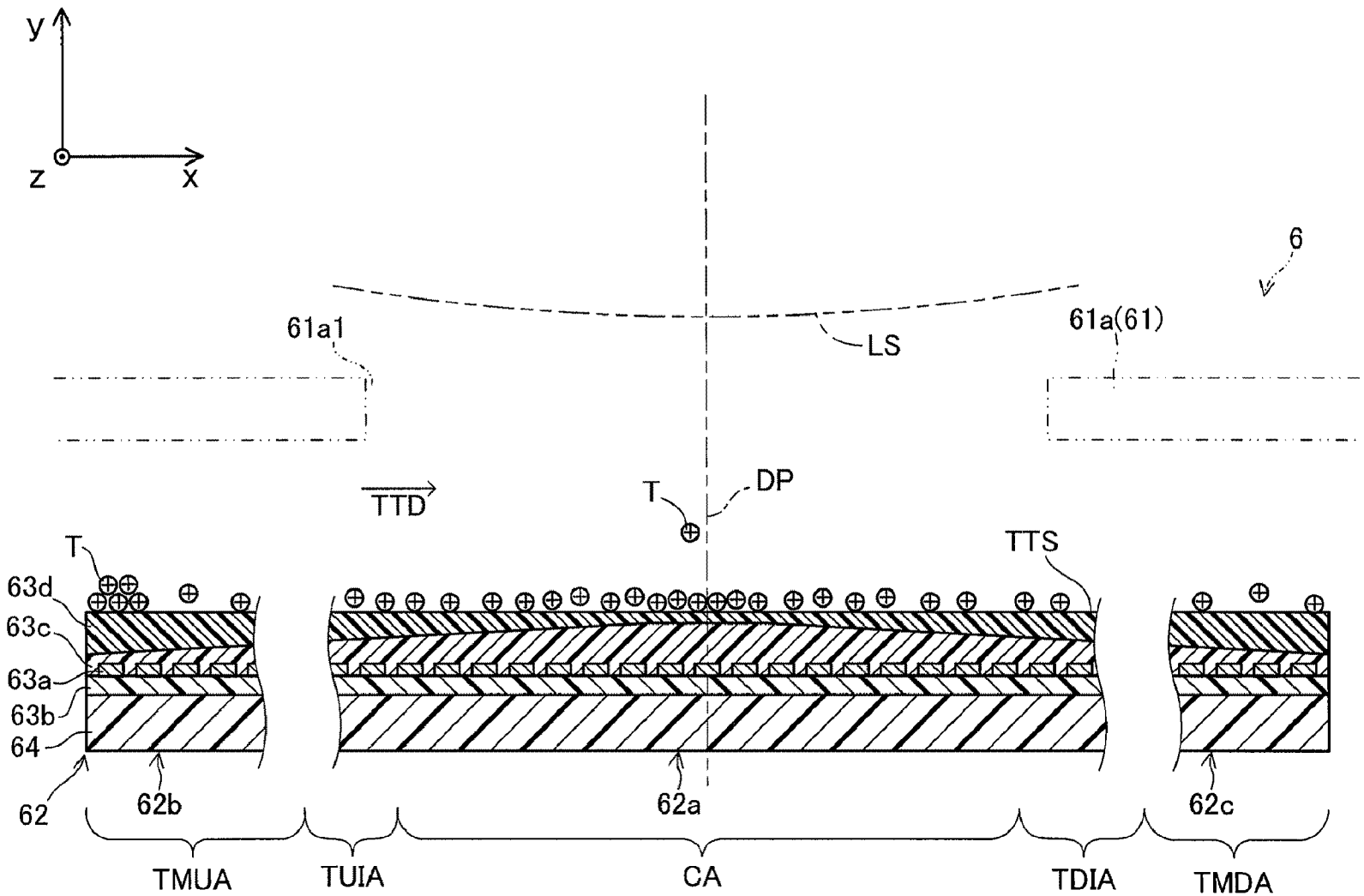
FIG. 28 is a side sectional view showing, on an enlarged scale, a transport wiring substrate in an eleventh embodiment of the toner supply apparatus shown in FIG. 11.

FIG. 28 is a side sectional view showing, on an enlarged scale, the transport wiring substrate 63 in the eleventh embodiment of the toner supply apparatus 6 shown in FIG. 11.

Referring to FIG. 28, in the present embodiment, the transport electrode coating layer 63*c* is formed thinner in those areas which are located upstream of and downstream of the counter area CA with respect to the toner transport direction TTD, than in the counter area CA.

That is, the transport electrode coating layer 63*c* is configured such that its thickness gradually increases in the direction from the most upstream area TMUA to the upstream intermediate area TUIA and then toward the counter area CA. Also, the transport electrode coating layer 63*c* is configured such that its thickness gradually decreases in the direction from the counter area CA to the downstream intermediate area TDIA and then toward the most downstream area TMDA.

Also, the transport electrode overcoating layer 63*d* is formed thicker in those areas which are located upstream of and downstream of the counter area CA with respect to the toner transport direction TTD, than in the counter area CA.

That is, the transport electrode overcoating layer 63*d* is configured such that its thickness gradually decreases in the direction from the most upstream area TMUA to the upstream intermediate area TUIA and then toward the counter area CA. Also, the transport electrode overcoating layer 63*d* is configured such that its thickness gradually increases in the direction from the counter area CA to the downstream intermediate area TDIA and then toward the most downstream area TMDA.

A laminate of the transport electrode coating later 63*c* and the transport electrode overcoating layer 63*d* is formed into the form of a flat plate so as to have a substantially fixed thickness. Furthermore, the transport electrode overcoating layer 63*d* is formed of a material whose relative dielectric constant is higher than that of the transport electrode coating layer 63*c*.

In the toner electric field transport body 62 (transport wiring substrate 63) of the present embodiment having the above-mentioned configuration, as in the case of the tenth embodiment, the (combined) relative dielectric constant of the laminate of the transport electrode overcoating layer 63*d* and the transport electrode coating layer 63*c* is higher in those areas which are located upstream of and downstream of the counter area CA with respect to the toner transport direction TTD, than in the counter area CA.

The above-mentioned configuration yields actions and effects similar to those which the above-described tenth embodiment yields.

<Twelfth Embodiment of Toner Supply Apparatus>

The configuration of a twelfth embodiment will be described with reference to FIG. 29.

Figure 29:
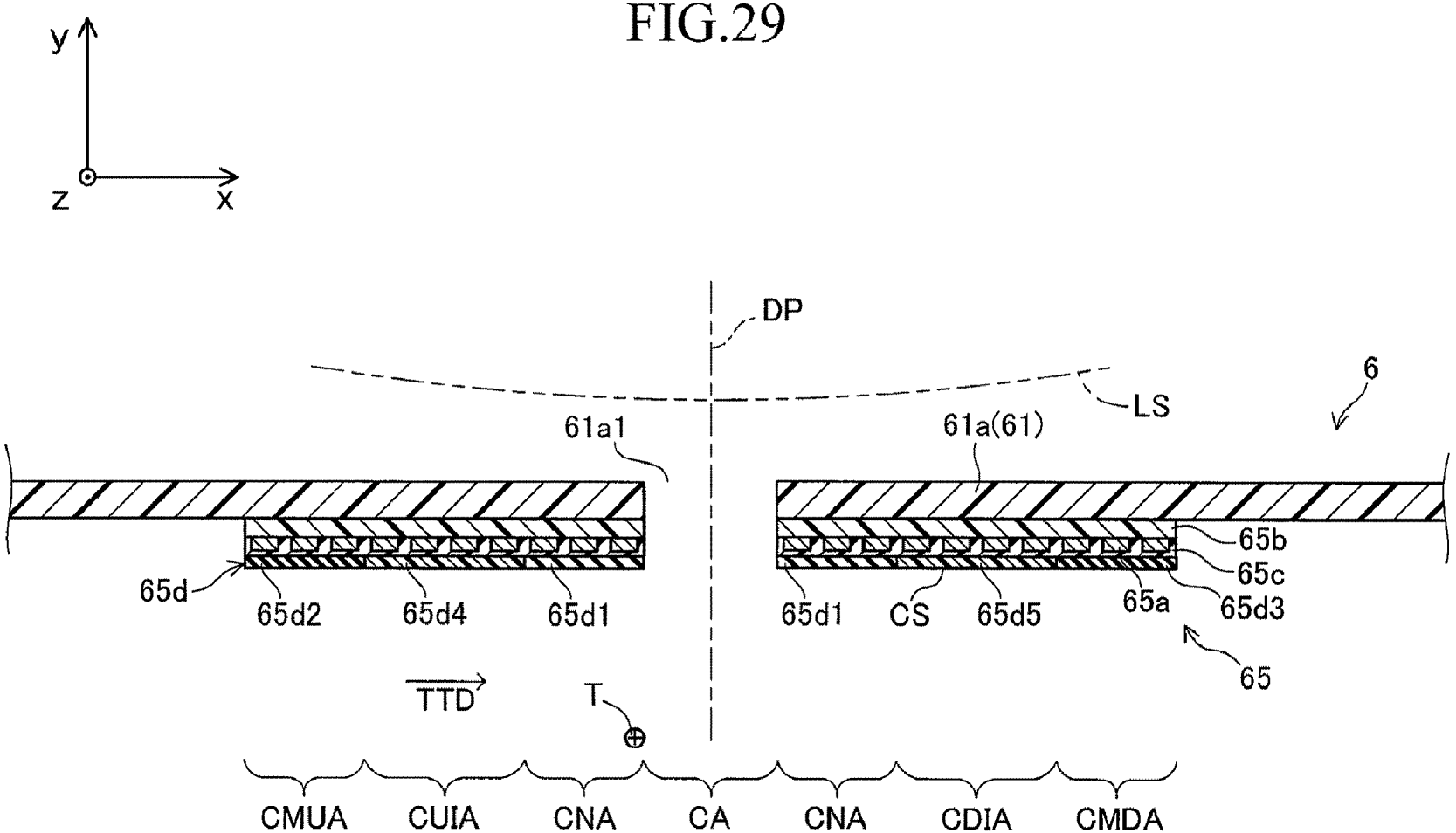
FIG. 29 is a side sectional view showing, on an enlarged scale, a transport wiring substrate in a twelfth embodiment of the toner supply apparatus shown in FIG. 11.

FIG. 29 is a side sectional view showing, on an enlarged scale, the counter wiring substrate 65 in the twelfth embodiment of the toner supply apparatus 6 shown in FIG. 11.

Referring to FIG. 29, the counter electrode overcoating layer 65*d* of the present embodiment includes the low relative dielectric constant portion 65*d*1, the upstream high relative dielectric constant portion 65*d*2, the downstream high relative dielectric constant portion 65*d*3, an upstream intermediate relative dielectric constant portion 65*d*4, and a downstream intermediate relative dielectric constant portion 65*d*5.

The low relative dielectric constant portion 65*d*1 is provided at a portion corresponding to the counter area neighboring area CNA.

The upstream high relative dielectric constant portion 65*d*2 is provided at a position corresponding to a most upstream area CMUA. The most upstream area CMUA is an area of the counter wiring substrate 65 located most upstream with respect to the toner transport direction TTD. The upstream high relative dielectric constant portion 65*d*2 is formed of a material higher in relative dielectric constant than the low relative dielectric constant portion 65*d*1.

The upstream intermediate relative dielectric constant portion 65*d*4 is provided at a position corresponding to an upstream intermediate area CUIA located between the most upstream area CMUA and the counter area neighboring area CNA. The upstream intermediate relative dielectric constant portion 65*d*4 is formed of a material whose relative dielectric constant falls between those of the low relative dielectric constant portion 65*d*1 and the upstream high relative dielectric constant portion 65*d*2.

The downstream high relative dielectric constant portion 65*d*3 is provided at a position corresponding to a most downstream area CMDA. The most downstream area CMDA is an area of the counter wiring substrate 65 located most downstream with respect to the toner transport direction TTD. The downstream high relative dielectric constant portion 65*d*3 is formed of a material higher in relative dielectric constant than the low relative dielectric constant portion 65*d*1.

The downstream intermediate relative dielectric constant portion 65*d*5 is provided at a position corresponding to a downstream intermediate area CDIA located between the most downstream area CMDA and the counter area neighboring area CNA. The downstream intermediate relative dielectric constant portion 65*d*5 is formed of a material whose relative dielectric constant falls between those of the low relative dielectric constant portion 65*d*1 and the downstream high relative dielectric constant portion 65*d*3.

That is, the counter electrode overcoating layer 65*d* is configured such that relative dielectric constant decreases sequentially in the order of the most upstream area CMUA, the upstream intermediate area CUIA, and the counter area neighboring area CNA. Also, the counter electrode overcoating layer 65*d* is configured such that relative dielectric constant increases sequentially in the order of the counter area neighboring area CNA, the downstream intermediate area CDIA, and the most downstream area CMDA.

According to the counter wiring substrate 65 of the present embodiment having the above-mentioned configuration, electric field strength increases in the order of the most upstream area CMUA, the upstream intermediate area TUIA, and the counter area neighboring area CNA.

Thus, the toner T is smoothly accelerated in the course of transport from the most upstream area CMUA to the counter area neighboring area CNA and the counter area CA. Thus, the toner T can be supplied satisfactorily toward the counter area CA and the developing position DP.

Also, according to the counter wiring substrate 65 of the present embodiment having the above-mentioned configuration, electric field strength decreases in the order of the counter area neighboring area CNA, the downstream intermediate area CDIA, and the most downstream area CMDA.

Therefore, when the toner T which has passed the developing position DP is ejected from the developing position DP toward the bottom portion of the toner box 61 via the most downstream area TMDA, stagnation of the toner T at a specific location can be effectively prevented, which stagnation would otherwise occur due to local slowdown of the flow of the toner T. Thus, discharge of the toner T from the developing position DP toward the bottom portion of the toner box 61 via the most downstream area CMDA can be performed smoothly.

Moreover, according to the present embodiment having the above-described configuration, the strength of an electric field component which presses the toner T downward in FIG. 29 (toward the toner transport surface TTS in FIG. 11); i.e., the strength of an electric field component which causes the toner T to move from the opening edges of the toner passage hole 61*a*1 toward the inside of the toner box 61*a*, is made the highest at the opening edges of the toner passage hole 61*a*1.

Thus, undesired jetting of the toner T at the opening edges of the toner passage hole 61*a*1 can be effectively suppressed. Therefore, good image formation with suppressed generation of "white-background fogging" can be performed.

<Thirteenth Embodiment of Toner Supply Apparatus>

The configuration of a thirteenth embodiment will now be described with reference to FIG. 30.

Figure 30:
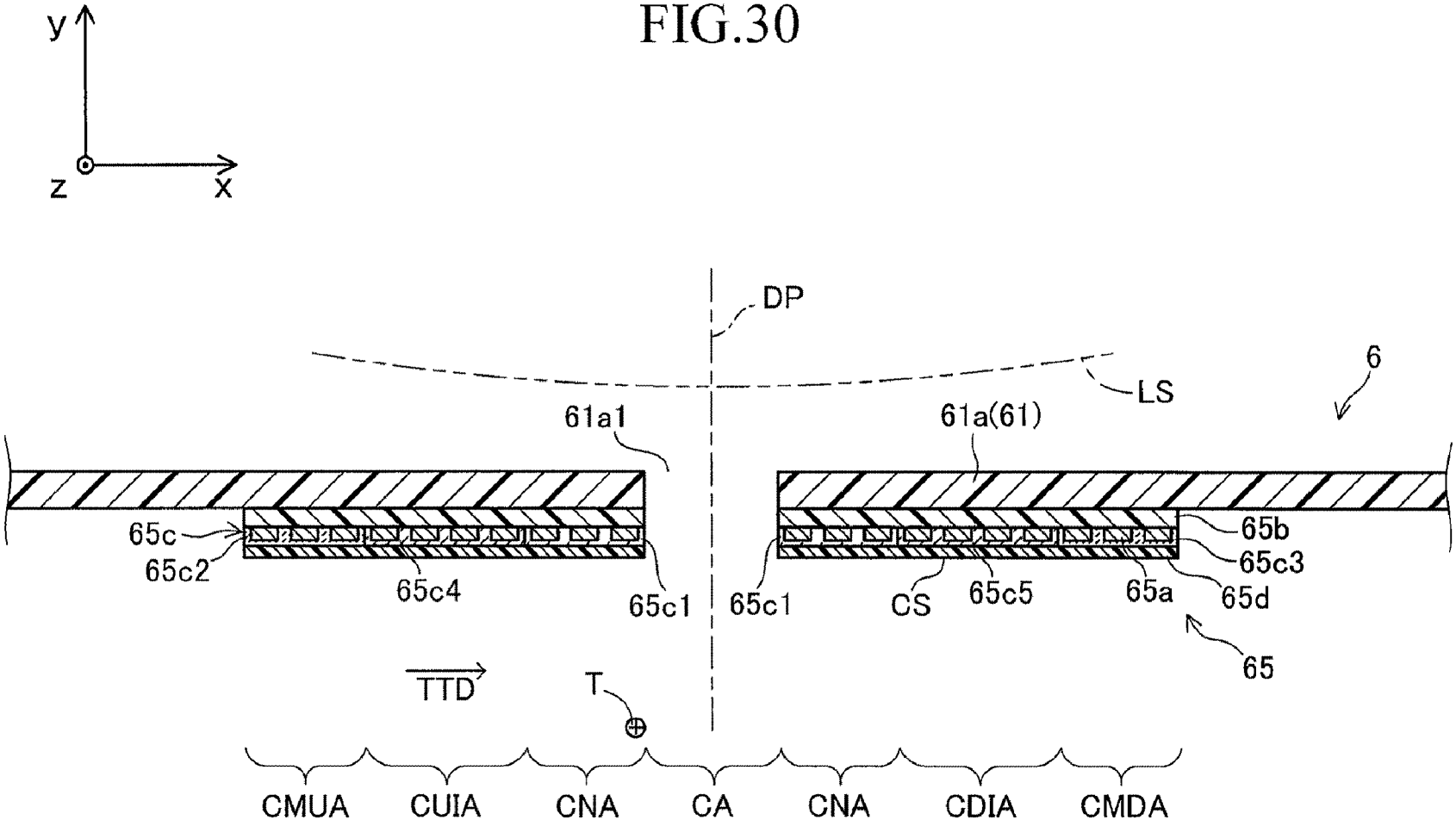
FIG. 30 is a side sectional view showing, on an enlarged scale, a counter wiring substrate in a thirteenth embodiment of the toner supply apparatus shown in FIG. 11.

FIG. 30 is a side sectional view showing, on an enlarged scale, the counter wiring substrate 65 in the thirteenth embodiment of the toner supply apparatus 6 shown in FIG. 11.

In the present embodiment, in place of the counter electrode overcoating layer 65*d* of FIG. 29, the counter electrode coating layer 65*c* includes a low relative dielectric constant portion 65*c*1, an upstream high relative dielectric constant portion 65*c*2, a downstream high relative dielectric constant portion 65*c*3, an upstream intermediate relative dielectric constant portion 65*c*4, and a downstream intermediate relative dielectric constant portion 65*c*5.

The low relative dielectric constant portion 65*c*1 is provided at a portion corresponding to the counter area neighboring area CNA.

The upstream high relative dielectric constant portion 65*c*2 is provided at a position corresponding to the most upstream area CMUA.

The upstream high relative dielectric constant portion 65*c*2 is formed of a material higher in relative dielectric constant than the low relative dielectric constant portion 65*c*1.

The upstream intermediate relative dielectric constant portion 65*c*4 is provided at a position corresponding to the upstream intermediate area CUIA located between the most upstream area CMUA and the counter area neighboring area CNA. The upstream intermediate relative dielectric constant portion 65*c*4 is formed of a material whose relative dielectric constant falls between those of the low relative dielectric constant portion 65*c*1 and the upstream high relative dielectric constant portion 65*c*2.

The downstream high relative dielectric constant portion 65*c*3 is provided at a position corresponding to the most downstream area CMDA. The downstream high relative dielectric constant portion 65*c*3 is formed of a material higher in relative dielectric constant than the low relative dielectric constant portion 65*c*1.

The downstream intermediate relative dielectric constant portion 65*c*5 is provided at a position corresponding to the downstream intermediate area CDIA located between the most downstream area CMDA and the counter area neighboring area CNA. The downstream intermediate relative dielectric constant portion 65*c*5 is formed of a material whose relative dielectric constant falls between those of the low relative dielectric constant portion 65*c*1 and the downstream high relative dielectric constant portion 65*c*3.

That is, the counter electrode coating layer 65*c* is configured such that relative dielectric constant decreases sequentially in the order of the most upstream area CMUA, the upstream intermediate area CUIA, and the counter area neighboring area CNA. Also, the counter electrode coating layer 65*c* is configured such that relative dielectric constant increases sequentially in the order of the counter area neighboring area CNA, the downstream intermediate area CDIA, and the most downstream area CMDA.

Even the above-mentioned configuration yields actions and effects similar to those which the above-described twelfth embodiment yields.

<Fourteenth Embodiment of Toner Supply Apparatus>

The configuration of a fourteenth embodiment will now be described with reference to FIG. 31.

Figure 31:
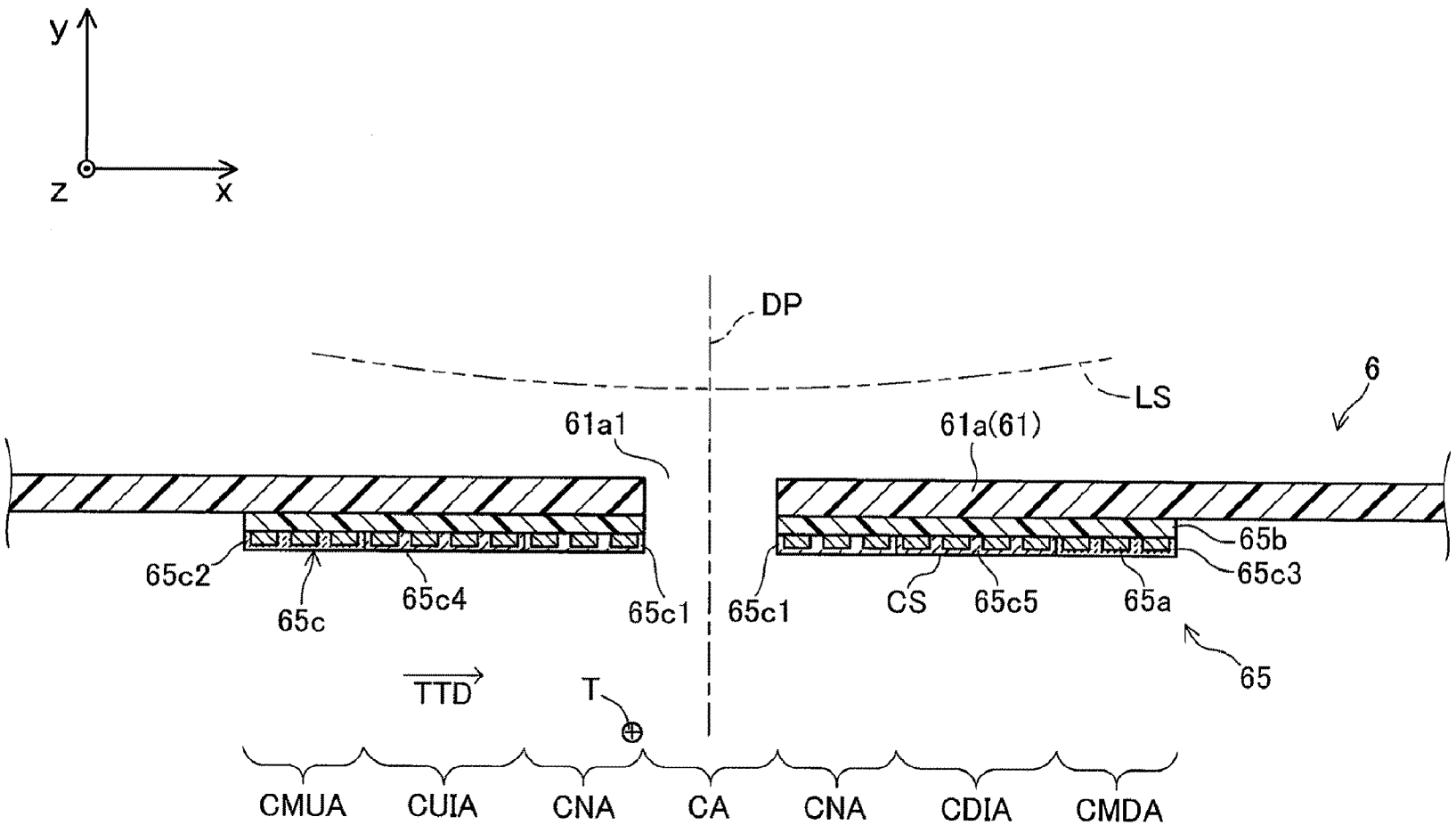
FIG. 31 is a side sectional view showing, on an enlarged scale, a counter wiring substrate in a fourteenth embodiment of the toner supply apparatus shown in FIG. 11.

FIG. 31 is a side sectional view showing, on an enlarged scale, the counter wiring substrate 65 in the fourteenth embodiment of the toner supply apparatus 6 shown in FIG. 11.

In the present embodiment, the transport electrode overcoating layer 65*d* (see FIG. 30) employed in the structure of the thirteenth embodiment is omitted. That is, in the present embodiment, the counter electrode coating layer 65*c* serves as the counter electrode cover member of the present invention.

Even the above-mentioned configuration yields actions and effects similar to those which the above-described twelfth and thirteenth embodiments yield.

<Fifteenth Embodiment of Toner Supply Apparatus>

The configuration of a fifteenth embodiment will be described with reference to FIG. 32.

Figure 32:
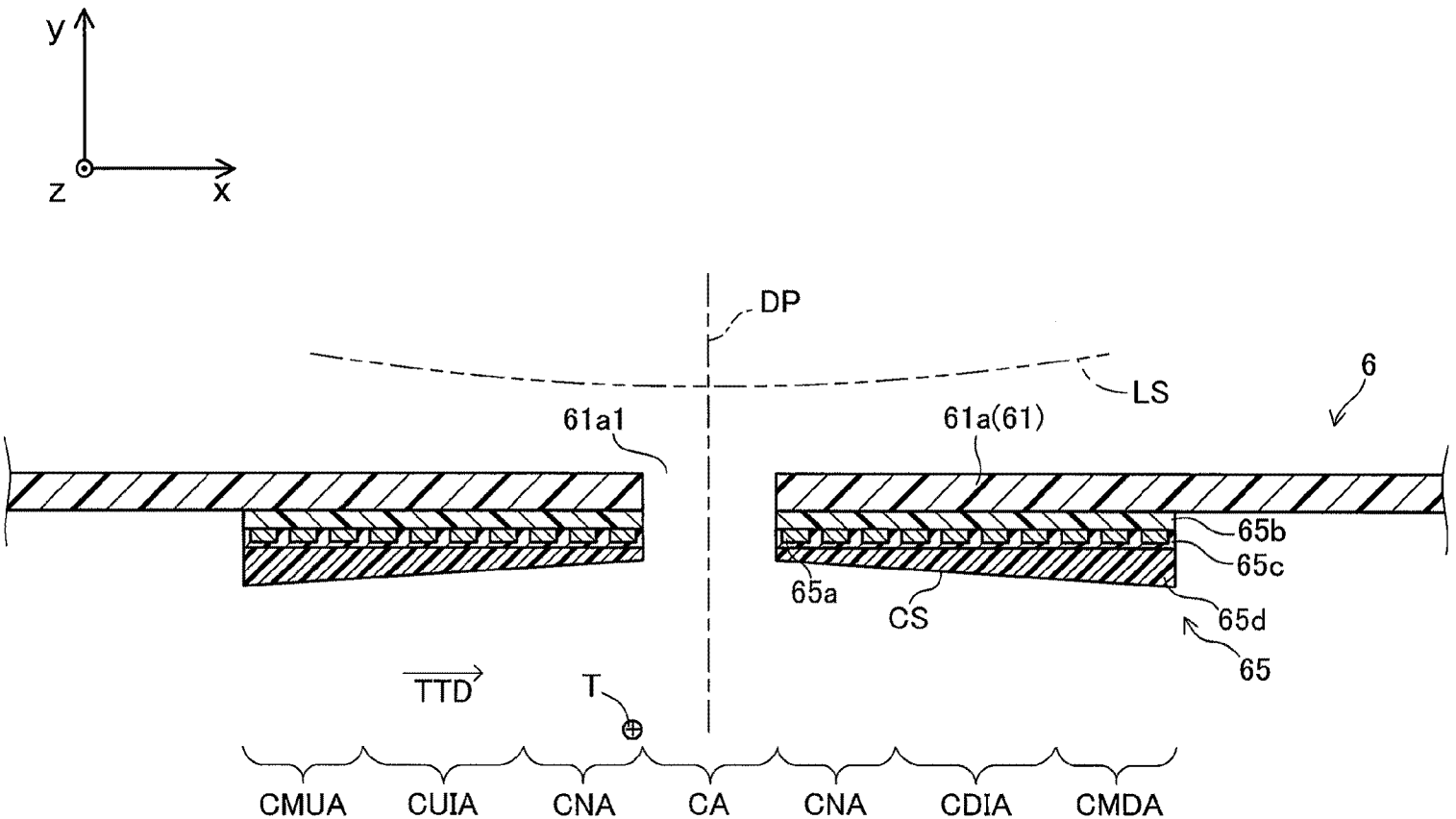
FIG. 32 is a side sectional view showing, on an enlarged scale, a counter wiring substrate in a fifteenth embodiment of the toner supply apparatus shown in FIG. 11.

FIG. 32 is a side sectional view showing, on an enlarged scale, the counter wiring substrate 65 in the fifteenth embodiment of the toner supply apparatus 6 shown in FIG. 11.

In the present embodiment, the counter electrode overcoating layer 65*d* is configured such that its thickness decreases in the direction from the most upstream area CMUA to the upstream intermediate area CUIA and then toward the counter area neighboring area CNA. Also, the counter electrode overcoating layer 65*d* is configured such that its thickness increases in the direction from the counter area neighboring area CNA to the downstream intermediate area CDIA and then toward the most downstream area CMDA.

Even the above-mentioned configuration yields actions and effects similar to those which the above-described twelfth through fourteenth embodiments yield.

<Sixteenth Embodiment of Toner Supply Apparatus>

The configuration of a sixteenth embodiment will be described with reference to FIG. 33.

Figure 33:
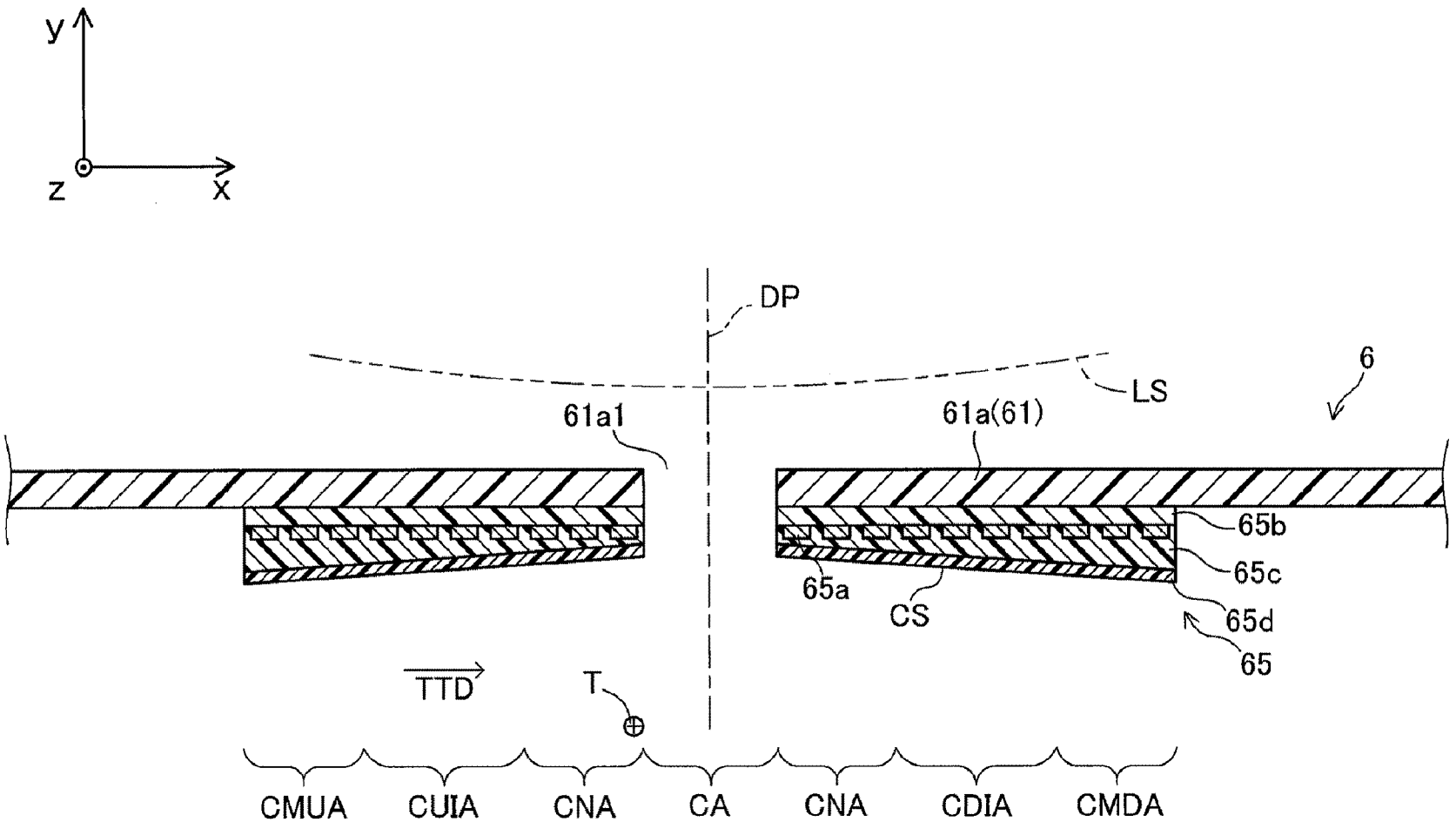
FIG. 33 is a side sectional view showing, on an enlarged scale, a counter wiring substrate in a sixteenth embodiment of the toner supply apparatus shown in FIG. 11.

FIG. 33 is a side sectional view showing, on an enlarged scale, the counter wiring substrate 65 in the sixteenth embodiment of the toner supply apparatus 6 shown in FIG. 11.

In the present embodiment, in place of the counter electrode overcoating layer 65*d* in FIG. 32, the counter electrode coating layer 65*c* is configured such that its thickness gradually varies in the toner transport direction TTD.

Specifically, the counter electrode coating layer 65*c* is configured such that its thickness decreases in the direction from the most upstream area CMUA to the upstream intermediate area CUIA and then toward the counter area neighboring area CNA. Also, the counter electrode coating layer 65*c* is configured such that its thickness increases in the direction from the counter area neighboring area CNA to the downstream intermediate area CDIA and then toward the most downstream area CMDA.

Even the above-mentioned configuration yields actions and effects similar to those which the above-described fifteenth embodiment yield.

<Seventeenth Embodiment of Toner Supply Apparatus>

The configuration of a seventeenth embodiment will be described with reference to FIG. 34.

Figure 34:
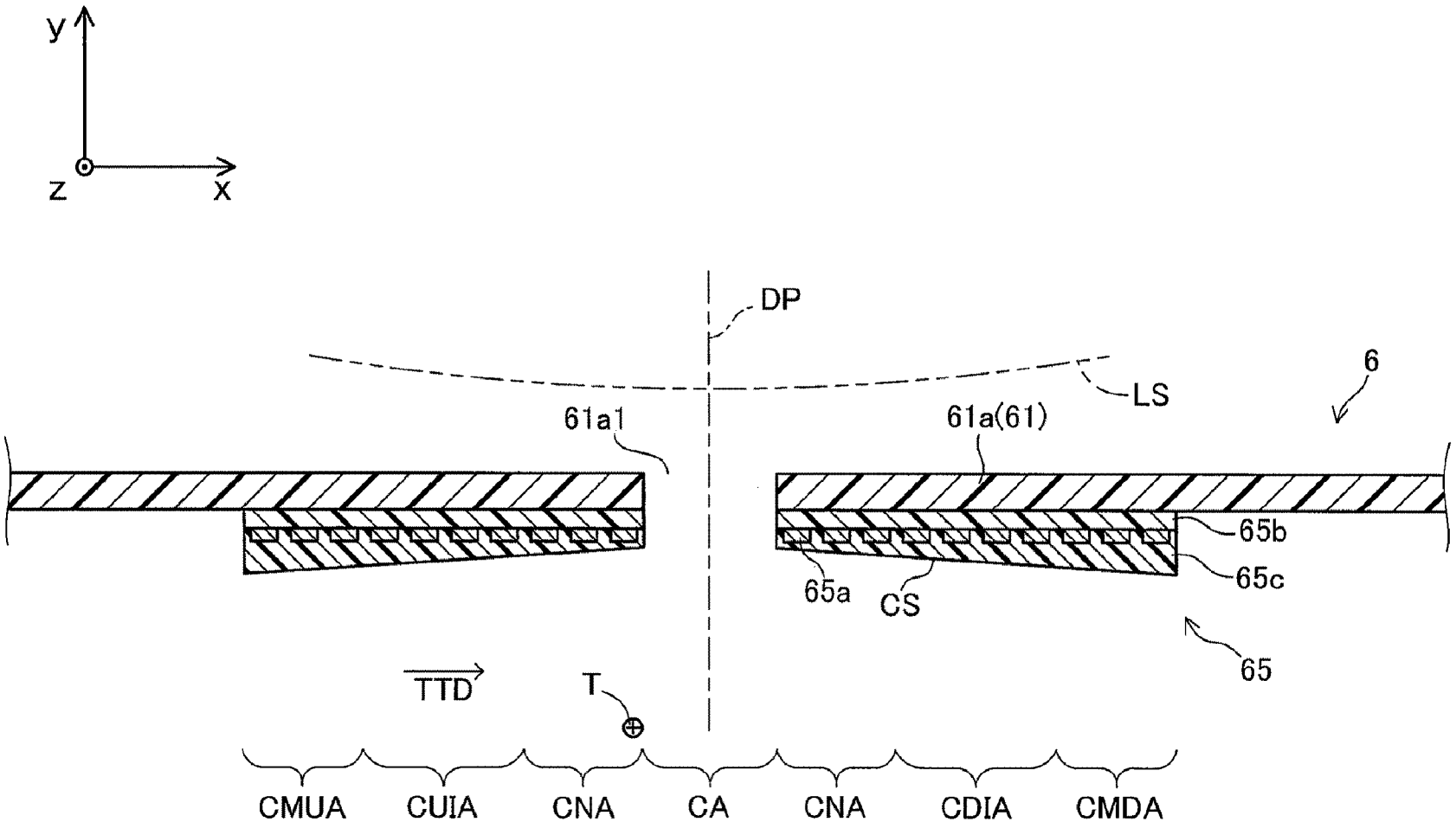
FIG. 34 is a side sectional view showing, on an enlarged scale, a counter wiring substrate in a seventeenth embodiment of the toner supply apparatus shown in FIG. 11.

FIG. 34 is a side sectional view showing, on an enlarged scale, the counter wiring substrate 65 in the seventeenth embodiment of the toner supply apparatus 6 shown in FIG. 11.

In the present embodiment, the counter electrode overcoating layer 65*d* (see FIG. 33) employed in the configuration of the above-described sixteenth embodiment is eliminated. That is, in the present embodiment, the counter electrode coating layer 65*c* serves as the transport electrode cover member of the present invention.

Even the above-mentioned configuration yields actions and effects similar to those which the above-described sixteenth embodiment yields.

<Eighteenth Embodiment of Toner Supply Apparatus>

The configuration of an eighteenth embodiment will be described with reference to FIG. 35.

Figure 35:
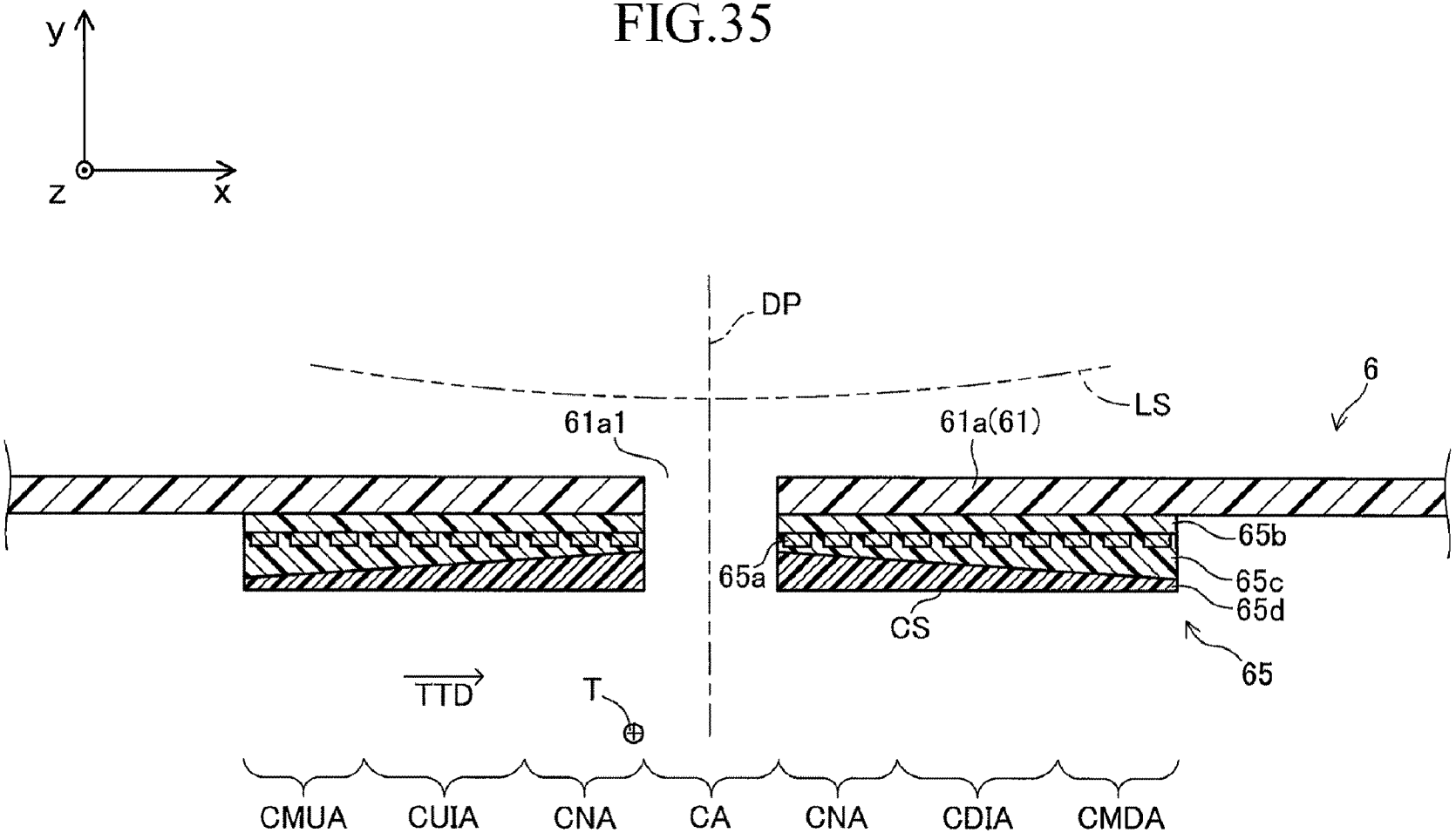
FIG. 35 is a side sectional view showing, on an enlarged scale, a counter wiring substrate in an eighteenth embodiment of the toner supply apparatus shown in FIG. 11.

FIG. 35 is a side sectional view showing, on an enlarged scale, the counter wiring substrate 65 in the eighteenth embodiment of the toner supply apparatus 6 shown in FIG. 11.

In the present embodiment, the counter electrode coating layer 65*c* is formed thicker in those areas which are located upstream of and downstream of the counter area neighboring area CNA with respect to the toner transport direction TTD, than in the counter area neighboring area CNA.

That is, the counter electrode coating layer 65*c* is configured such that its thickness decreases in the direction from the most upstream area CMUA to the upstream intermediate area CUIA and then toward the counter area CA. Also, the counter electrode coating layer 65*c* is configured such that its thickness increases in the direction from the counter area CA to the downstream intermediate area CDIA and then toward the most downstream area CMDA.

Also, the counter electrode overcoating layer 65*d* is formed thinner in those areas which are located upstream of and downstream of the counter area neighboring area CNA with respect to the toner transport direction TTD, than in the counter area neighboring area CNA.

That is, the counter electrode overcoating layer 65*d* is configured such that its thickness increases in the direction from the most upstream area CMUA to the upstream intermediate area CUIA and then toward the counter area CA. Also, the counter electrode overcoating layer 65*d* is configured such that its thickness gradually decreases in the direction from the counter area CA to the downstream intermediate area CDIA and then toward the most downstream area CMDA.

A laminate of the counter electrode coating later 65*c* and the counter electrode overcoating layer 65*d* is formed into the form of a flat plate so as to have a substantially fixed thickness. Furthermore, the counter electrode overcoating layer 65*d* is formed of a material whose relative dielectric constant is lower than that of the counter electrode coating layer 65*c*.

In the toner electric field transport body 62 (transport wiring substrate 63) of the present embodiment having the above-mentioned configuration, the (combined) relative dielectric constant of the laminate of the transport electrode overcoating layer 63*d* and the transport electrode coating layer 63*c* is higher in those areas which are located upstream of and downstream of the counter area CA with respect to the toner transport direction TTD, than in the counter area CA.

That is, the relative dielectric constant of the laminate gradually decreases in the direction from the most upstream area CMUA to the upstream intermediate area CUIA and then toward the counter area neighboring area CNA. Also, the relative dielectric constant of the laminate gradually increases in the direction from the counter area neighboring area CNA to the downstream intermediate area CDIA and then toward the most downstream area CMDA.

Thus, when traveling wave voltages are applied to the counter electrodes 65*a*, electric field strength is higher in the counter area neighboring area CNA than in the upstream and downstream areas with respect to the toner transport direction TTD.

That is, the electric field strength gradually increases in the direction from the most upstream area CMUA to the upstream intermediate area CUIA and then toward the counter area neighboring area CNA. Also, the electric field strength gradually decreases in the direction from the counter area neighboring area CNA to the downstream intermediate area CDIA and then toward the most downstream area CMDA.

The above-mentioned configuration yields actions and effects similar to those which the above-described twelfth to seventeenth embodiments yield.

<Nineteenth Embodiment of Toner Supply Apparatus>

The configuration of a nineteenth embodiment will be described with reference to FIG. 36.

Figure 36:
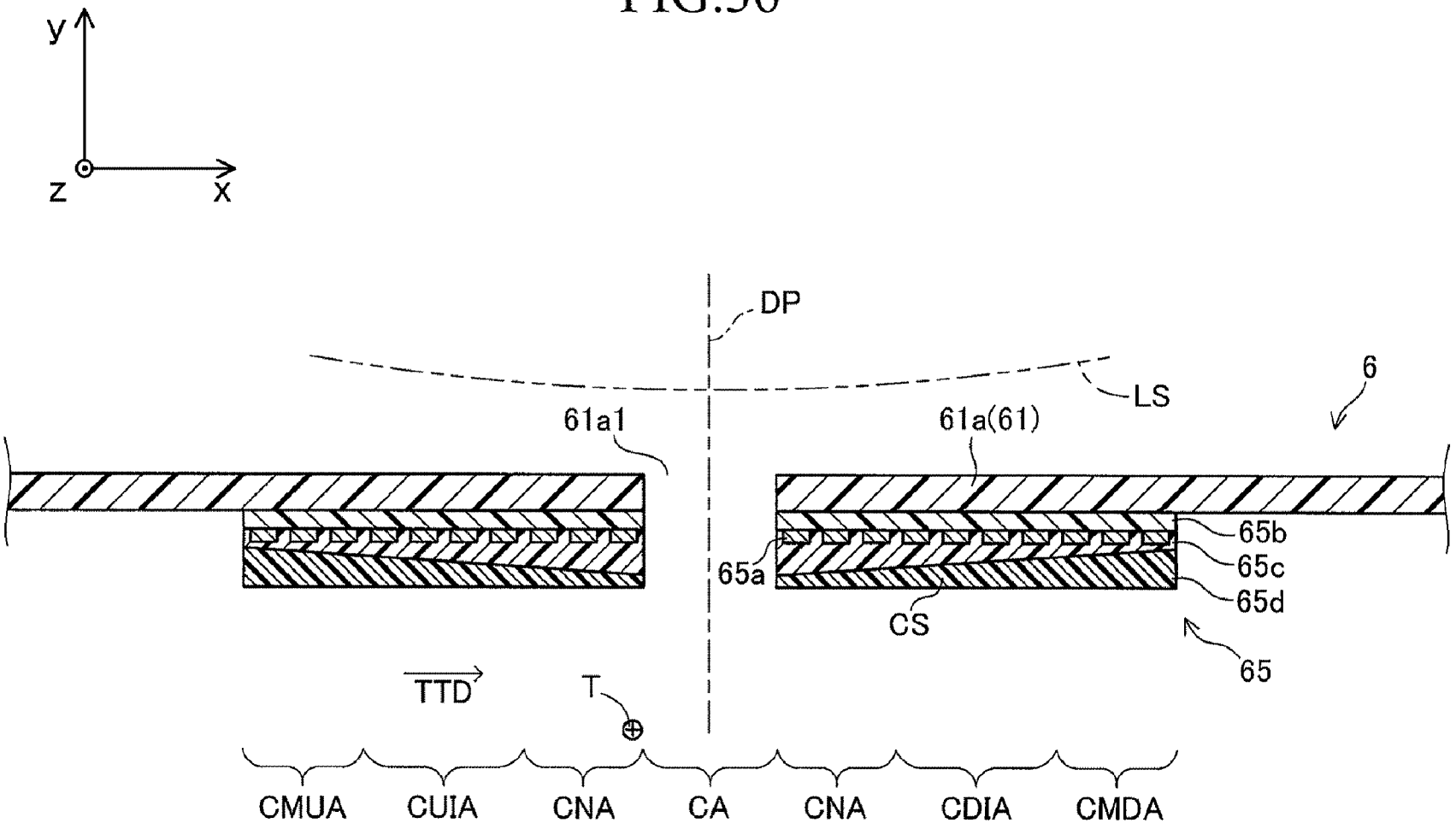
FIG. 36 is a side sectional view showing, on an enlarged scale, a counter wiring substrate in a nineteenth embodiment of the toner supply apparatus shown in FIG. 11.

FIG. 36 is a side sectional view showing, on an enlarged scale, the counter wiring substrate 65 in the nineteenth embodiment of the toner supply apparatus 6 shown in FIG. 11.

Referring to FIG. 36, in the present embodiment, the counter electrode coating layer 65*c* is formed thinner in those areas which are located upstream of and downstream of the counter area neighboring area CNA with respect to the toner transport direction TTD, than in the counter area neighboring area CNA.

That is, the counter electrode coating layer 65*c* is configured such that its thickness gradually increases in the direction from the most upstream area CMUA to the upstream intermediate area CUIA and then toward the counter area neighboring area CNA. Also, the counter electrode coating layer 65*c* is configured such that its thickness gradually decreases in the direction from the counter area neighboring area CNA to the downstream intermediate area CDIA and then toward the most downstream area CMDA.

Also, the counter electrode overcoating layer 65*d* is formed thicker in those areas which are located upstream of and downstream of the counter area neighboring area CNA with respect to the toner transport direction TTD, than in the counter area neighboring area CNA.

That is, the counter electrode overcoating layer 65*d* is configured such that its thickness gradually decreases in the direction from the most upstream area CMUA to the upstream intermediate area CUIA and then toward the counter area neighboring area CNA. Also, the counter electrode overcoating layer 65*d* is configured such that its thickness gradually increases in the direction from the counter area neighboring area CNA to the downstream intermediate area CDIA and then toward the most downstream area CMDA.

A laminate of the counter electrode coating later 65*c* and the counter electrode overcoating layer 65*d* is formed into the form of a flat plate so as to have a substantially fixed thickness. Furthermore, the counter electrode overcoating layer 65*d* is formed of a material whose relative dielectric constant is higher than that of the counter electrode coating layer 65*c*.

In the counter wiring substrate 65 of the present embodiment having the above-mentioned configuration, as in the case of the eighteenth embodiment, the (combined) relative dielectric constant of the laminate of the counter electrode overcoating layer 65*d* and the counter electrode coating layer 65*c* is higher in those areas which are located upstream of and downstream of the counter area neighboring area CNA with respect to the toner transport direction TTD, than in the counter area neighboring area CNA.

The above-mentioned configuration yields actions and effects similar to those which the above-described eighteenth embodiment yields.

<Twentieth Embodiment of Toner Supply Apparatus>

The configuration of a twentieth embodiment will be described with reference to FIG. 37.

Figure 37:
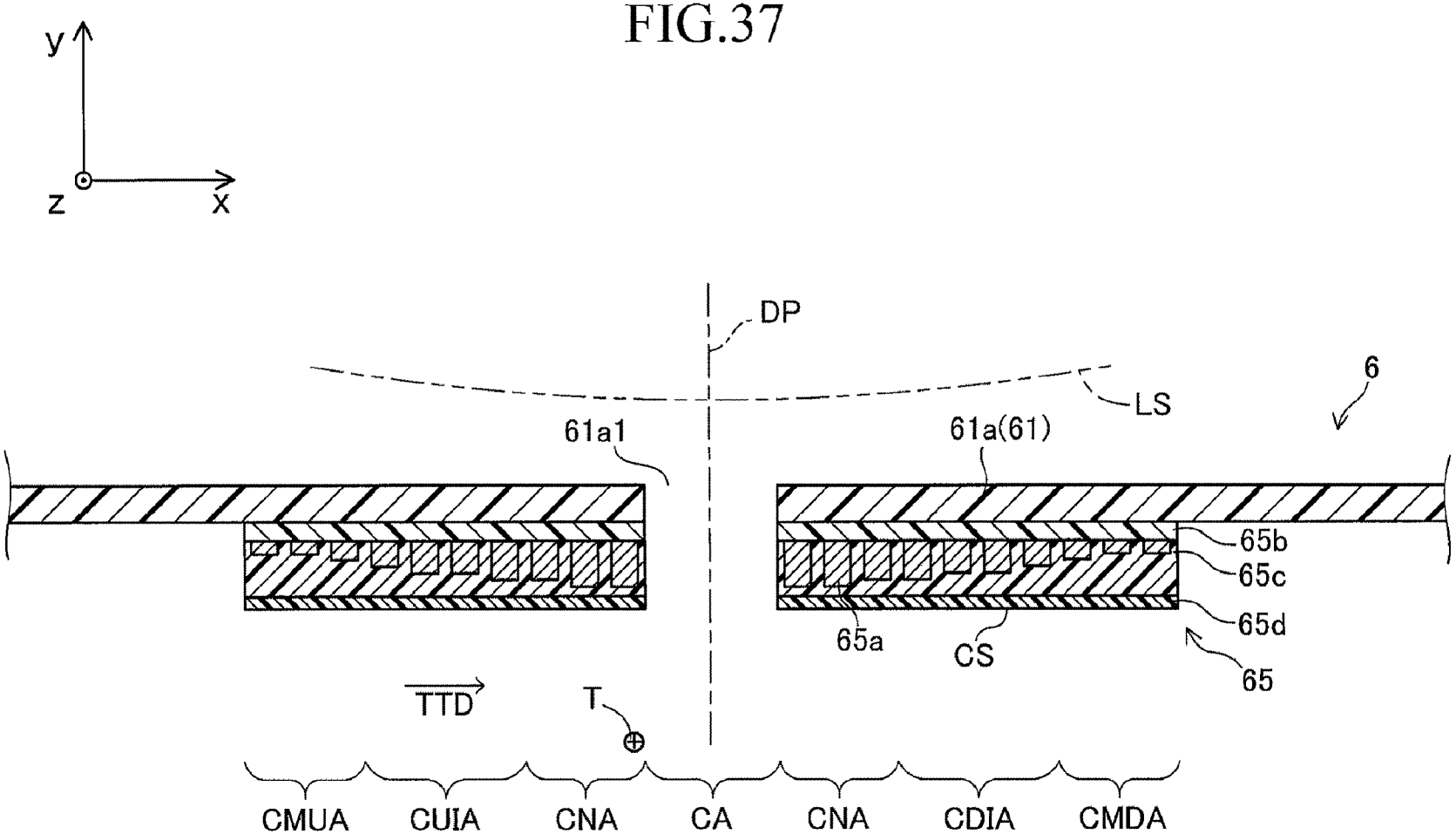
FIG. 37 is a side sectional view showing, on an enlarged scale, a counter wiring substrate in a twentieth embodiment of the toner supply apparatus shown in FIG. 11.

FIG. 37 is a side sectional view showing, on an enlarged scale, the counter wiring substrate 65 in the twentieth embodiment of the toner supply apparatus 6 shown in FIG. 11.

Referring to FIG. 37, in the present embodiment, the counter electrodes 65*a* are configured such that their thickness gradually varies in the toner transport direction TTD.

Specifically, the counter electrodes 65*a* are configured such that their thickness increases in the direction from the most upstream area CMUA to the upstream intermediate area CUIA and then toward the counter area neighboring area CNA. Also, the counter electrodes 65*a* are configured such that their thickness decreases in the direction from the counter area neighboring area CNA to the downstream intermediate area CDIA and then toward the most downstream area CMDA.

According to such a configuration, as in the case of the configurations of the twelfth to nineteenth embodiments, electric field strength on the toner transport surface TTS and that on the counter wiring substrate surface CS gradually varies in the toner transport direction TTD. Thus, actions and effects similar to those of the above-described twelfth to nineteenth embodiments can be attained.

<Modifications of Present Mode>

(1) In FIG. 12, the low relative dielectric constant portion 63*d*1 of the transport wiring substrate 63 may be provided such that the low relative dielectric constant portion 63*d*1 projects from the upstream end and/or downstream end of the counter area CA with respect to the toner transport direction TTD. That is, the low relative dielectric constant portion 63*d*1 of the transport wiring substrate 63 may face the low relative dielectric constant portion 65*d*1 of the counter wiring substrate 65.

(2) In the above-described embodiments, relative dielectric constant or thickness may vary continuously or stepwise.

Further, the boundary positions of the upstream intermediate area CUIA, the downstream intermediate area CDIA, the upstream intermediate area TUIA, and the downstream intermediate area TDIA in FIG. 21, etc. are not limited to those shown in the drawings and described in the above-described embodiments.

Moreover, each of the upstream intermediate area CUIA, the downstream intermediate area CDIA, the upstream intermediate area TUIA, and the downstream intermediate area TDIA in FIG. 21, etc. may be divided into a plurality of areas.

(3) In FIGS. 24, 25, and 26, the toner transport surface TTS of the central component portion 62*a* may be formed as a plane parallel to the x-z plane.

Further, in FIGS. 32, 23, and 34, the counter wiring substrate surface CS may be formed as a plane parallel to the x-z plane.

(4) Needless to say, the transport wiring substrate 63 and the counter wiring substrate 65 (including those modified in the above-described manner) of the above-described embodiments may be combined in any manner.

<Suggestions on Modifications of First and Second Modes>

The above-described specific examples (which include the modes, the embodiments, and the individual modifications of the modes and embodiments; the same convention also applies to the following description) are, as mentioned previously, mere typical examples which the applicant of the present invention contemplated as the best at the time of filing the present application. Thus, the present invention is not limited to the specific configurations of the specific examples described above. Various modifications to the specific examples described above are possible so long as the invention is not modified in essence.

Several typical modifications will be cited below. Needless to say, even modifications are not limited to those cited below. Also, a plurality of embodiments and modifications can be combined as appropriate so long as no technical inconsistencies are involved.

The above-described specific examples and the following modifications should not be construed as limiting the present invention (particularly, those components which partially constitute means for solving the problems to be solved by the invention and are illustrated with respect to operations and functions). Such limiting construal is impermissible, since it unfairly impairs the interests of an applicant (who is motivated to file as quickly as possible under the first-to-file system) and unfairly benefits imitators, and is adverse to the purpose of the Patent Law of protecting and utilizing inventions.

(1) Application of the present invention is not limited to a monochromatic laser printer. For example, the present invention can be preferably applied to so-called electrophotographic image forming apparatus, such as color laser printers and monochromatic and color copying machines. At this time, the shape of a photoconductor is not limited to a drum shape as in the specific examples described above. For example, the photoconductor may assume the form of a flat plate or an endless belt.

Also, the present invention can be preferably applied to image forming apparatus of other than the above-mentioned electrophotographic system (for example, image forming systems which do not use photoconductor, such as a toner jet system, an ion flow system, and a multistylus electrode system).

(2) In the specific examples described above, voltages generated by the power circuits VA to VD are of rectangular waveforms. However, the voltages may be of other waveforms, such as sine waveforms and triangular waveforms.

The specific examples described above employ four power circuits VA to VD and are configured such that voltages generated by the power circuits VA to VD shift 90° in phase from one another. However, three power circuits may be provided such that voltages generated by the power circuits shift 120° in phase from one another.

(3) The counter wiring substrate 65 can have a configuration similar to that of the transport wiring substrate 63 of the specific examples described above. Alternatively, the counter wiring substrate 65 can be omitted partially or entirely.

(4) Although they are not mentioned specifically, variations other than those mentioned above are possible without departing from the gist of the present invention.

Those components which partially constitute means for solving the problems to be solved by the invention and are illustrated with respect to operations and functions encompass not only the specific structures disclosed above in the description of the specific examples but also any other structures that can implement the operations and functions.

The invention claimed is:

1. An image forming apparatus comprising:

an electrostatic latent image carrying body having a latent image forming surface formed in parallel with a predetermined main scanning direction and configured to be able to form an electrostatic latent image thereon by means of electric potential distribution, and configured such that the latent image forming surface can move along a sub-scanning direction orthogonal to the main scanning direction and a developer supply apparatus disposed in such a manner as to face the electrostatic latent image carrying body and configured to be able to supply a developer in a charged state to the latent image forming surface, wherein the developer supply apparatus comprises:

a plurality of transport electrodes arrayed along the sub-scanning direction and configured to be able to transport the developer in a predetermined developer transport direction through application of traveling wave voltages thereto;

a transport electrode support member configured to support the transport electrodes on its surface; and a transport electrode cover member formed in such a manner as to cover the surface of the transport electrode support member and the transport electrodes and having a developer transport surface which is in parallel with the main scanning direction and faces the latent image forming surface, wherein the transport electrode cover member is formed such that, in an area in the vicinity of a closest proximity position where the latent image forming surface and the developer transport surface face in the closest proximity to each other, the transport electrode cover member has different relative dielectric constants at first and second portions, respectively, wherein the first portions correspond to the transport electrodes, and the second portions differ from the first portions.

* * * * *